US010064499B2

(12) United States Patent
Szymanski et al.

(10) Patent No.: US 10,064,499 B2
(45) Date of Patent: Sep. 4, 2018

(54) RECONFIGURABLE INFANT PLAY YARD

(71) Applicant: Mattel, Inc., El Segundo, CA (US)

(72) Inventors: Matthew Alan Szymanski, East Aurora, NY (US); Charles Smith, East Amherst, NY (US); Lawrence M. Hopcia, Alden, NY (US); John S. Canna, Orchard Park, NY (US); Juliette Marlene Welch, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 195 days.

(21) Appl. No.: 14/842,904

(22) Filed: Sep. 2, 2015

(65) Prior Publication Data

US 2016/0183698 A1 Jun. 30, 2016

Related U.S. Application Data

(60) Provisional application No. 62/046,333, filed on Sep. 5, 2014.

(51) Int. Cl.
*A47D 13/06* (2006.01)
*A47D 9/00* (2006.01)

(52) U.S. Cl.
CPC ..... *A47D 13/063* (2013.01); *A47D 9/005* (2013.01); *A47D 13/06* (2013.01); *A47D 13/061* (2013.01); *A47D 13/066* (2013.01)

(58) Field of Classification Search
CPC . A47D 9/00; A47D 9/005; A47D 9/02; A47D 13/06; A47D 13/061; A47D 13/063;
(Continued)

(56) References Cited

U.S. PATENT DOCUMENTS 210,156 A 11/1878 Schultes et al.
234,016 A 11/1880 Fosburgh
(Continued)

FOREIGN PATENT DOCUMENTS

WO 2013003320 A2 1/2013

*Primary Examiner* — Nicholas F Polito
*Assistant Examiner* — David R Hare
(74) *Attorney, Agent, or Firm* — Edell, Shapiro & Finnan, LLC

(57) ABSTRACT

The present invention relates to an infant play yard with multiple reconfigurations. The infant play yard includes a frame structure that is reconfigurable between a deployed configuration and a storage configuration. Rotatably coupled to the frame structure is a set of legs that are reconfigurable between a deployed configuration and a storage configuration. The infant play yard includes an infant play yard cover that is coupled to the frame structure, the play yard cover having an exterior and an interior. Moreover, the infant play yard further includes a sleeper insert that is removably coupleable to the frame structure. The sleeper insert, when used in conjunction with the frame structure, is disposed between the sidewalls of the play yard cover. The sleeper insert is configured with locking covers that are removably coupleable to the legs of the play yard frame. The locking covers are connected by a resilient tether so that the locking covers easily snap into the proper locking location on the legs of the play yard frame.

11 Claims, 36 Drawing Sheets

(58) Field of Classification Search
CPC .. A47D 13/066; A47D 13/068; A47D 13/105; A47D 13/107; A47D 15/001; A47D 15/003
See application file for complete search history.

(56) References Cited

U.S. PATENT DOCUMENTS 485,081 A 10/1892 Baird
1,105,156 A * 7/1914 Oliphant ..... A47D 13/063 5/288
1,526,038 A 2/1925 Allman
1,879,665 A 9/1932 Ekvall
2,553,579 A 5/1951 Harris
2,617,999 A 11/1952 Mitchell
2,851,700 A 9/1958 Denison
2,936,464 A 5/1960 Miller et al.
3,127,620 A 4/1964 Peterson
3,644,947 A 2/1972 Padera
3,848,277 A * 11/1974 Reguitti ..... A47D 7/00 24/16 PB
4,941,453 A 7/1990 Shakas et al.
4,967,432 A 11/1990 Kujawski et al.
5,039,118 A 8/1991 Huang
5,109,556 A 5/1992 Cook
5,168,601 A 12/1992 Liu
5,243,718 A 9/1993 Shamie
5,339,470 A * 8/1994 Shamie ..... A47D 13/063 5/93.2
5,553,336 A 9/1996 Mariol
5,778,465 A 7/1998 Myers
5,813,064 A 9/1998 Hartenstine
5,867,850 A 2/1999 Mariol
5,991,944 A * 11/1999 Yang ..... A47D 7/04 403/231
6,058,528 A * 5/2000 Yang ..... A47D 7/04 5/93.1
6,076,205 A * 6/2000 Yang ..... A47D 7/04 403/205
6,131,218 A * 10/2000 Wang ..... A47D 13/06 5/93.1
6,182,308 B1 * 2/2001 Yang ..... A47D 7/04 24/616
6,233,759 B1 5/2001 Warner, Jr. et al.
D448,218 S 9/2001 Celestina-Krevh
6,430,762 B1 8/2002 Cheng
6,434,767 B1 8/2002 Welsh, Jr.
6,510,570 B2 1/2003 Hartenstine et al.
6,526,608 B1 * 3/2003 Hsia ..... A47D 7/04 5/93.1
6,543,070 B2 4/2003 Longenecker et al.
6,588,033 B1 7/2003 Welsh, Jr. et al.
6,634,038 B2 * 10/2003 Hsia ..... A47D 13/063 5/93.1
6,687,927 B1 2/2004 Tharalson et al.
6,704,949 B2 3/2004 Waldman et al.
6,735,796 B2 5/2004 Warner, Jr. et al.
6,886,195 B2 5/2005 Vidal
6,895,611 B2 5/2005 Tharalson et al.
6,901,613 B1 6/2005 Hsia
6,907,626 B1 6/2005 Welsh, Jr. et al.
6,934,981 B2 8/2005 Waldman et al.
6,948,197 B1 9/2005 Chen
6,961,968 B2 11/2005 Clapper et al.
7,003,821 B2 2/2006 DeHart et al.
7,013,505 B2 3/2006 Martin
7,055,191 B1 * 6/2006 Chen ..... A47D 13/06 5/93.2
7,111,339 B2 9/2006 Chen
D534,381 S 1/2007 Troutman et al.
D537,277 S 2/2007 Chen
7,263,729 B2 * 9/2007 Paesang ..... A47D 7/04 5/93.1
D557,510 S 12/2007 Troutman
D570,621 S 6/2008 Troutman et al.
7,404,219 B2 7/2008 Berkey
7,409,733 B2 8/2008 Tharalson et al.
7,418,745 B2 * 9/2008 Paesang ..... A47D 7/04 5/93.1
7,617,569 B2 11/2009 Liao
D604,970 S 12/2009 Troutman et al.
D616,231 S 5/2010 Troutman et al.
D616,677 S 6/2010 Troutman et al.
7,739,759 B2 6/2010 Mendes et al.
7,818,832 B2 10/2010 Hartenstine et al.
7,882,579 B2 2/2011 Jackson et al.
7,908,686 B2 3/2011 Clapper et al.
7,937,786 B2 5/2011 Bergkvist
7,950,081 B2 5/2011 Chen et al.
8,001,630 B2 8/2011 Burkholder et al.
8,011,036 B2 9/2011 Tuckey
8,028,358 B2 10/2011 Fiore, Jr.
8,141,186 B2 3/2012 Burns et al.
8,201,291 B2 6/2012 Burns et al.
8,230,536 B2 7/2012 Clapper et al.
8,281,431 B2 10/2012 Hartenstine
8,291,530 B2 10/2012 Burkholder et al.
8,307,475 B2 11/2012 Hutchinson et al.
8,316,481 B2 11/2012 Arnold, IV et al.
8,424,131 B2 4/2013 Thomsen et al.
8,522,374 B2 9/2013 Sousa et al.
8,528,130 B2 9/2013 Bu et al.
8,544,125 B2 10/2013 Greger et al.
9,848,714 B2 * 12/2017 Burns ..... A47D 13/063
2001/0001162 A1 5/2001 Warner, Jr. et al.
2001/0001330 A1 5/2001 Warner, Jr. et al.
2002/0078499 A1 * 6/2002 Cheng ..... A47D 7/002 5/95
2003/0070229 A1 4/2003 Hsia
2003/0126681 A1 * 7/2003 Tharalson ..... A47D 5/00 5/93.2
2003/0154547 A1 8/2003 Hsia
2003/0177575 A1 9/2003 Cheng et al.
2006/0218725 A1 10/2006 Carpenter et al.
2006/0225204 A1 10/2006 Bretschger et al.
2007/0271697 A1 11/2007 Martin
2009/0077742 A1 * 3/2009 Burns ..... A47D 7/04 5/93.2
2009/0288257 A1 11/2009 Grainger
2010/0017959 A1 1/2010 Yoshe et al.
2010/0138991 A1 6/2010 Hartenstine et al.
2011/0148159 A1 6/2011 Barron et al.
2012/0036633 A1 2/2012 Horst et al.
2012/0036634 A1 * 2/2012 Pacella ..... A47D 9/005 5/93.1
2012/0037869 A1 2/2012 Fiore, III et al.
2012/0167299 A1 7/2012 Tarquinio
2012/0180211 A1 7/2012 Chapman et al.
2013/0047336 A1 2/2013 Burkholder et al.
2013/0198951 A1 8/2013 Arnold, IV et al.
2013/0232687 A1 9/2013 Thomsen et al.
2013/0312178 A1 * 11/2013 Jackson ..... A47D 13/06 5/93.1
2014/0068856 A1 3/2014 Thomson et al.
2014/0068857 A1 3/2014 Jackson et al.

* cited by examiner

RECONFIGURABLE INFANT PLAY YARD

CROSS REFERENCE TO RELATED APPLICATIONS

This application claims priority to and the benefit of U.S. Provisional Patent Application No. 62/046,333, filed Sep. 5, 2014, entitled "Reconfigurable Infant Play Yard," the contents of which are hereby incorporated by reference in their entirety.

FIELD OF THE INVENTION

The present invention relates to an infant play yard, and in particular, an infant play yard with multiple configurations and a new sleeper attachment. Specifically, the play yard is reconfigurable between a storage configuration and a deployed configuration. More specifically, when in the deployed configuration, and depending on if an attachment device is configured on the play yard, the play yard can be utilized as a play yard or a sleeper.

BACKGROUND OF THE INVENTION

Various infant support structures are known. Many parents often purchase multiple different support structures for their children, where each of the infant support structures serves a different purpose. For example, many parents will purchase a play yard, an infant sleeper, an infant bouncer, an infant changing table, a crib, etc. Not only does purchasing the various infant support structures create a financial burden on parents, each one of the infant support structures consumes a potentially significant amount of space within the home. Despite most infant support structures being able to be reconfigured into a storage configuration, having various infant support structures in their storage configurations still consumes a large amount of space. In addition, it is often difficult to reconfigure these infant support structures from the deployed configuration to the storage configuration. Reconfiguring the infant support structures often requires significant amounts of time, and the disassembly and reassembly of multiple parts of the infant support structure. Moreover, the need to reassemble and attach multiple components creates a chance for assembly error on the part of the parent, thereby creating a potential hazard for the infant placed within a misassembled support structure.

Furthermore, whether reconfigured in their storage configuration, or just being in their deployed or in-use configuration, the various infant support structures have an awkward shape, making travel with the infant support structures very difficult for parents.

Thus, there is a need for an infant support structure that combines multiple infant support structures together into one structure, including a play yard, a sleeper, and possibly even a changing table. This eliminates the need for multiple infant support structures within the home, and the need to travel with multiple infant support structures. There is also a need for these support structure to be combined in a safer way, with assembly being as simple and foolproof as possible to limit the chances for assembly error and related mishaps. Also, there is a need for this infant support structure to be quickly and easily reconfigured from a deployed and in-use configuration to a storage configuration, without requiring the disassembly of multiple parts. In addition, there is a need for an infant support structure that is easily portable and makes travel easier for the parents.

SUMMARY OF THE INVENTION

In one embodiment, an infant play yard includes a frame, a play yard coupled to and supported by the frame and an elevated infant support removably coupleable to the play yard. The frame includes at least two legs that are rotatably coupled to the frame and configured to rotate about the frame. Moreover, the frame is reconfigurable between a storage configuration and a deployed configuration. The play yard includes at least one sidewall, which is coupled to the frame, and a bottom coupled to the at least one sidewall. The play yard is configured to be supported by, and hang from, the frame. The elevated infant support or infant seat insert or sleeper insert defines a receiving area, which is sized and shaped for receiving an infant. The sleeper insert is removably coupleable to the play yard, and when coupled to the play yard, the receiving area of the infant seat is disposed between the sidewalls of the play yard. The sleeper insert includes a strap with resilient properties that secure the strap around the outer perimeter of the frame when the sleeper is attached to the frame. The resilient properties of the strap aid in the attachment of the sleeper insert to the frame over the play yard, as well as securing the sleeper insert the to frame when an infant is placed within the sleeper insert. The strap is coupled to connecting covers that snap onto portions of the frame and/or legs of the frame to further secure the sleeper insert to the frame of the apparatus. This safely supports the child any time the sleeper insert is used in conjunction with the play yard.

BRIEF DESCRIPTION OF THE DRAWINGS

Like reference numerals have been used to identify like elements throughout this disclosure.

DETAILED DESCRIPTION OF THE INVENTION

Figure 1:
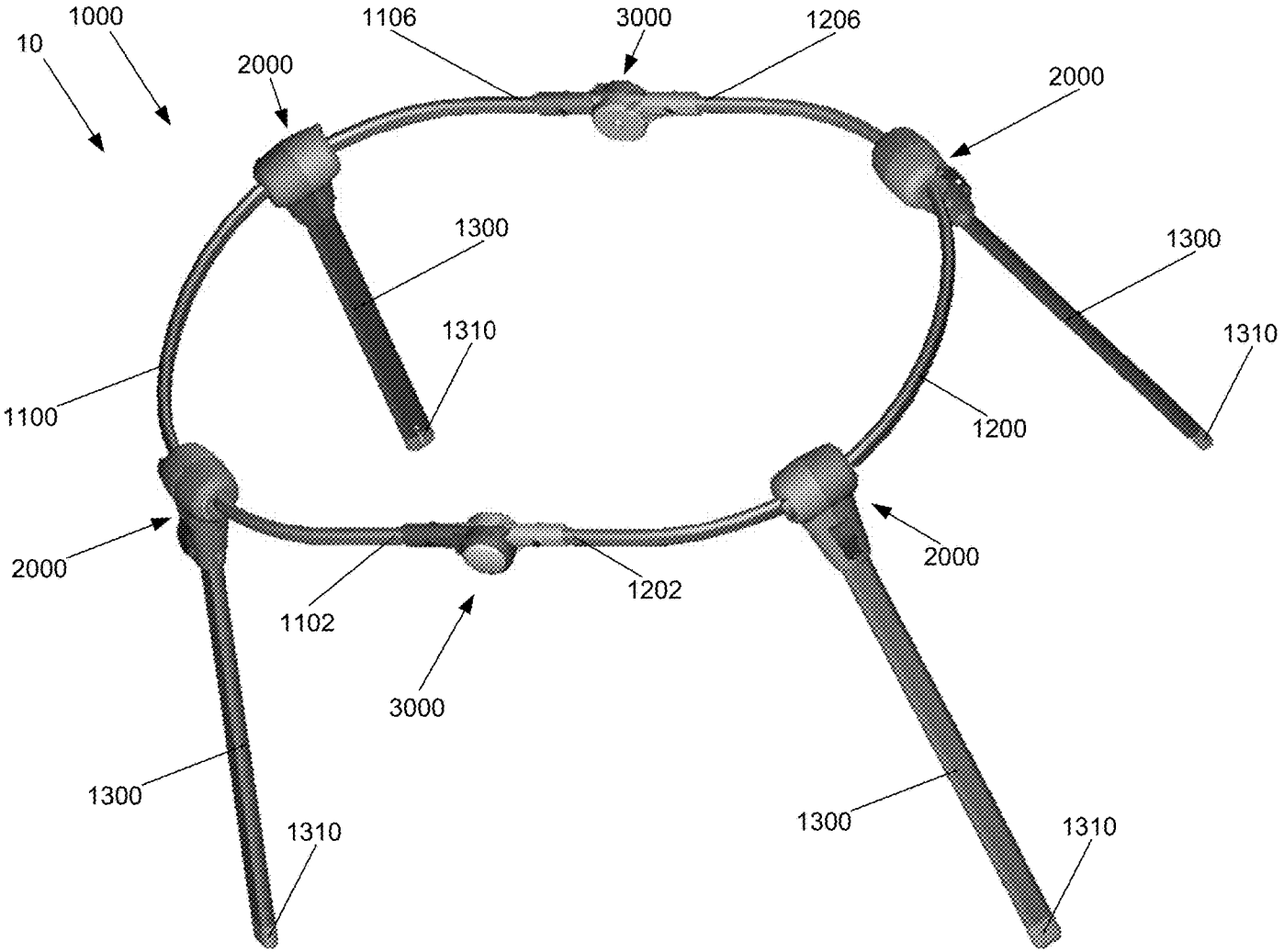
FIG. 1 illustrates a perspective view of the frame of a play yard in accordance with the present invention.

Referring to FIG. 1, illustrated is a perspective view of an embodiment of the frame of an infant play yard apparatus 10 of the present invention. The frame 1000 is symmetrical in shape and includes a first horizontal member 1100 and a second horizontal member 1200. The first and second horizontal members 1100, 1200 are curved, and form a general U-shape. The first horizontal member 1100 has a first end 1102 and a second end 1106. Similarly, the second horizontal member has a first end 1202 and a second end 1206. The frame 1000 of the apparatus 10 includes two frame locks 3000. The frame locks 3000 are spaced opposite from each other around the frame 1000. The first end 1102 of the first horizontal member 1100 and the first end 1202 of the second horizontal member 1200 are coupled to one frame lock 3000, while the second end 1106 of the first horizontal member 1100 and the second end 1206 of the second horizontal member 1200 are coupled to the second frame lock 3000. Spaced around, and rotatably coupled to, the frame 1000 are four leg locks 2000. Coupled to each one the of these leg locks 2000 is a leg 1300, which include feet 1310. Two of the four leg locks 2000 are rotatably coupled to the first horizontal member 1100, and the other two leg locks 2000 are rotatably coupled to the second horizontal member 1200. As illustrated in FIG. 1, the leg locks 2000 are rotatably coupled to the first and second horizontal members 1100, 1200 about the curved portions of the horizontal members 1100, 1200.

Figure 2A:
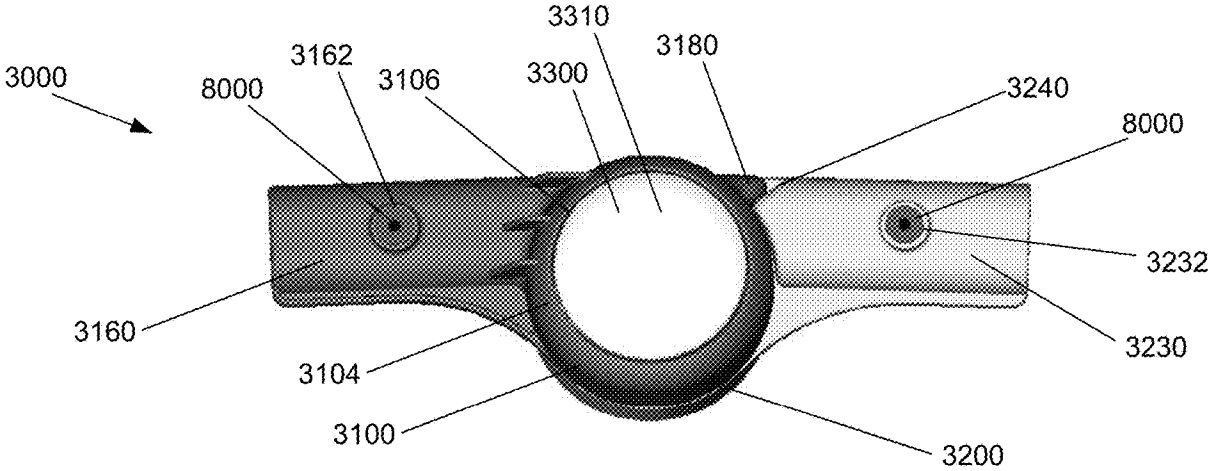
FIG. 2A illustrates front view of the frame lock of the frame of the play yard illustrated in FIG. 1.
Figure 2B:
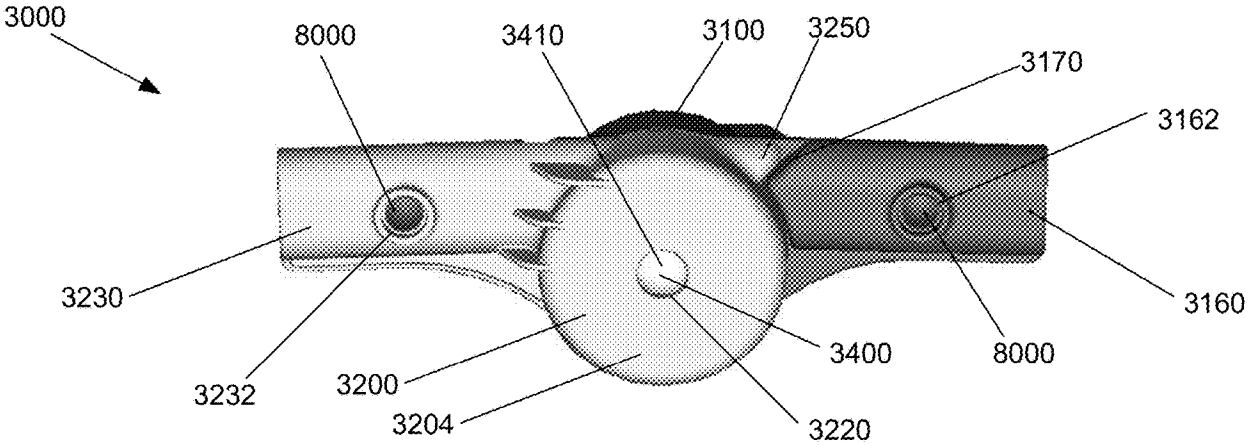
FIG. 2B illustrates a rear view of the frame lock illustrated in FIG. 2A.

Turning to FIGS. 2A and 2B, illustrated is a front view and a rear view of the frame locks 3000. The discussion of FIGS. 2A and 2B only includes one frame lock 3000, but, because the frame locks 3000 are structurally identical to each other, the discussion applies to both of the frame locks 3000 illustrated in FIG. 1. As illustrated in FIGS. 2A and 2B, the frame lock 3000 includes an outer housing 3100 and an inner housing 3200. The outer housing 3100 and the inner housing 3200 are rotatably coupled to each other. The outer housing 3100 and the inner housing 3200 are illustrated in FIGS. 2A and 2B in their deployed configuration when the apparatus 10 is used in the play yard or sleeper configuration. The outer housing 3100 includes a receptacle 3160 configured to receive the first and second ends 1102, 1106, 1202, 1206 of the first and second horizontal members 1100, 1200. The inner housing 3200 also includes a receptacle 3230 configured to receive the first and second ends 1102, 1106, 1202, 1206 of the first and second horizontal members 1100, 1200. The receptacle 3160 of the outer housing 3100 includes a pair of apertures 3162, while the receptacle 3230 of the inner housing 3200 also includes a pair of apertures 3232. These apertures 3162, 3232 are sized and configured to receive fasteners 8000 when the ends 1102, 1106, 1202, 1206 of the first and second horizontal members 1100, 1200 are inserted into the receptacles 3160, 3230. The fasteners 8000 couple the ends 1102, 1106, 1202, 1206 of the first and second horizontal members 1100, 1200 to the outer and inner housings 3100, 3200. The fasteners 8000 may be screws, nuts and bolts, rivets, or other similar type of fastening devices.

As illustrated in FIG. 2A, the outer surface 3104 of the outer housing 3100 includes a push button 3300 that sits within a cavity 3106. Furthermore, as illustrated in FIG. 2B, the outer surface 3204 of the inner housing 3200 includes a central opening 3220. A rivet 3400 is inserted through the central opening 3220. The rivet 3400 rotatably couples the outer housing 3100 to the inner housing 3200. The rivet 3400 includes a shaft 3420 (not illustrated) with a proximal end 3410 and a distal end 3430 (not illustrated). The proximal and distal ends 3410, 3430 are flanged to be wider than the shaft 3420. The rivet 3400 is inserted through the central opening 3120 (not illustrated but located behind the push button 3300) of the outer housing 3100 and the central opening 3220 of the inner housing 3200. The distal end 3430 of the rivet 3400 is positioned proximate the central opening 3120, and within the cavity 3160, of the outer housing 3100. Moreover, the proximal end 3410 of the rivet 3400 is positioned proximate to the central opening 3220 of the inner housing 3200.

Additionally, the outer housing 3100 includes an abutment extension 3180, illustrated in FIG. 2A, and an abutment surface 3170, illustrated in FIG. 2B. Similarly, the inner housing 3200 also includes an abutment extension 3250, illustrated in FIG. 2B, and an abutment surface 3240, illustrated in FIG. 2A. As illustrated, the abutment extension 3180 of the outer housing 3100 is in contact with the abutment surface 3240 of the inner housing 3200. Similarly, the abutment extension 3250 of the inner housing 3200 is in contact with the abutment surface 3170 of the outer housing 3100. The abutment extensions 3180, 3250 contacting the abutment surfaces 3170, 3240 prevent the outer housing 3100 and the inner housing 3200 from rotating too far with respect to one another. In other words, the outer housing 3100 and the inner housing 3200 can be rotated in one direction with respect to one another while a user pulls upward on the center of the outer housing 3100 and inner housing 3200 (to allow the frame to be folded) until the receptacles 3160, 3230 are located proximate to one another. Thereafter, the housings 3100, 3200 of the frame lock 3000 can then be rotated in the opposite direction with respect to one another while a user pushes downward on the center of the outer housing 3100 and inner housing 3200 (to allow the frame to be unfolded) until the abutment extensions 3180, 3250 contact the abutment surfaces 3170, 3240, and the receptacles 3160, 3230 extend outward away from each other. It is important that the outer housing 3100 and the inner housing 3200 do not fold downward to create a V-shape.

As illustrated in FIG. 2A, the push button 3300 is substantially circular in shape and has a smooth outer surface 3310. The push button 3300 is coupled to the outer housing 3100 within the cavity 3106. When the push button 3300 is depressed into the cavity 3106, the outer housing 3100 and the inner housing 3200 are capable of rotating with respect to each other. When the push button 3300 is in its resting state, as illustrated in FIG. 2A, the outer housing 3100 and the inner housing 3200 are prevented from rotating with respect to one another. Note that the internal structure for these elements shown in FIGS. 2A and 2B is substantially similar to that shown in U.S. Pat. No. 6,739,649, the disclosure of which is hereby incorporated by reference.

Figure 3:
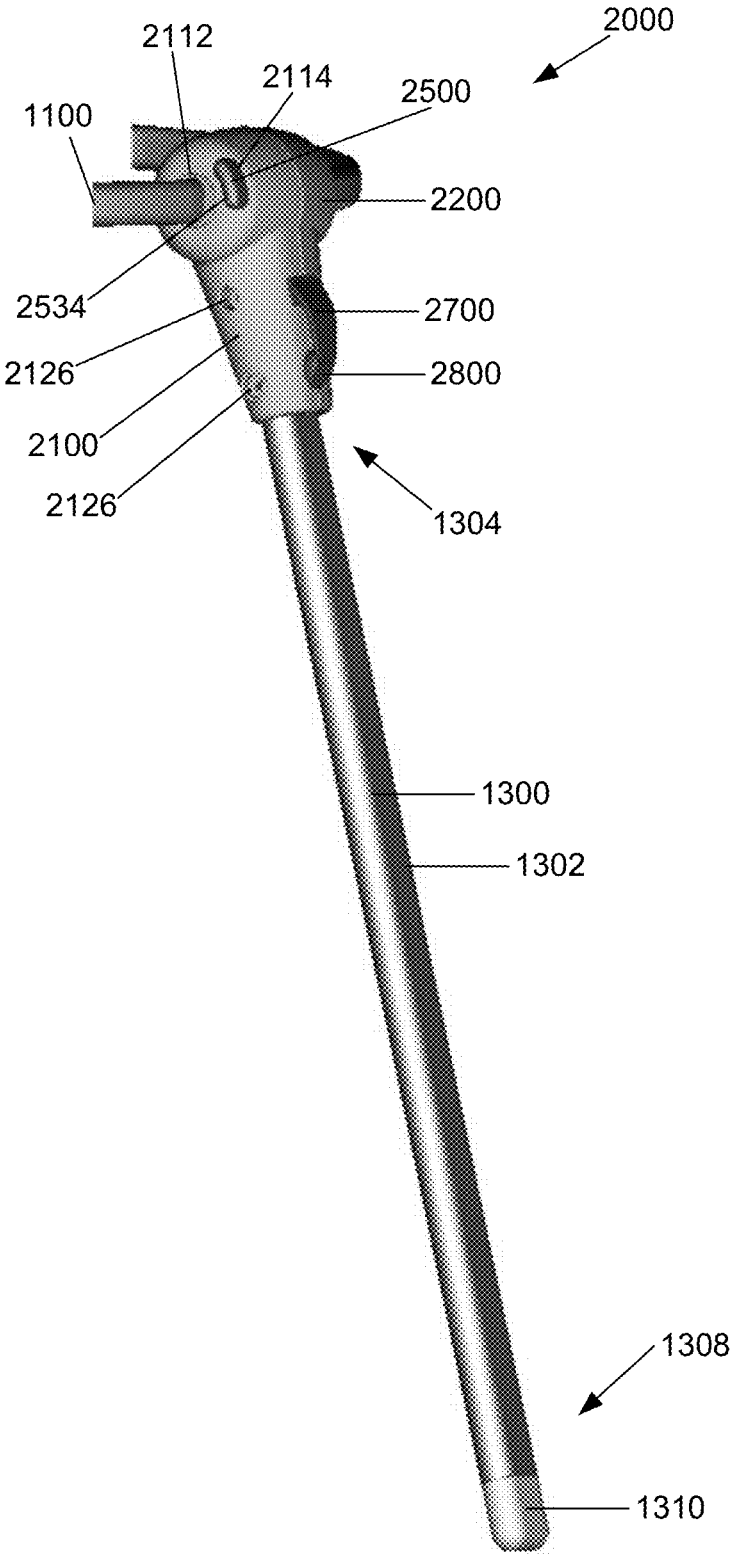
FIG. 3 illustrates a side view a first embodiment of the leg lock and leg of the frame of the play yard illustrated in FIG. 1.

FIGS. 3, 4A, 4B, 5, 6, 7A, 7B, 8A, 8B, 9, and 10 illustrate a first embodiment of the leg lock 2000 of the apparatus 10 illustrated in FIG. 1. The discussion of FIGS. 3, 4A, 4B, 5, 6, 7A, 7B, 8A, 8B, 9, and 10 only includes one leg lock 2000, but, because the leg locks 2000 are structurally identical to each other, the discussion can be applied to all of the leg locks 2000 illustrated in FIG. 1. Turning to FIG. 3, illustrated is an embodiment of a leg lock 2000 attached to the first horizontal frame member 1100. The leg lock 2000 is rotatably coupled to either the first horizontal member 1100 or the second horizontal member 1200 of the frame 1000. As further illustrated, the leg lock 2000 includes a first housing 2100 and a second housing 2200. This first embodiment of the leg lock 2000 includes a hook 2700 and a button 2800 coupled to the first and second housings 2100, 2200. Extending downwardly from each of the leg locks 2000 is a leg 1300. The leg 1300 includes a tubular member 1302, which has a proximal end 1304 and a distal end 1308. As illustrated in FIG. 3, the proximal end 1304 of the tubular member 1302 is inserted within the leg lock 2000. Furthermore, coupled to the distal end 1308 of the tubular member 1302 is a foot 1310, which is configured to allow the leg 1300 to slide along a support surface. The foot 1310 is designed to stabilize the legs 1300, and as a result, the apparatus 10, on a support surface.

Figure 4A:
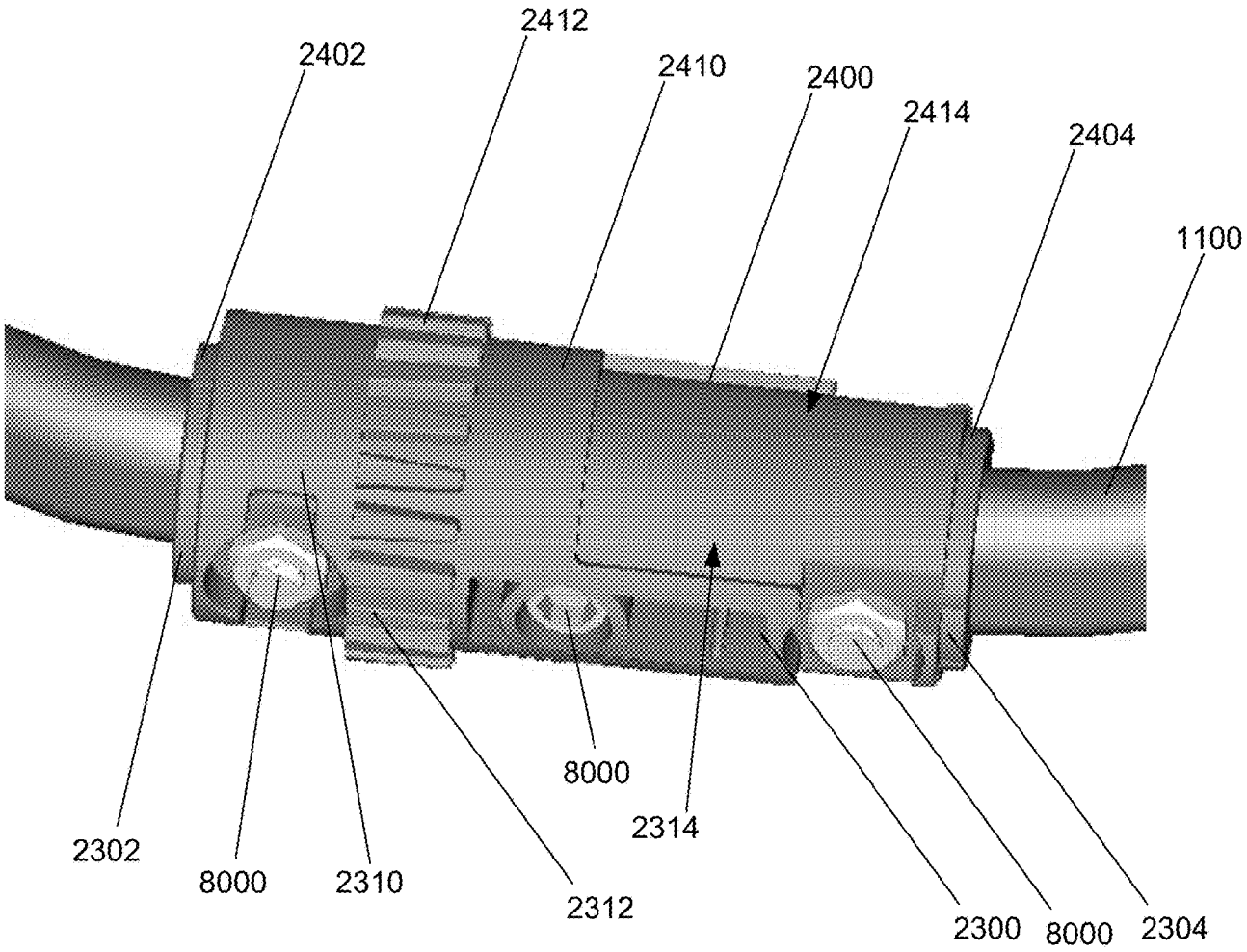
FIG. 4A illustrates a top view of the first inner member and the second inner member of the leg lock illustrated in FIG. 3 being coupled to the frame of the play yard illustrated in FIG. 1.
Figure 4B:
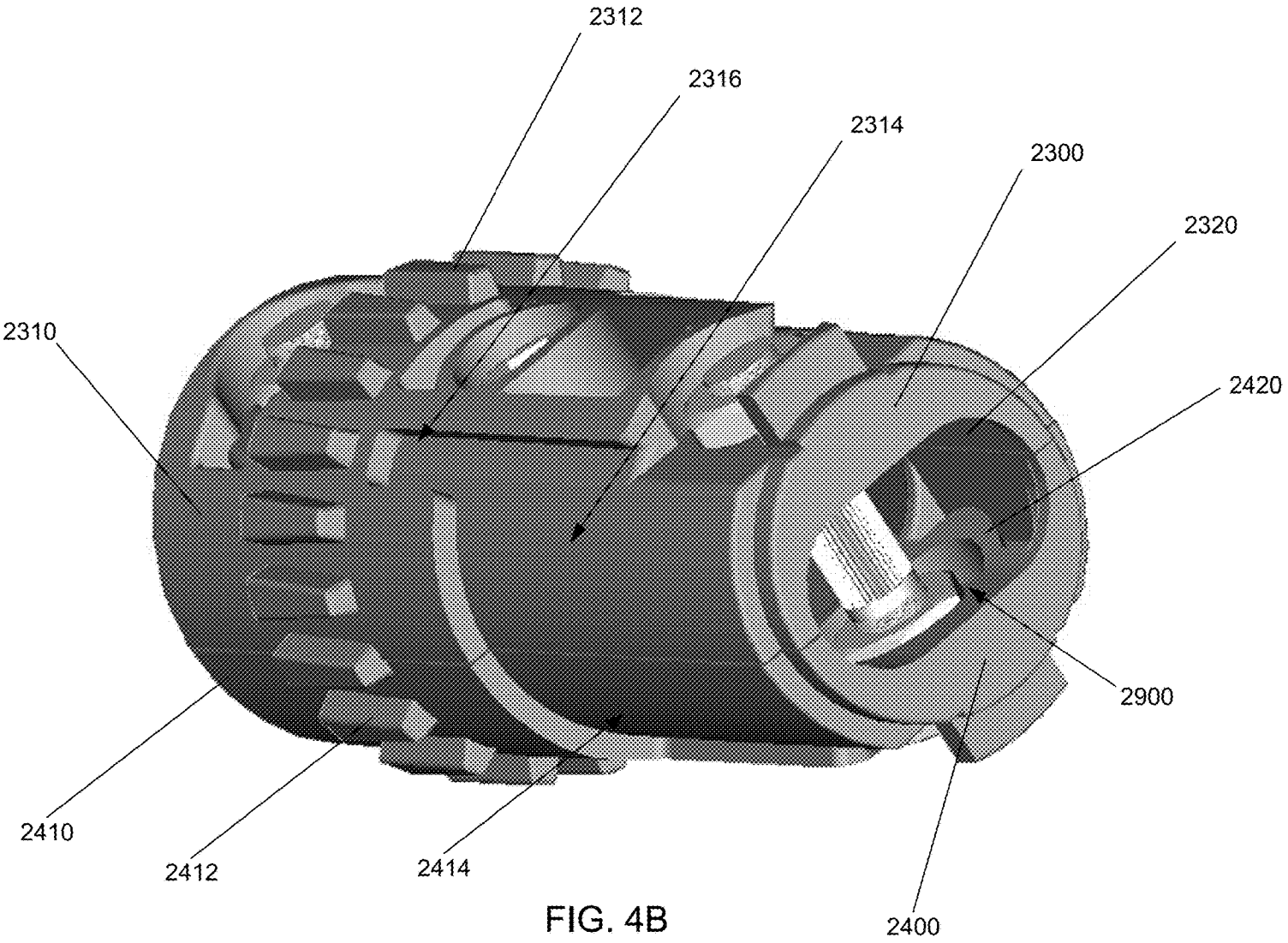
FIG. 4B illustrates a perspective view of the first inner member and the second inner member illustrated in FIG. 4A.

Turning to FIGS. 4A and 4B, illustrated is a first inner member 2300 and a second inner member 2400 coupled to a first horizontal member 1100 of the frame 1000. The first inner member 2300 and the second inner member 2400 are mirror images of each other. The first inner member 2300 has a first side 2302 and a second side 2304. The second inner member 2400 has a first side 2402 and a second side 2404. Moreover, the first inner member 2300 includes an outer surface 2310 and an inner surface 2320. Similarly, the second inner member 2400 includes an outer surface 2410 and an inner surface 2420. The first inner member 2300 and the second inner member 2400 are U-shaped, and when paired together, form a channel 2900, which is best illustrated in FIG. 4B. The channel 2900 is shaped by the inner surface 2320 of the first inner member 2300 and the inner surface 2420 of the second inner member 2400. The channel 2900 is sized and shaped identically to that of the first or second horizontal member 1100, 1200 of the frame 1000. Thus, the first and second inner members 2300, 2400, when combined together, encircle a portion of the first or second horizontal member 1100, 1200 of the frame 1000, where the inner surfaces 2320, 2420 of the first and second inner members 2300, 2400 are placed against the first or second horizontal member 1100, 1200. The first and second inner members 2300, 2400 are coupled together, and to the first or second horizontal member 1100, 1200 of the frame 1000, via a set of fasteners 8000 that extend from the first inner member 2300, through the frame 1000, and to the second inner member 2400. In this embodiment, the there are three fasteners 8000 that secure the first and second inner members 2300, 2400 to the frame 1000. In other embodiments, the number of fasteners 8000 can be greater or smaller.

As illustrated in FIGS. 4A and 4B, the first inner member 2300 includes a set of gear teeth 2312 disposed on the outer surface 2310 closer to the first side 2302 of the first inner member 2300 than the second side 2304 of the first inner member 2300. Similarly, the second inner member 2400 includes a set of gear teeth 2412 disposed on the outer surface 2410 closer to the first side 2402 of the second inner member 2400 than the second side 2404 of the second inner member 2400. When the first inner member 2300 and the second inner member 2400 are coupled to one another, the gear teeth 2312 of the first inner member 2300 align with the gear teeth 2412 of the second inner member 2400. As illustrated in FIGS. 4A and 4B, the gear teeth 2312, 2412 are tapered, where the gear teeth 2312, 2412 are wider on the side closest to the first sides 2302, 2402 of the first and second inner members 2300, 2400, and thinner on the side closest to the second sides 2304, 2404 of the first and second inner members 2300, 2400.

Moreover, as illustrated in FIGS. 4A and 4B, proximate to the second side 2304 of the first inner members 2300 is a recessed portion 2314. Similarly, proximate to the second side 2404 of the second inner member 2400 is a recessed portion 2414. As illustrated in FIGS. 4A and 4B, the recessed portions 2314, 2414 of the first and second inner members 2300, 2400 also align with one another when the first and second inner members 2300, 2400 are coupled to one another. Furthermore, FIG. 4B best illustrates a recessed slot 2316 that extends from the recessed portion 2314 of the first inner member 2300 towards the gear teeth 2312. While not illustrated, the second inner member 2400 also includes a recessed slot 2416 that extends from the recessed portion 2414 of the second inner member 2400 toward the gear teeth 2412.

Figure 5:
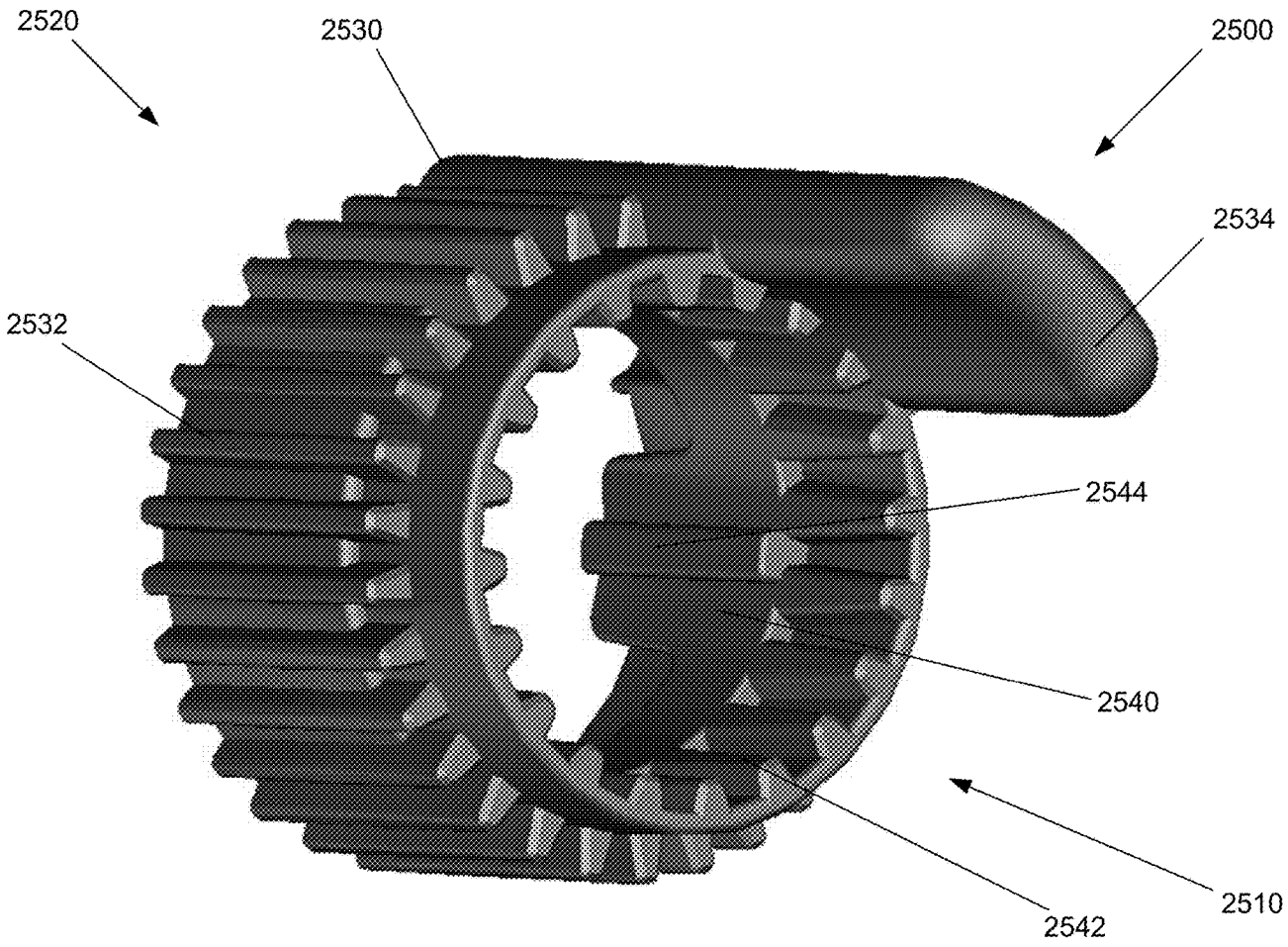
FIG. 5 illustrates a perspective view of the slidable member of the leg lock illustrated in FIG. 3.

Turning to FIG. 5, illustrated is a sliding gear member 2500, which is configured to slide over the first and second inner members 2300, 2400. The sliding gear member 2500 includes a first side 2510 and a second side 2520. The sliding gear member 2500 is circular in shape with an outer surface 2530 and an inner surface 2540. Disposed on the outer surface 2530 of the sliding gear member 2500 is a set of outer gear teeth 2532 and an actuator 2534. The outer gear teeth 2532 are tapered as the outer gear teeth 2532 extend away from the outer surface 2530. The actuator 2534 extends from the outer surface 2530 beyond the first side 2510 of the sliding gear member 2500.

Moreover, the inner surface 2540 also includes a set of inner gear teeth 2542 disposed on the inner surface 2540 proximate to the first side 2510 of the sliding gear member 2500. The inner gear teeth 2542 are tapered toward the first side 2510 of the sliding gear member 2500. The inner gear teeth 2542 are similar in shape to the gear teeth 2312, 2412 on the first and second inner members 2300, 2400. The inner gear teeth 2542 are sized and configured to mesh with the gear teeth 2312, 2412 on the first and second inner members 2300, 2400. Further disposed on the inner surface 2540 of the sliding gear member 2500 are two alignment members 2544 disposed opposite of each other. In other words, and as best illustrated in FIG. 6, the alignment members 2544 are disposed 180 degrees away from each other on the circular inner surface 2540.

Figure 6:
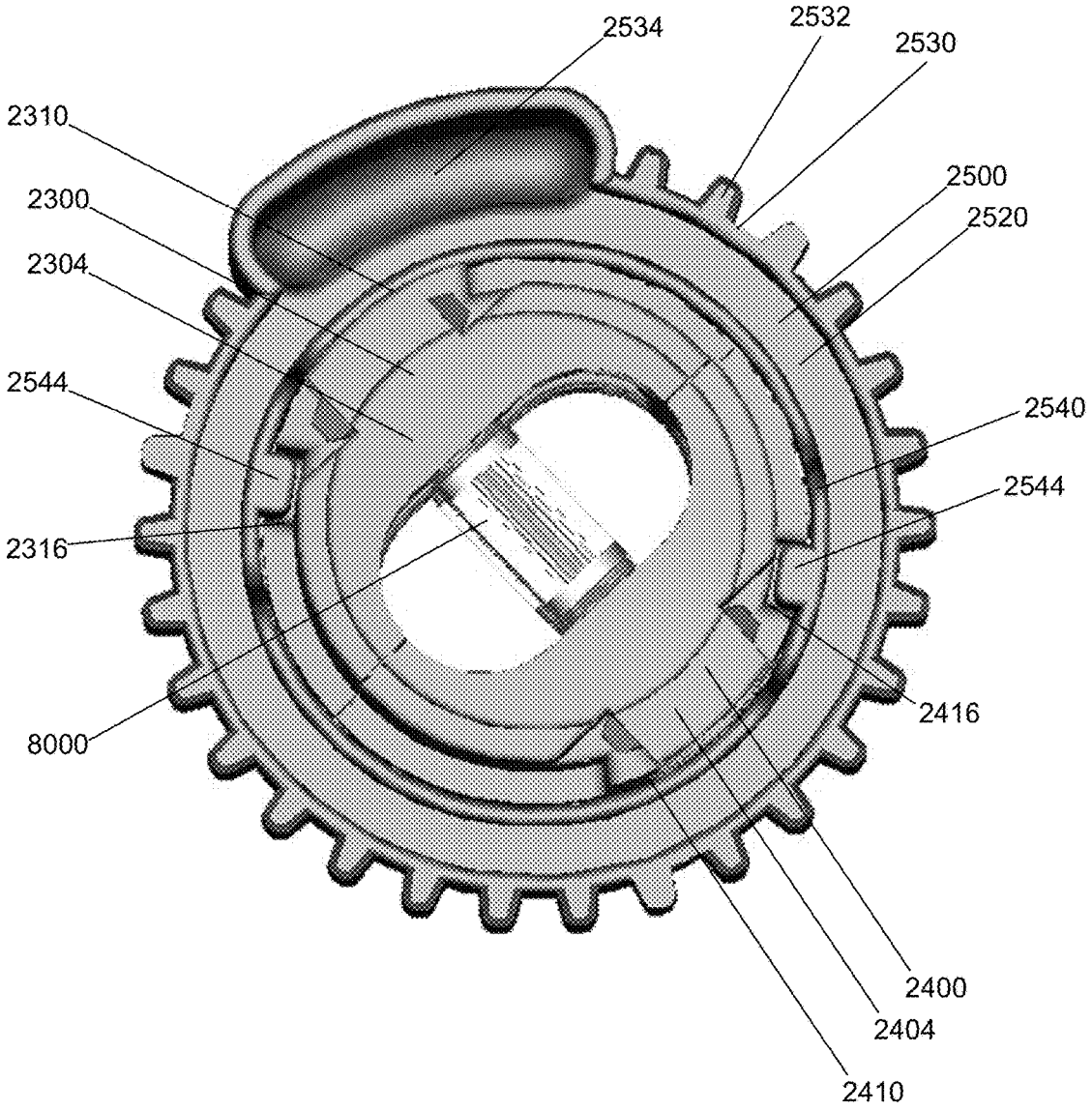
FIG. 6 illustrates a side view of the slidable member being coupled to the first and second inner members illustrated in FIG. 4A.
Figure 7A:
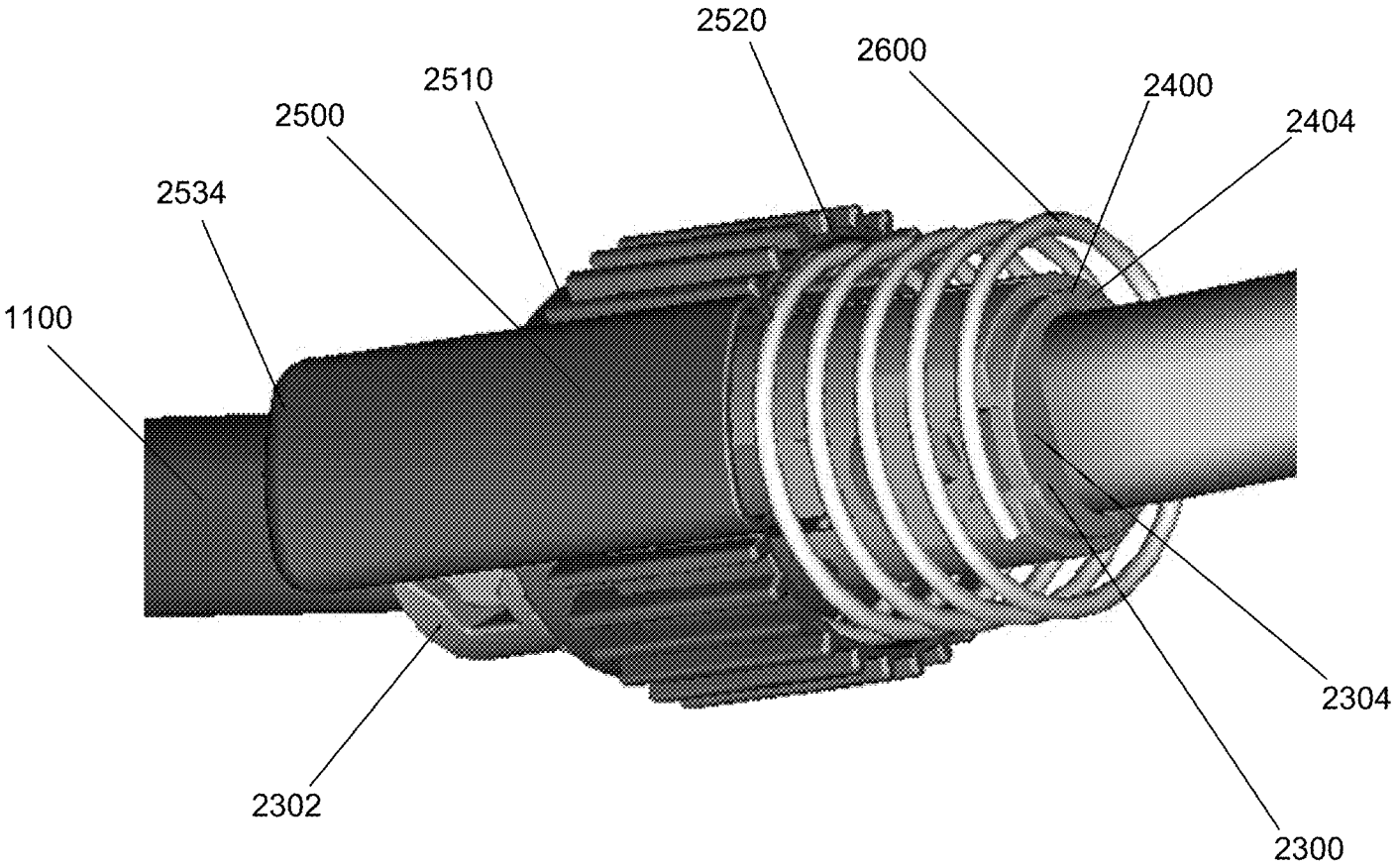
FIG. 7A illustrates a perspective view of the slidable member and resilient member being coupled to the first and second inner members of the leg lock illustrated in FIG. 4A.
Figure 7B:
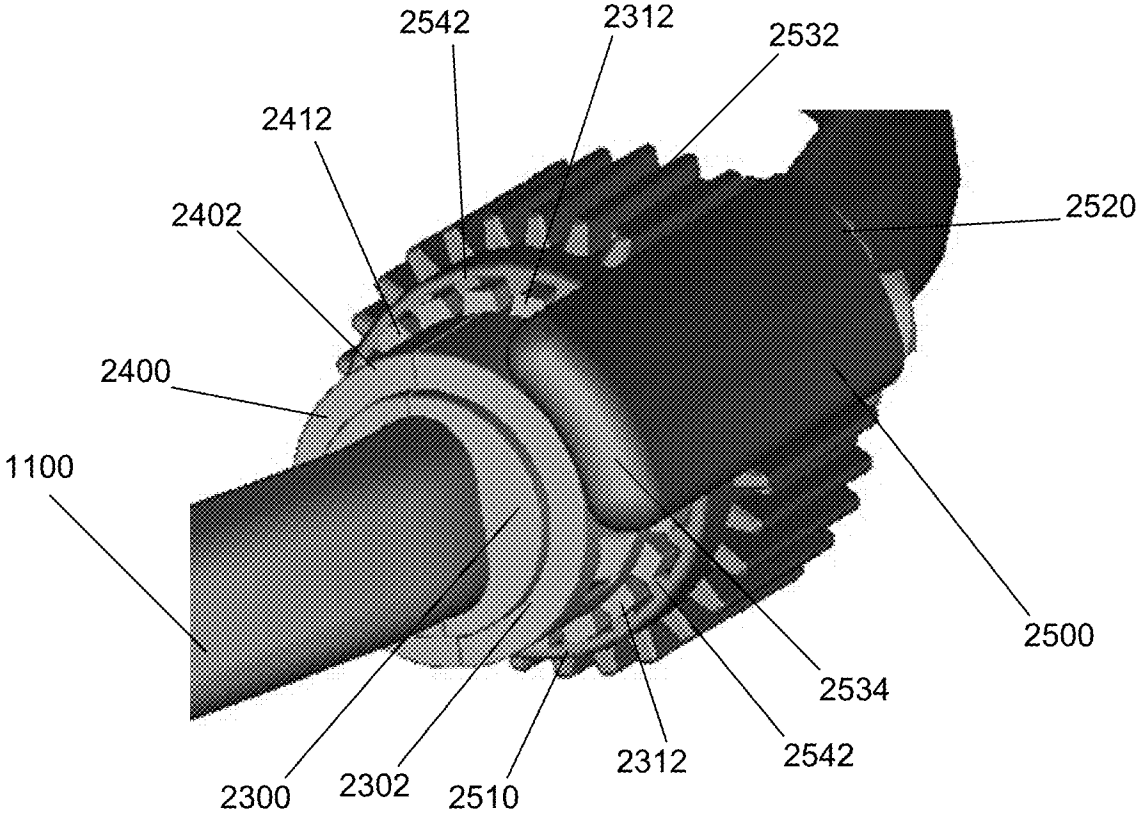
FIG. 7B illustrates a perspective view of the slidable member being coupled to the first and second inner members illustrated in FIG. 4A, which are coupled to the frame of the play yard illustrated in FIG. 1.

Turning to FIGS. 6, 7A, and 7B, illustrated is the sliding gear member 2500 slid over the first and second inner members 2300, 2400. FIG. 6 illustrates a side view of the second sides 2304, 2404 of the first and second inner members 2300, 2400, and the second side 2520 of the sliding gear member 2500. The inner surface 2540 of the sliding gear member 2500 is slidably disposed around the outer surfaces 2310, 2410 of the first and second inner members 2300, 2400. As illustrated in FIG. 6, the alignment members 2544 on the inner surface 2540 of the sliding gear member 2500 are positioned within the recessed slots 2316, 2416 on the first and second inner members 2300, 2400. When the alignment members 2544 are positioned within the recessed slots 2316, 2416, the sliding gear member 2500 is positioned around the gear teeth 2312, 2412 of the first and second inner members 2300, 2400, as illustrated in FIG. 7B. FIG. 7B further illustrates that, when the sliding gear member 2500 is slid over the first and second inner members 2300, 2400 so that the alignment members 2544 are positioned within the recessed slots 2316, 2416, the inner gear teeth 2542 of the sliding gear member 2500 are meshed with the gear teeth 2312, 2412 of the first and second inner members 2300, 2400. As illustrated in FIG. 7A, the sliding gear member 2500 is shorter in length than the first and second inner members 2300, 2400. In other words, the distance between the first sides 2302, 2402 and the second sides 2304, 2404 of the first and second inner members 2300, 2400 is greater than the distance between the first side 2510 and the second side 2520 of the sliding gear member 2500. Moreover, FIG. 7A further illustrates a resilient member 2600 that is configured to bias the sliding gear member 2500 toward the first sides 2302, 2402 of the first and second inner members 2300, 2400. In this embodiment, the resilient member 2600 is a spring.

The position of the sliding gear member 2500 on the first and second inner members 2300, 2400 illustrated in FIGS. 6, 7A, and 7B is the farthest toward the first sides 2302, 2402 of the first and second inner members 2300, 2400 the sliding gear member 2500 may slide. However, the sliding gear member 2500 is capable of sliding toward the second sides 2304, 2404 of the first and second inner members 2300, 2400 so that the alignment members 2544 of the sliding gear member 2500 are no longer positioned within the recessed slots 2316, 2416, but rather are positioned within the recessed portions 2314, 2414 of the first and second inner members 2300, 2400. When the alignment members 2544 are no longer positioned within the recessed slots 2316, 2416, the inner gear teeth 2542 of the sliding gear member 2500 are no longer meshed with the gear teeth 2312, 2412 of the first and second inner members 2300, 2400. Additionally, when the alignment members 2544 of the sliding gear member 2500 are positioned in the recessed portions 2314, 2414 of the first and second inner members 2300, 2400, and the inner gear teeth 2542 of the sliding gear member 2500 are no longer meshed with the gear teeth 2312, 2412 of the first and second inner members 2300, 2400, the sliding gear member 2500 is free to rotate about the first and second inner members 2300, 2400.

Once the alignment members 2544 are returned into alignment with the recessed slots 2316, 2416 on the first and second inner members 2300, 2400, the sliding gear member 2500 may be slid back towards the first sides 2302, 2402 of the first and second inner members 2300, 2400, and the inner gear teeth 2542 of the sliding gear member are meshed with the gear teeth 2312, 2412 of the first and second inner members 2300, 2400. Because the gear teeth 2312, 2412 of the first and second inner members 2300, 2400 and the inner gear teeth 2542 of the sliding gear member 2500 are tapered, as described previously, the gear teeth 2312, 2412 and the inner gear teeth 2542 are more easily engaged with one another, even when the sliding gear member 2500 and the first and second inner members 2300, 2400 are not perfectly aligned for the sets of gear teeth 2312, 2412, 2542 to mesh together. In addition to adding ease of use, the tapering of the gear teeth also results in a tighter locking fit between the sliding gear member 2500 and the first and sent inner members 2300, 2400. This is notable because a tighter lock creates less movement about the first and second inner members 2300, 2400, and ultimately less movement of the leg 1300 around the horizontal members 1100, 1200 of the frame 1000. Even small potential gaps between the gear teeth can create unwanted rotational movement of the leg 1300, especially at the points furthest from the joint, e.g., feet 1310. Thus, the tapered gear teeth create an overall more stable, safer play yard.

Further illustrated in FIGS. 7A and 7B is the actuator 2534. As illustrated, the actuator 2534 extends beyond the first side 2510 of the sliding gear member 2500. Furthermore, the actuator 2534 extends beyond the gear teeth 2312, 2412 of the first and second inner members 2300, 2400 and the first sides 2302, 2402 of the first and second inner members 2300, 2400.

Figure 8A:
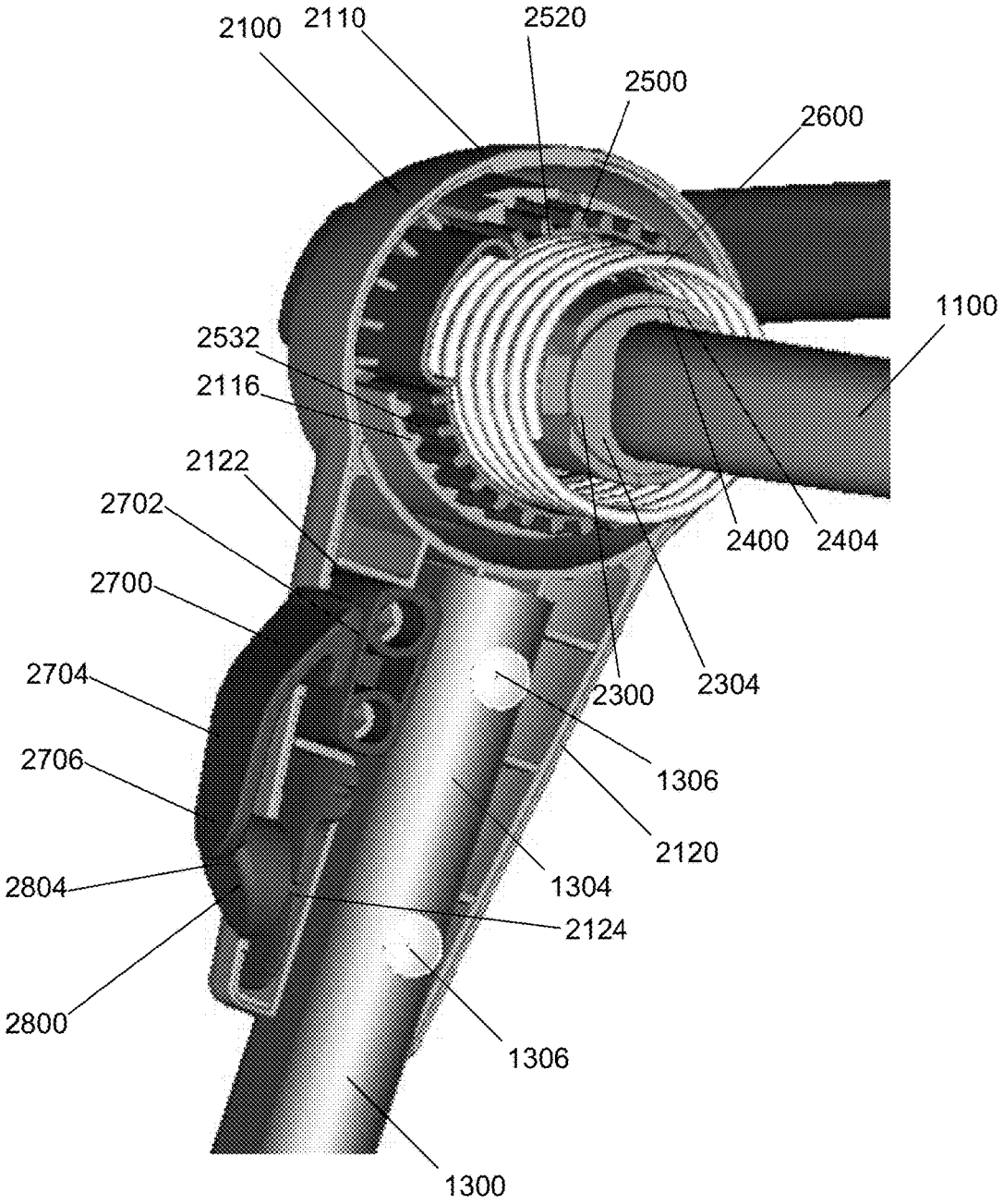
FIG. 8A illustrates an interior view of the first housing of the leg lock illustrated in FIG. 3 being coupled to the slidable member and first and second inner members.
Figure 8B:
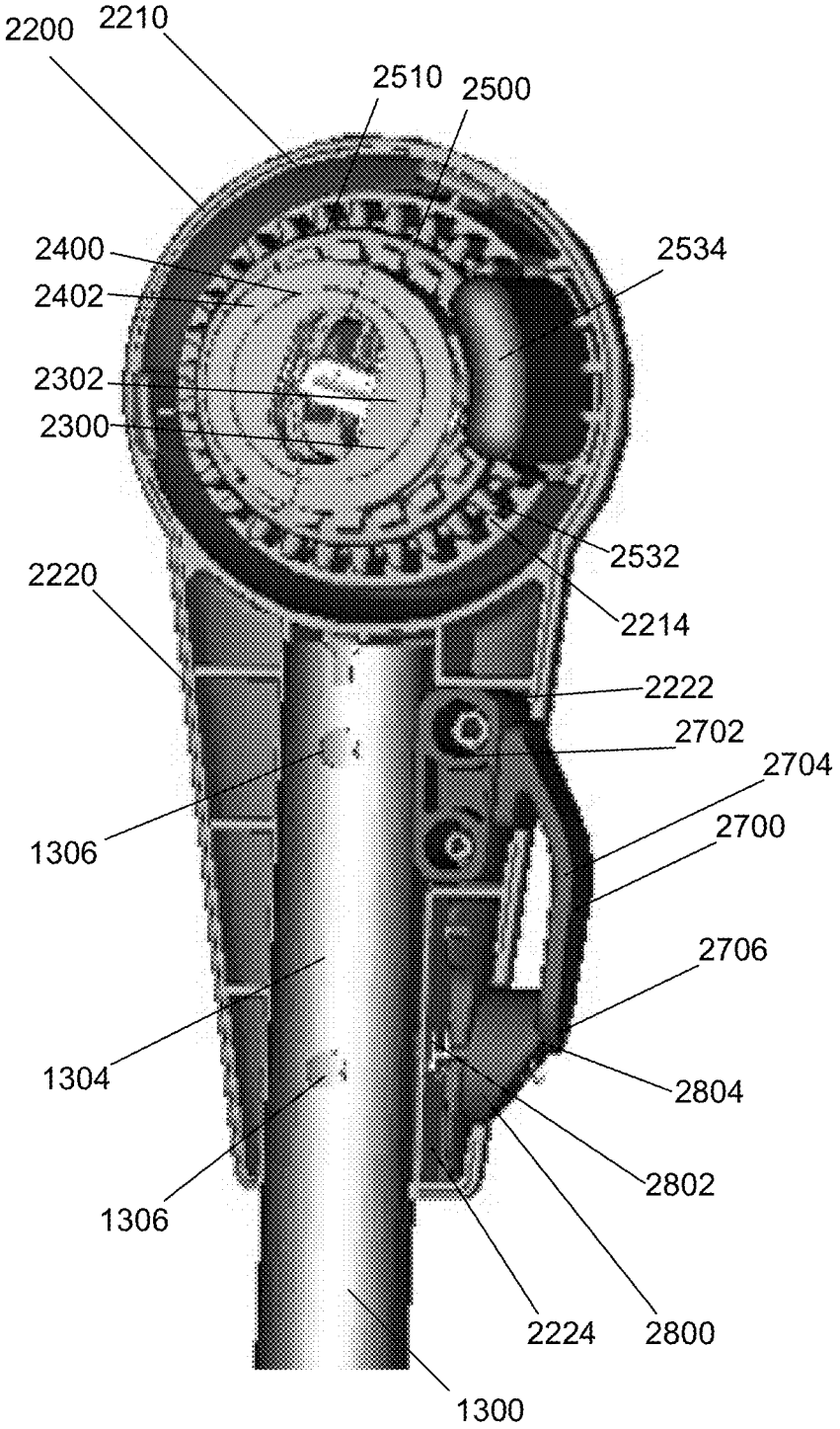
FIG. 8B illustrates an interior view of the second housing of the leg lock illustrated in FIG. 3 being coupled to the slidable member and first and second inner members.

Turning to FIGS. 8A and 8B, illustrated is the first and second inner members 2300, 2400 engaged with the sliding gear member 2500, and the sliding gear member 2500 being engaged with the first or second housings 2100, 2200. FIG. 8A illustrates the interior of the first housing 2100, while FIG. 8B illustrates the interior of the second housing 2200. As illustrated in housing 2100 which includes an upper portion 2110 and a lower portion 2120. The lower portion 2120 includes a first cavity 2122 and a second cavity 2124. The first cavity 2122 is configured to receive the anchor portion 2702 of the hook 2700. The hook 2700 further includes a flange 2704 that extends from the anchor portion 2702. The flange 2704 extends outward from first cavity 2122 and the lower portion 2120 of the first housing 2100, and curves downward. Furthermore the flange 2704 includes an end 2706. The hooks 2700 of the leg locks 2000 are configured to enable an embodiment of the sleeper cover 5000, similar to that illustrated in FIG. 13A but without the covers 6000, to be connected to the apparatus 10 by securing the straps 5700 of the sleeper cover 5000 underneath the hook 2700.

Positioned below the first cavity 2122 of the lower portion 2120 of the first housing 2100 is the second cavity 2124, which is sized and configured to house a portion of the button 2800. The button 2800 has an engagement portion 2804 that extends outwardly from the second cavity 2124 and the lower portion 2120 of the first housing 2100. Furthermore, the button 2800 is configured to slide within the second cavity 2124 so that at least a portion of the engagement portion 2804 slides within the second cavity 2124. As further illustrated in FIG. 8A, the engagement portion 2804, when extending fully from the second cavity 2124, abuts the end 2706 of the flange 2704 of the hook 2700.

As further illustrated in FIG. 8A, the first housing 2100 includes an upper portion 2110. As illustrated by the exposed resilient member 2600, the second side 2520 of the sliding gear member 2500, and the second sides 2304, 2404 of the first and second inner members 2300, 2400, the first side 2510 of the sliding gear member 2500 and the first sides 2302, 2402 of the first and second inner members 2300, 2400 are inserted into the interior of upper portion 2110 of the first housing 2100. The upper portion 2110 of the first housing 2100 includes a set of gear teeth 2116 within the interior of the upper portion 2110. The gear teeth 2116 are oriented in a substantially circular shape that has a diameter substantially equivalent to the outer surface 2530 of the sliding gear member 2500. The gear teeth 2116 are tapered as the gear teeth 2116 extend toward the center of the set of gear teeth 2116. Moreover, as illustrated, the gear teeth 2116 of the upper portion 2110 of the first housing 2100 are engaged and intermeshed with the outer gear teeth 2532 on the outer surface 2530 of the sliding gear member 2500. Because the gear teeth 2116 of the first housing 2100 and the outer gear teeth 2532 of the sliding gear member 2500 are tapered, as described previously, the gear teeth 2116 and the outer gear teeth 2532 are more easily engaged with one another, even when not perfectly aligned. In addition to adding ease of use, the tapering of the gear teeth also results in a tighter locking fit between first housing 2100 and sliding gear member 2500. This is notable because a tighter lock creates less movement within the joint, and ultimately less movement in leg 1300. Even small potential gaps between the gear teeth can create unwanted movement within leg 1300, especially at the points furthest from the joint, e.g., feet 1310. Thus, the tapered gear teeth create an overall more stable, safer play yard.

Figure 9:
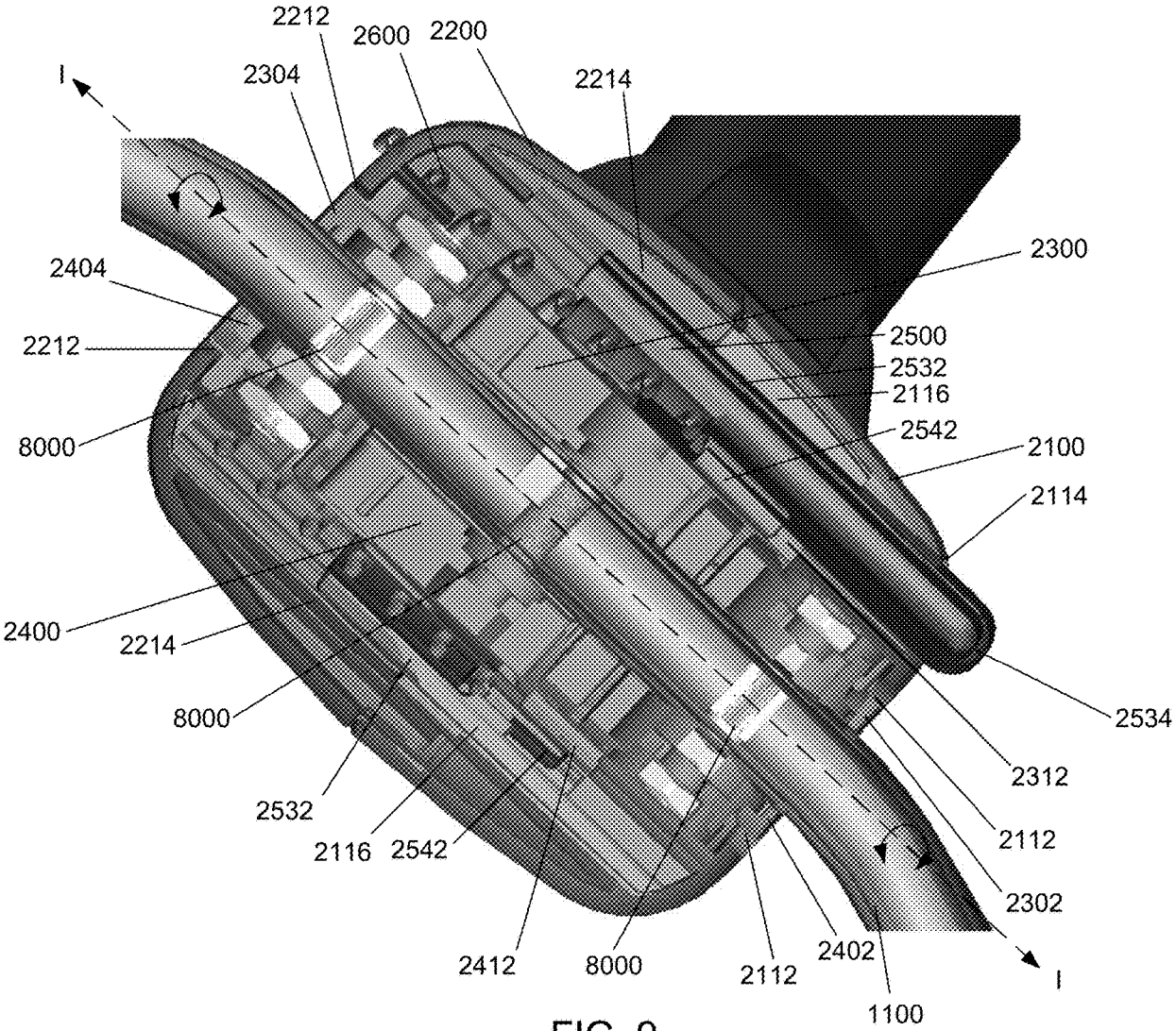
FIG. 9 illustrates a cross sectional view of the leg lock illustrated in FIG. 3.
Figure 10:
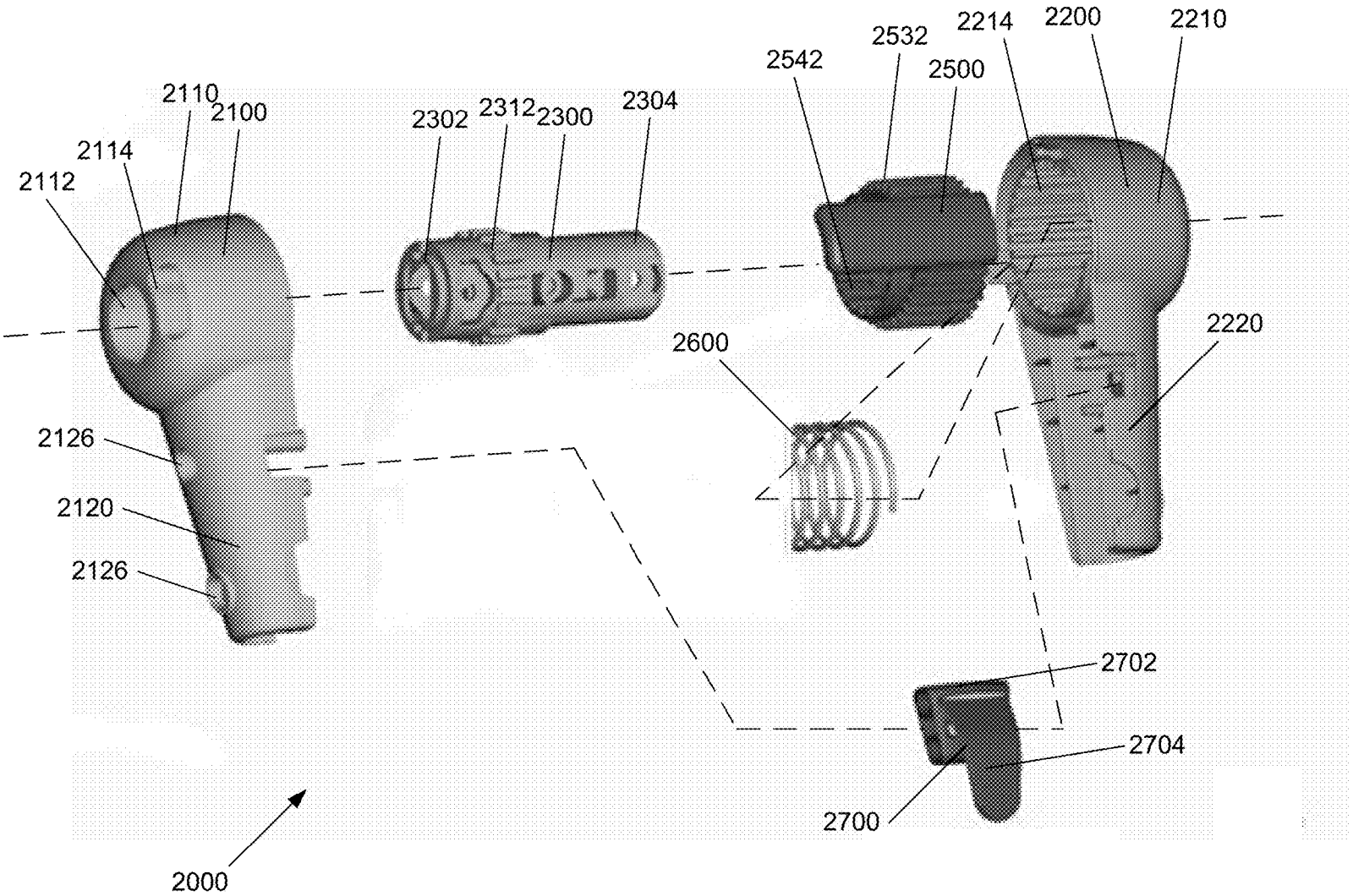
FIG. 10 illustrates an exploded view of the leg lock illustrated in FIG. 3.

As illustrated in FIGS. 3 and 10, the upper portion 2110 of the first housing 2100 includes a first opening 2112 and a second opening 2114. The first opening 2112 is sized and configured to have a substantially circular shape, and is disposed on the upper portion 2110 of the first housing 2100 at a central location on the upper portion 2110. As illustrated in FIGS. 3 and 9, the first horizontal member 1100 extends through the upper portion 2110 of the first housing 2100 and the first opening 2112. Moreover, the second opening 2114 is disposed on the upper portion 2110 of the first housing 2100 at a location offset from the first opening 2112. The second opening 2114 is sized and configured to receive the actuator 2534 of the sliding gear member 2500. As best illustrated in FIGS. 3 and 9, the actuator 2534 of the sliding gear member 2500 extends outwardly from the second opening 2114.

Turning to FIG. 8B, the second housing 2200, similar to the first housing 2100, includes an upper portion 2210 and a lower portion 2220. The lower portion 2220 also includes a first cavity 2222 and a second cavity 2224. When the first and second housings 2100, 2200 are coupled to each other, the first and second cavities 2122, 2124 of the first housing 2100 and the first and second cavities 2222, 2224 of the second housing 2200 align with one another. Thus, the first and second cavities 2222, 2224 of the second housing 2200 are sized and shaped identical to the first and second cavities 2122, 2124 of the first housing 2100. Moreover, similar to the first housing 2100, the first cavity 2222 of the second housing 2200 is also configured to receive the anchor portion 2702 of the hook 2700. The flange 2704 of the hook 2700 extends outward from first cavity 2222 and the lower portion 2220 of the second housing 2200.

Identical to that of the first housing 2100, the second cavity 2224 of the second housing 2200 is positioned below the first cavity 2222. As previously explained with the second cavity 2124 of the first housing 2100, the second cavity 2224 of the second housing 2200 is sized and configured to house a portion of the button 2800. The engagement portion 2804 is configured to also extend outwardly from the second cavity 2224 and the lower portion 2220 of the second housing 2200. Furthermore, the button 2800 is configured to slide within the second cavity 2224 so that at least a portion of the engagement portion 2804 slides within the second cavity 2224 of the second housing 2200. As best illustrated in FIG. 8B, the button 2800 includes a resilient member 2802, disposed within the second cavity 2224 to bias the engagement portion 2804 of the button 2800 to extend fully from the second cavity 2224 and abut the end 2706 of the flange 2704 of the hook 2700.

As further illustrated in FIG. 8B, the second housing 2200 includes an upper portion 2210. As illustrated by the first side 2510 and actuator 2534 of the sliding gear member 2500, and the first sides 2302, 2402 of the first and second inner members 2300, 2400, the second side 2520 of the sliding gear member 2500 and the second sides 2304, 2404 of the first and second inner members 2300, 2400 are inserted into the interior of upper portion 2210 of the second housing 2200. Similar to the first housing 2100, the upper portion 2210 of the second housing 2200 includes a set of gear teeth 2214 within the interior of the upper portion 2210. The gear teeth 2214 are oriented in a substantially circular shape that has a diameter substantially equivalent to the outer surface 2530 of the sliding gear member 2500. The gear teeth 2214 within the upper portion 2210 of the second housing 2200 are sized and shaped substantially similar to the gear teeth 2116 within the upper portion 2110 of the first housing 2100. Moreover, the gear teeth 2214 within the upper portion 2210 of the second housing 2200 are aligned with the gear teeth 2116 within the upper portion 2110 of the first housing 2100. Additionally, the gear teeth 2214 extend toward the center of the set of gear teeth 2214, and are also tapered as the gear teeth 2214 extend toward the center of the set of gear teeth 2214. Moreover, as illustrated, the gear teeth 2214 of the upper portion 2210 of the second housing 2200 are engaged and intermeshed with the outer gear teeth 2532 on the outer surface 2530 of the sliding gear member 2500. Because the gear teeth 2214 of the second housing 2200 and the outer gear teeth 2532 of the sliding gear member 2500 are tapered, as described previously, the gear teeth 2214 and the outer gear teeth 2532 are more easily engaged with one another, even when not perfectly aligned. Thus, when the first and second housings 2100, 2200 are coupled to one another, the outer gear teeth 2532 of the sliding gear member 2500 are meshed simultaneously with both the gear teeth 2116 of the first housing 2100 and the gear teeth 2214 of the second housing 2200.

As best illustrated in FIG. 9, and unlike the first housing 2100, the upper portion 2210 of the second housing 2200 includes only one opening 2212. The opening 2212 is sized and configured to have a substantially circular shape, and is disposed at a central location on the upper portion 2210 of the second housing 2200. As illustrated in FIG. 9, the first horizontal member 1100 extends through the upper portion 2210 of the second housing 2200 and the opening 2212.

The lower portion 2120 of the first housing 2100 and the lower portion 2220 of the second housing 2200 are also configured to receive a portion of the proximal end 1304 of the leg 1300. As illustrated in FIG. 3, the lower portion 2120 of the first housing 2100 includes a pair of apertures 2126. While not illustrated, the lower portion 2220 of the second housing 2200 also include a pair of apertures 2226. As further illustrated in FIGS. 8A and 8B, the proximal end 1304 of the leg 1300 also contains two pairs of apertures 1306 that are disposed on the proximal end 1304 opposite of each other. The apertures 1306 of the leg 1300 align with the apertures 2126 of the lower portion 2120 of the first housing 2100 and the apertures 2226 of the lower portion 2220 of the second housing 2200. Thus, once the first and second housings 2100, 2200 are coupled together and enclosing the proximal end 1304 of the leg 1300, fasteners 8000 can be inserted through the apertures 2126 on the lower portion 2120 of the first housing 2100, the apertures 1306 on the proximal end 1304 of the leg 1300, and the apertures 2226 on the lower portion 2220 of the second housing 2200, locking the first and second housings 2100, 2200 together, and the proximal end 1304 of the leg 1300 to the interior of the first and second housings 2100, 2200.

Turning to FIG. 10, illustrated is an exploded view of the leg lock 2000 of the embodiment shown in FIG. 3. As illustrated in FIG. 10, the leg lock 2000 is assembled by coupling the first and second inner members 2300, 2400 around a first horizontal member 1100 or the second horizontal member 1200. The sliding member 2500 is then slid over the first and second inner members 2300, 2400 from the second end 2304, 2404 towards the first end 2302, 2402 until the inner gear teeth 2542 engage and intermesh with the gear teeth 2312, 2412 of the first and second inner members 2300, 2400. The resilient member 2600 is then slid over the inner members 2300, 2400 from the second sides 2304, 2404 towards the first sides 2302, 2402 until the resilient member 2600 contacts the sliding gear member 2500. The first and second housing 2100, 2200 can then be combined around the combination of the first and second inner members 2300, 2400, the sliding gear member 2500, and the resilient member 2600. The first sides 2302, 2402 of the first and second inner members 2300, 2400 are enclosed by the upper portion 2110 of the first housing 2100, and the second sides 2304, 2404 of the first and second inner members 2300, 2400 are enclosed by the upper portion 2210 of the second housing 2200. Moreover, as illustrated in FIG. 10, when the first and second housings 2100, 2200 of this embodiment of the leg lock 2000 are coupled to one another, the lower portions 2120, 2220 of the housings 2100, 2200 enclose the anchor portion 2702 of hook 2700, while the flange 2704 remains outside of the lower portions 2120, 2220 of the housings 2100, 2200.

Turning back to FIG. 9, illustrated is a cross sectional view of the leg lock 2000. As illustrated in FIG. 9, and explained previously, the leg lock 2000 is built around the first horizontal member 1100 or second horizontal member 1200. Moreover, the first and second inner members 2300, 2400 are coupled to one another and to the first horizontal member 1100 by fasteners 8000 that extend from the first inner member 2300 to the second inner member 2400, through the first horizontal member 1100. Thus, the first and second inner members 2300, 2400 are fixedly coupled to the first horizontal member 1100, and they are not capable of rotating with respect to the first horizontal member 1100. As previously explained, the sliding gear member 2500 is slidably disposed over the first and second inner members 2300, 2400. Additionally, the resilient member 2600 is also disposed over the first and second inner member 2300, 2400. Finally, the first and second housings 2100, 2200 are disposed around the first and second inner members 2300, 2400, the sliding gear member 2500, and the resilient member 2600.

As illustrated in FIG. 9, the first sides 2302, 2402 of the first and second inner members 2300, 2400 are positioned within the first opening 2112 of the first housing 2100. Furthermore, the second sides 2304, 2404 of the first and second inner members 2300, 2400 are positioned within the opening 2212 of the second housing 2200. FIG. 9 illustrates the sliding gear member 2500 disposed around the first and second inner members 2300, 2400 so that the inner gear teeth 2542 are engaged and intermeshed with the gear teeth 2312, 2412 of the first and second inner members 2300, 2400. The outer gear teeth 2532 of the sliding gear member 2500 are engaged and intermeshed with both the gear teeth 2116 of the first housing 2100 and the gear teeth 2214 of the second housing 2200 simultaneously. When the sliding gear member 2500 is disposed in this position, the actuator 2534 of the sliding gear member 2500 extends through, and out of, the second opening 2114 of the first housing 2100. Moreover, as illustrated, the resilient member 2600 is abutting the sliding gear member 2500 and the second housing 2200. Thus, the resilient member 2600 is biasing the sliding gear member 2500 into engagement with the gear teeth 2312, 2412 of the first and second inner members 2300, 2400.

When the sliding gear member 2500 is positioned as illustrated in FIG. 9, the leg lock 2000 is locked into place on the first horizontal member 1100, and cannot rotate about the first horizontal member 1100 and axis I. Because the first and second inner members 2300, 2400 are fixedly coupled to the first horizontal member 1100, and, when in the position illustrated in FIG. 9, the sliding member 2500 is simultaneously engaged with the first and second inner members 2300, 2400 and the first and second housings 2100, 2200, the first and second housings 2100, 2200 cannot rotate about axis I. However, when a user depresses the actuator 2534 of the sliding gear member 2500, the sliding gear member 2500 is forced to slide along axis I towards the second sides 2304, 2404 of the first and second inner members 2300, 2400. As the sliding gear member 2500 slides along axis I towards the second sides 2304, 2404 of the first and second inner members 2300, 2400, the inner gear teeth 2542 of the sliding gear member 2500 disengages from the gear teeth 2312, 2412 of the first and second inner members 2300, 2400. Simultaneously, the alignment members 2544 (illustrated in FIGS. 5, 6) are slid out of the recessed slots 2316, 2416 (illustrated in FIGS. 4B and 5) of the first and second inner members 2300, 2400 and into the recessed portions 2314, 2414 (illustrated in FIGS. 4A and 4B) of the first and second inner members 2300, 2400. While the sliding gear member 2500 slides along axis I towards the second sides 2304, 2404 of the first and second inner members 2300, 2400, the resilient member 2600 is compressed.

Moreover, because the outer gear teeth 2532 are longer in width than the inner gear teeth 2542, in any position that the sliding gear member 2500 is slid along axis I, the outer gear teeth 2532 remain engaged and intermeshed with the gear teeth 2116, 2214 of the first and second housings 2100, 2200. Thus, even though the inner gear teeth 2532 are disengaged from the gear teeth 2312, 2412 of the first and second inner members 2300, 2400 as the sliding gear member 2500 slides along axis I towards the second sides 2304, 2404 of the first and second inner members 2300, 2400, the outer gear teeth 2532 of the sliding gear member 2500 remains engaged with the gear teeth 2116, 2214 of the first and second housings 2100, 2200. Therefore, once a user depresses the actuator 2534 of the sliding gear member 2500, causing the inner gear teeth 2542 to disengage from the gear teeth 2312, 2412 of the first and second inner members 2300, 2400 and the alignment members 2544 to disengage from the recessed slots 2316, 2416 of the first and second inner members 2300, 2400, the first and second housings 2100, 2200 and the sliding gear member 2500 are able to rotate about axis I. This allows the leg lock 2000 and, as a result, the leg 1300, to rotate about the first horizontal member 1100 of the frame 1000.

Once the actuator 2534 is no longer pressed into the leg lock 2000 by a user, the resilient member 2600 biases the sliding gear member 2500 toward the first sides 2302, 2402 of the first and second inner members 2300, 2400. However, if the alignment members 2544 of the sliding gear member 2500 are not aligned with the recessed slots 2316, 2416 of the first and second inner members 2300, 2400, than the sliding gear member 2500 does not slide far enough toward the first sides 2302, 2402 of the first and second inner members 2300, 2400 for the inner gear teeth 2542 of the sliding gear member 2500 to engage and intermesh with the gear teeth 2312, 2412 of the first and second inner members 2300, 2400. Thus, the first and second housings 2100, 2200 and the sliding gear member 2500 are able to rotate freely about axis I until the alignment members 2544 of the sliding gear member 2500 are aligned with the recessed slots 2316, 2416 of the first and second inner members 2300, 2400. As a result, the leg lock 2000, and in turn, the leg 1300, are free to rotate about the first horizontal member 1100 of the frame 1000 until the alignment members 2544 of the sliding gear member 2500 are aligned with the recessed slots 2316, 2416 of the first and second inner members 2300, 2400.

Turning to FIGS. 14A, 14B, 14C, and 14D, illustrated is a second embodiment of the leg lock 2000. The discussion of FIGS. 14A, 14B, 14C, and 14D only includes one leg lock 2000, but, because the leg locks 2000 are structurally identical to each other, the discussion of this embodiment of the leg lock 2000 can be applied to all of the leg locks 2000 illustrated in FIG. 1. The second embodiment of the leg lock 2000 illustrated in FIGS. 14A, 14B, 14C, and 14D is substantially similar to the first embodiment of the leg lock 2000 illustrated in FIGS. 3, 8A, 8B, and 10. As illustrated in FIGS. 14A, 14B, 14C, and 14D, this second embodiment of the leg lock 2000 includes a first housing 2100 and a second housing 2200. The first housing 2100 includes an upper portion 2110 and a lower portion 2120, while the second housing 2200 also includes an upper portion 2210 and a lower portion 2220.

Figure 14A:
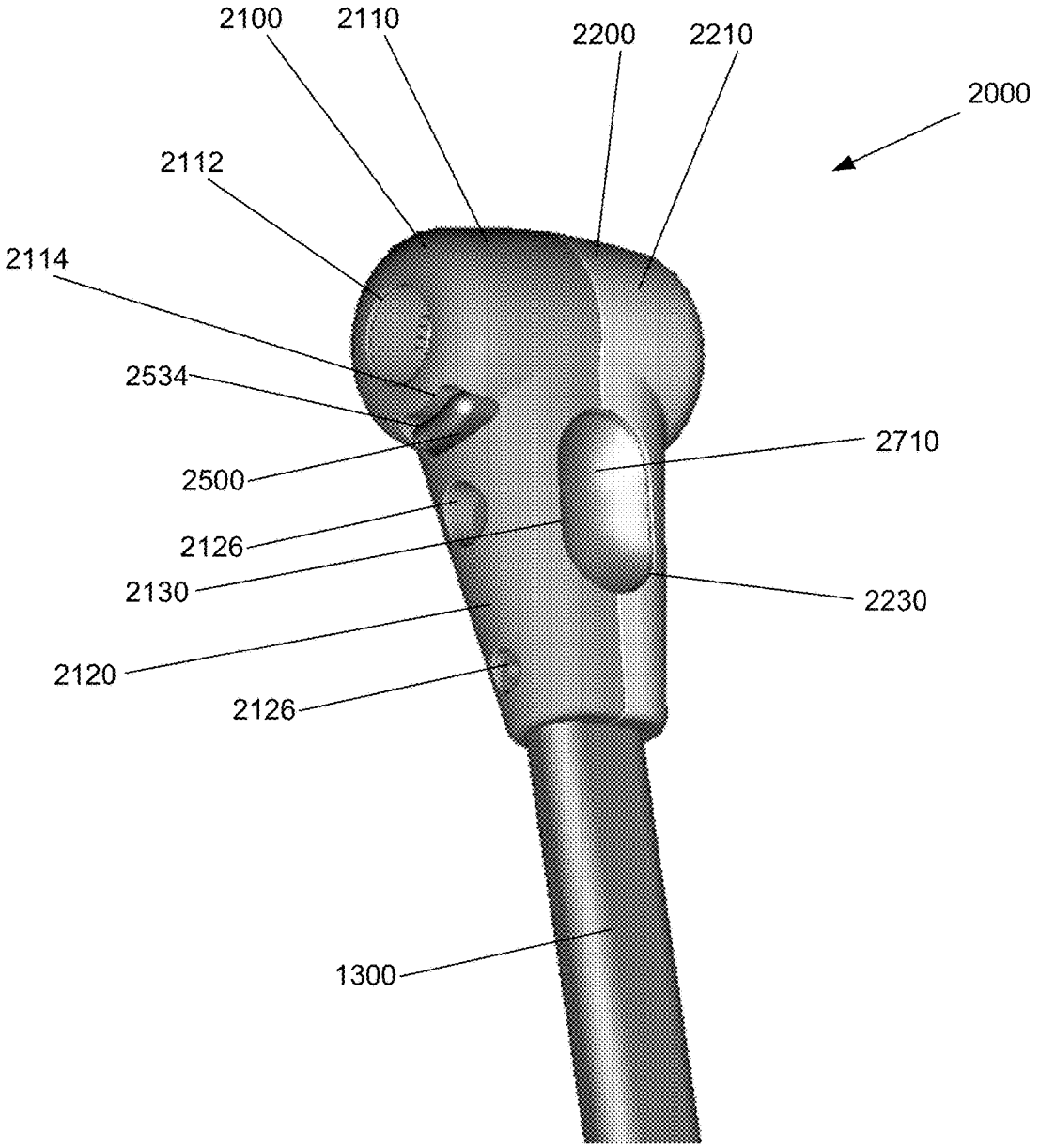
FIG. 14A illustrates a perspective view of a second embodiment of the leg lock of the play yard illustrated in FIG. 1.

Similar to the first embodiment, the first housing 2100 of the second embodiment of the leg lock 2000 includes a first opening 2112 that is central to the upper portion 2110 and a second opening 2114. The second opening 2114 is disposed on the upper portion 2110 of the first housing 2100 at a location offset from the first opening 2112. In this second embodiment, however, the second opening 2114 is disposed on the upper portion 2110 of the first housing 2100 proximate to the connection of the upper portion 2110 to the lower portion 2120. The second opening 2114 is sized and configured to receive the actuator 2534 of the sliding gear member 2500. As best illustrated in FIG. 14A, the actuator 2534 of the sliding gear member 2500 extends outwardly from the second opening 2114. The second housing 2200 of the embodiment of the leg lock 2000 best illustrated in FIGS. 14A, 14B, and 14D includes an opening 2212 in the upper portion 2210. Furthermore, the lower portion 2120 of the first housing 2100 includes a pair of apertures 2126 and the lower portion 2220 of the second housing 2200 also includes a pair apertures 2226. As previously explained with the first embodiment of the leg lock 2000, the proximal end 1304 of the leg 1300 is inserted into the lower portion 2120 of the first housing 2100 and the lower portion 2220 of the second housing 2200. The leg 1300 contains two pairs of apertures 1306 that are disposed on the proximal end 1304 opposite of each other. The apertures 1306 of the leg 1300 align with the apertures 2126 of the lower portion 2120 of the first housing 2100 and the apertures 2226 of the lower portion 2220 of the second housing 2200. Thus, once the first and second housings 2100, 2200 are coupled together and enclosing the proximal end 1304 of the leg 1300, fasteners 8000 can be inserted through the apertures 2126 on the lower portion 2120 of the first housing 2100, the proximal end 1304 of the leg 1300, and the apertures 2226 on the lower portion 2220 of the second housing 2200, locking the first and second housings 2100, 2200 together, and the proximal end 1304 of the leg 1300 to the interior of the first and second housings 2100, 2200.

Figure 14B:
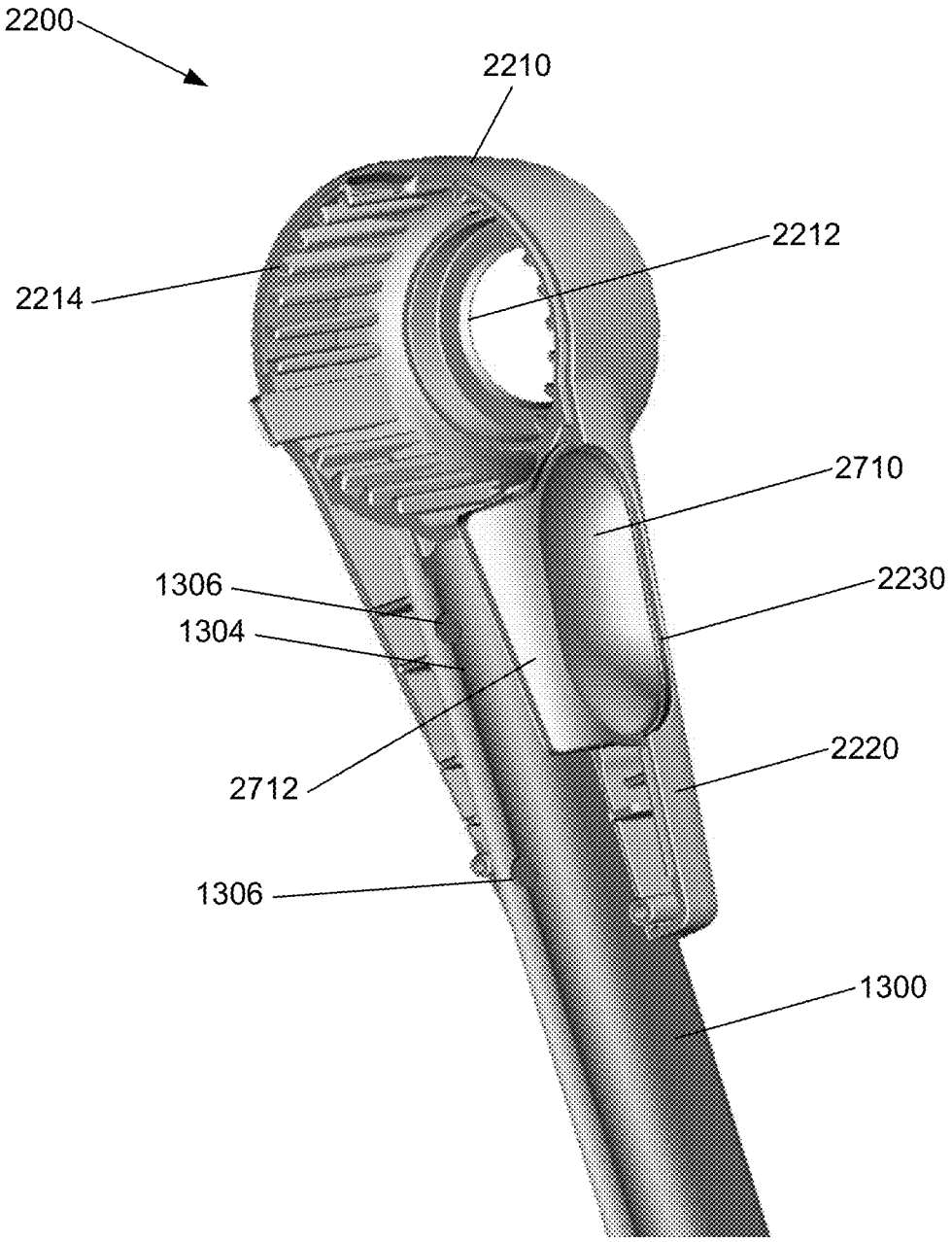
FIG. 14B illustrates an interior view of the second housing of the leg lock illustrated in FIG. 14A.
Figure 14C:
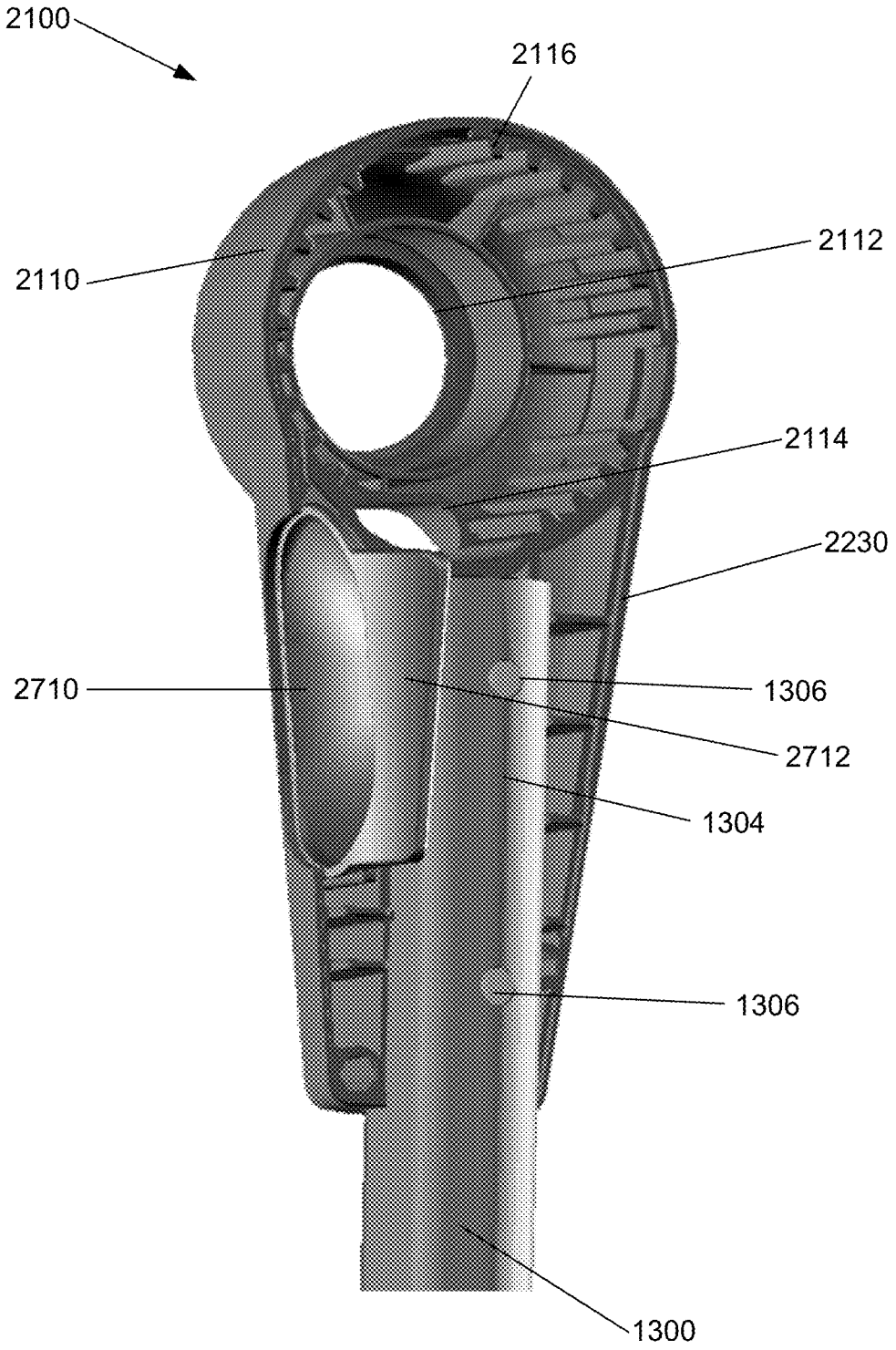
FIG. 14C illustrates an interior view of the first housing of the leg lock illustrated in FIG. 14A.

As illustrated in FIGS. 14B and 14C, the interior of the upper portion 2110 of the first housing 2100 includes gear teeth 2116, and the interior of the upper portion 2210 of the second housing 2200 includes a set of gear teeth 2214. The upper portion 2110 of the first housing 2100 and the upper portion 2210 of the second housing 2200 of the second embodiment of the leg lock 2000 illustrated in FIGS. 14A, 14B, 14C, and 14D are substantially similar to the upper portions 2110, 2210 of the first embodiment of the leg lock 2000 illustrated in FIGS. 3, 8A, 8B, and 9. Therefore, the second embodiment of the leg lock 2000 interacts with the first inner member 2300, second inner member 2400, slidable member 2500, and the spring 2600 in substantially the same manner as explained for the first embodiment of the leg lock 2000. Thus, the second embodiment of the leg lock 2000 is configured to rotate about the horizontal members 1100, 1200 of the frame 1000 and lock into place in the same manner as explained previously. Thus, the gear teeth 2116, 2214 of the second embodiment of the leg lock 2000 are oriented in a substantially circular shape and have a diameter substantially equivalent to the outer surface 2530 of the sliding gear member 2500. The gear teeth 2214 within the upper portion 2210 of the second housing 2200 are aligned with the gear teeth 2116 within the upper portion 2110 of the first housing 2100. When the first and second housings 2100, 2200 are coupled to one another, the outer gear teeth 2532 of the sliding gear member 2500 are meshed simultaneously with both the gear teeth 2116 of the first housing 2100 and the gear teeth 2214 of the second housing 2200.

Figure 14D:
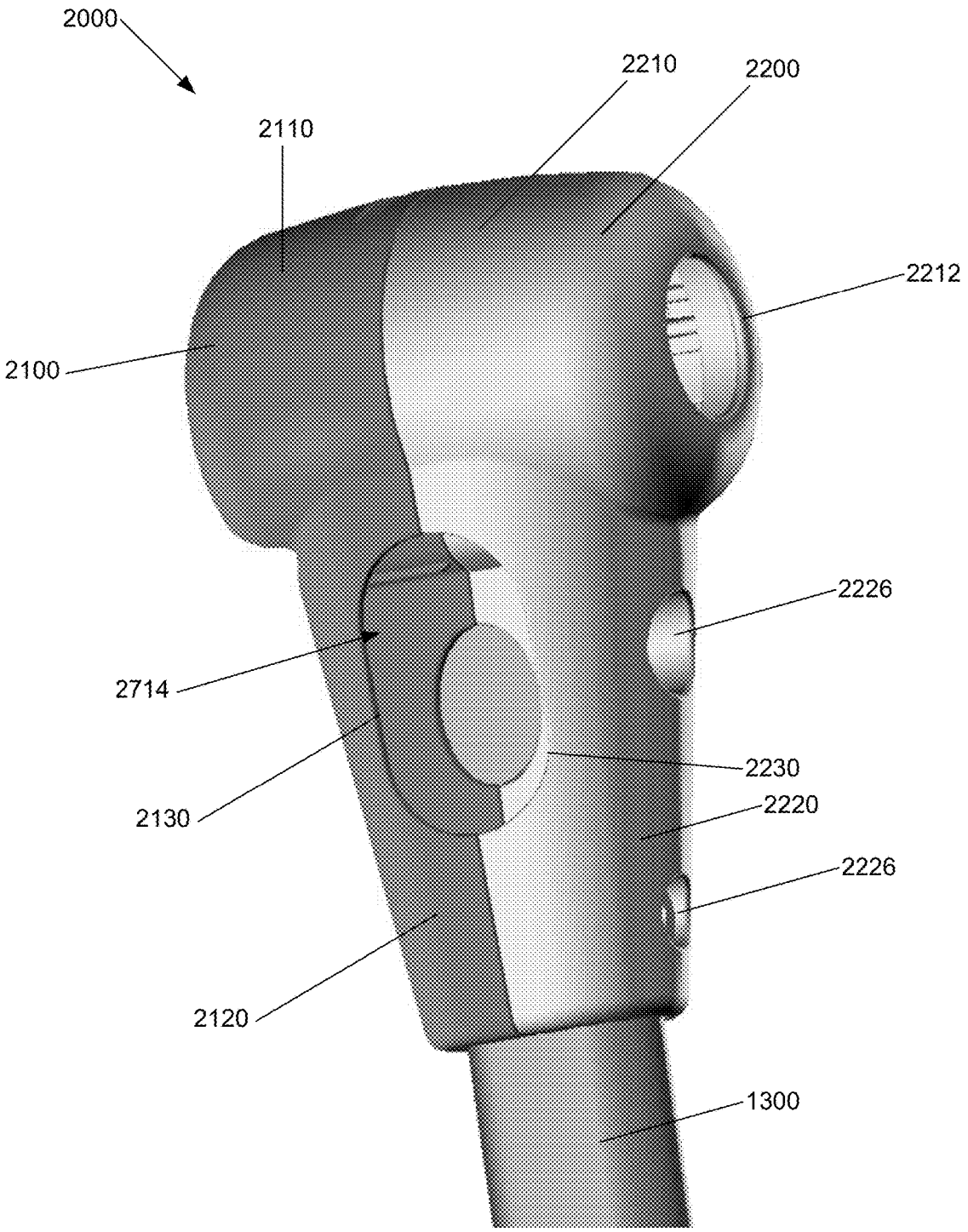
FIG. 14D illustrates a front view of the leg lock illustrated in FIG. 14A, the locking cavity member being removed from the leg lock.

However, this second embodiment of the leg lock 2000 differs substantially from the first embodiment of the leg lock 2000 with regard to the lower portions 2120, 2220 of the first and second housings 2100, 2200, respectively. The second embodiment of the leg lock 2000 includes a locking cavity member 2710, illustrated in FIGS. 14A, 14B, and 14C instead of the hook 2700 and button 2800 illustrated in FIGS. 3, 8A, 8B, and 10. According to this second embodiment of the leg lock 2000, the lower portion 2120 of first housing 2100 includes a first cutout portion 2130, while the lower portion 2220 of the second housing 2200 includes a second cutout portion 2230. As best illustrated in FIG. 14D, when the first housing 2100 and the second housing 2200 are coupled to one another, the first cutout portion 2130 and the second cutout portion 2230 together form a cavity opening 2714. As best illustrated by FIG. 14A, the locking cavity member 2710 is placed within the cavity opening 2714. Illustrated in FIGS. 14B and 14C, the locking cavity member 2710 includes extensions 2712 on each side, which, when surrounded by the lower portions 2120, 2220 of the first and second housings 2100, 2200, extend beyond the first and second cutout portions 2130, 2230. The extensions 2712 prevent the locking cavity member 2710 from sliding out of alignment with the cavity opening 2714 formed by the cutout portions 2130, 2230.

Figure 11A:
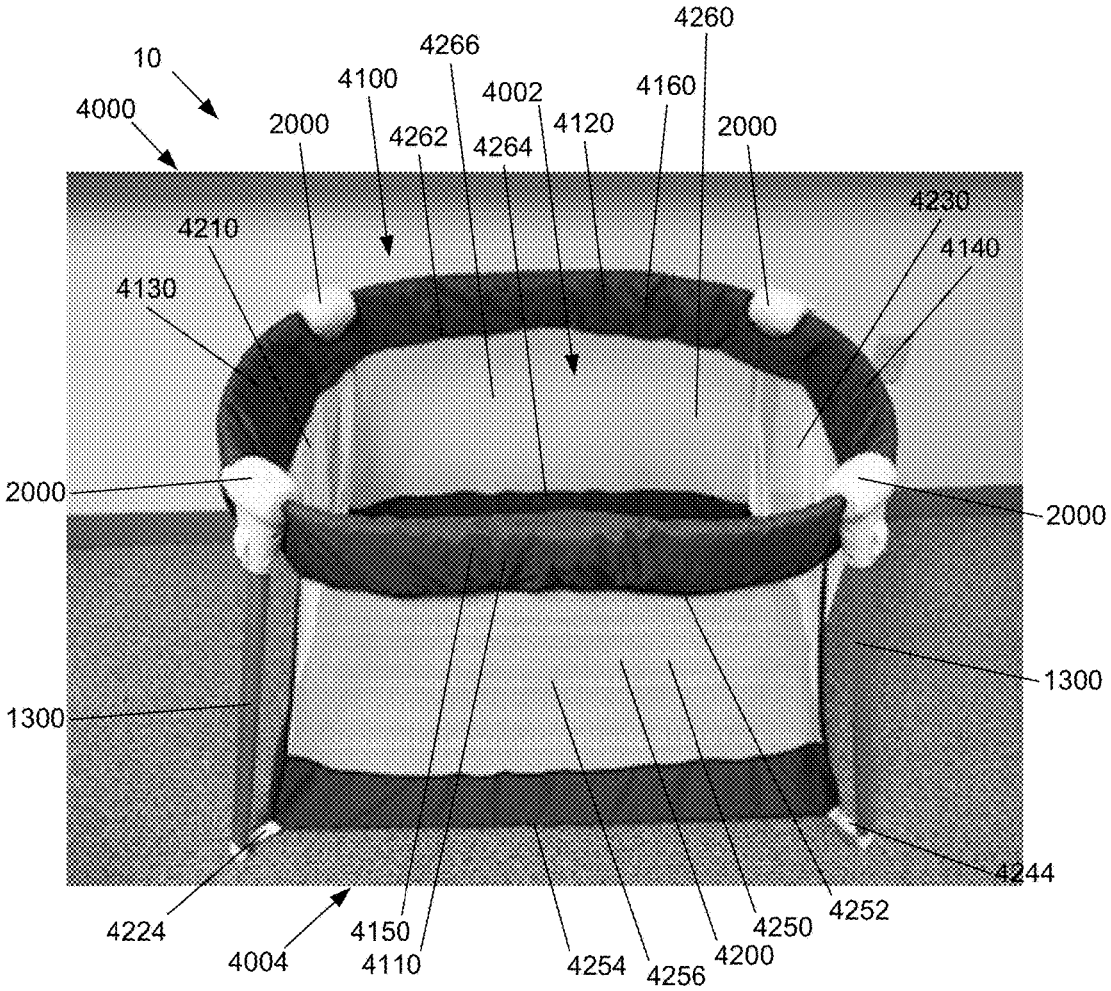
FIG. 11A illustrates a front view of a play yard in accordance with the present invention.
Figure 11B:
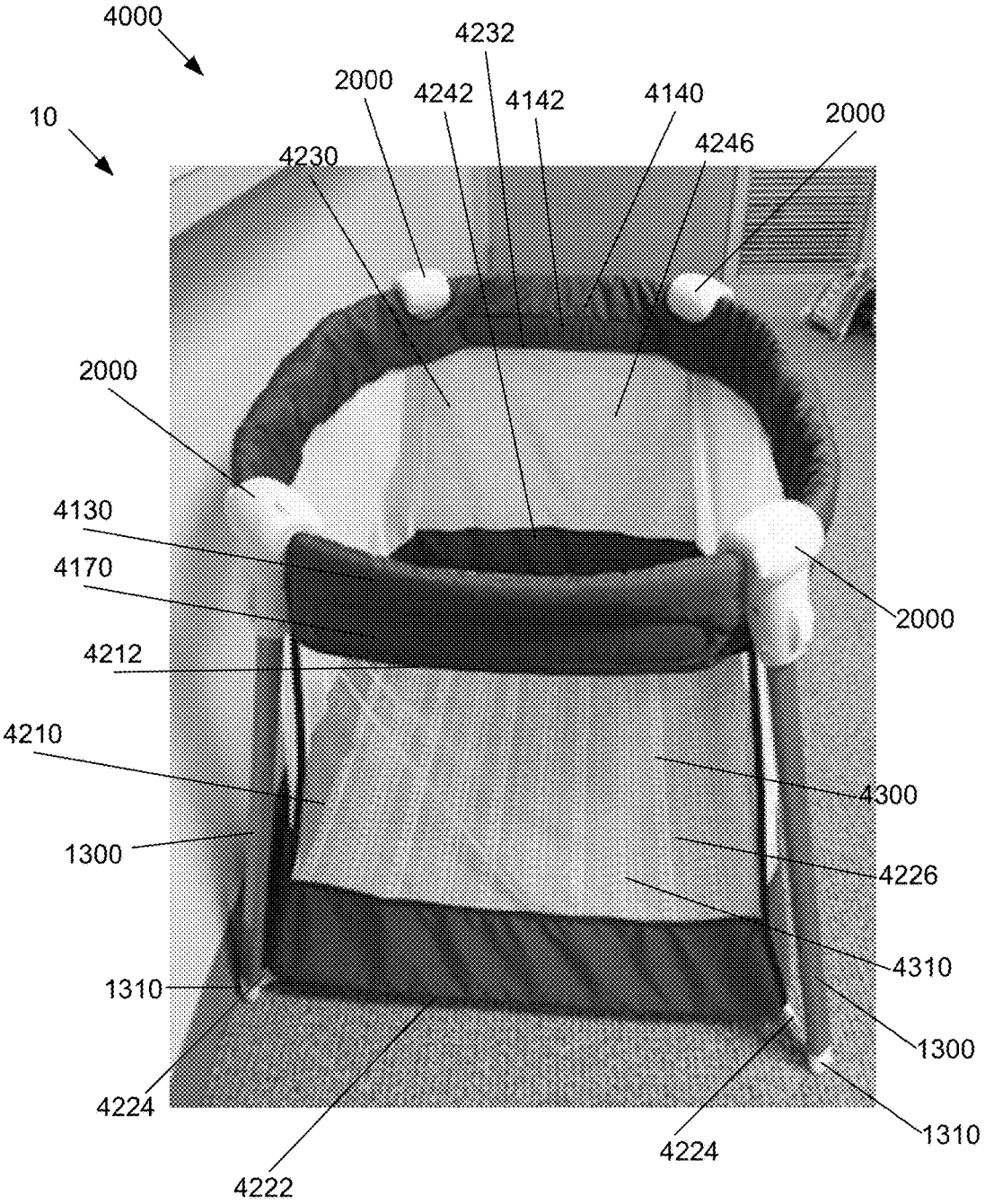
FIG. 11B illustrates a side view of the play yard illustrated in FIG. 11A.

Turning back to FIGS. 11A and 11B, illustrated is the apparatus 10 in the play yard configuration, where the play yard cover 4000 is coupled to the frame 1000. The play yard cover 4000 includes a top portion 4100, a set of side panels 4200, and a bottom 4300. The side panels 4200 connect the top portion 4100 to the bottom 4300. The play yard cover 4000 defines an interior portion 4002 and an exterior portion 4004 with a large opening in the top of the cover 4000 to access the interior portion 4002. As illustrated in FIGS. 11A and 11B, the play yard cover 4000 covers the frame 1000 and frame lock 3000 of the apparatus 10, but leaves the leg locks 2000 and the legs 1300 uncovered and exposed. When the apparatus 10 is in the play yard configuration, an infant can be placed within the interior 4002 for play time in a confined area.

As further illustrated in FIG. 11A, the top portion 4100 of the play yard cover 4000 is folded over the frame 1000 of the apparatus 10, which causes the top portion 4100 to have an inner portion 4120 and an outer portion 4110. The top portion 4100 of the play yard cover 4000 includes a first side 4130, a second side 4140, a front side 4150, and a rear side 4160. The first side 4130 and the second side 4140 connect the front side 4150 to the rear side 4160. Furthermore, because of the shape of the frame 1000 illustrated in FIG. 1, the first and second sides 4130, 4140 of the top portion 4100 are shorter in length than the front and rear sides 4150, 4160 of the top portion 4100. In addition, the side panels 4200 include a first side panel 4210, a second side panel 4230, a front side panel 4250, and a rear side panel 4260, where the first side panel 4210 and the second side panel 4230 connect the front side panel 4250 to the rear side panel 4260. As best illustrated in FIG. 11B, the first side panel 4210 includes a top edge 4212, a bottom edge 4222, and a mesh panel 4226, and the second side panel 4230 includes a top edge 4232, a bottom edge 4242, and a mesh panel 4246. Additionally, as best illustrated in FIG. 11A, the front side panel 4250 includes a top 4252, a bottom 4254, and a mesh panel 4256, and the rear side panel 4260 includes a top 4262, a bottom 4264, and a mesh panel 4266. As illustrated in FIGS. 11A and 11B, the top edge 4212 of the first side panel 4210 is coupled to the first side 4150 of the top portion 4100, the top edge 4232 of the second side panel 4230 is coupled to the second side 4140 of the top portion 4100, the top edge 4252 of the front side panel 4250 is coupled to the front side 4150 of the top portion 4100, and the top edge 4262 of the rear side panel 4260 is coupled to the rear side 4160 of the top portion 4100. Moreover, the mesh panels 4226, 4246, 4256, 4266 are configured to allow air to pass through the side panels 4200 so that an infant within the play yard 10 can breathe through the side panels 4200.

Furthermore, the play yard cover 4000 includes a bottom 4300. As illustrated, the bottom 4300 is coupled to the bottom 4222 of the first side panel 4210, the bottom 4242 of the second side panel 4230, the bottom 4254 of the front side panel 4250, and the bottom 4264 of the rear side panel 4260. Moreover, the bottom 4300 is configured to support a removable mattress 4310. As further illustrated in FIGS. 11A and 11B, extending from the bottom 4222 of the first side panel 4210 is a pair of tethers 4224. The tethers 4224 extend to legs 1300 proximate to the first side panel 4210. As best illustrated in FIG. 11B, the tethers 4224 are coupled to the feet 1310 that are coupled to the legs 1300. While FIG. 11A only illustrates one tether 4244, the bottom 4242 of the second side panel 4230 also contains a pair of tethers 4244 that extend from the bottom 4242 of the second side panel 4230 to the legs 1300 that are proximate the second side panel 4230. The tethers 4224, 4244, by being connected to the legs 1300 of the frame 1000, provide the shape of the bottom 4300 of the play yard cover 4000 in the deployed configuration.

Turning to FIG. 11B, the outer portion 4110 of the first side 4130 of the top portion 4100 includes a female connector panel 4170. Similarly, while not illustrated, the outer portion 4110 of the second side 4140 of the top portion 4100 also includes a female connector panel 4180. As illustrated in FIG. 11B, the inner portion 4120 of the second side 4140 of the top portion 4100 includes a male connector panel 4142. While not illustrated, the inner portion 4120 of the first side 4130 of the top portion 4100 also includes a male connector panel 4132. The male connector panels 4132, 4142 are configured to be coupled to the female connector panels 4170, 4180 to aid in securing the play yard cover 4000 to the frame 1000 of the apparatus 10 (as discussed below in greater detail with respect to FIGS. 12A and 12B). In the embodiment illustrated, only the first side 4130 and the second side 4140 of the top portion 4100 include male connectors 4132, 4142 and female connectors 4170, 4180.

Figure 12A:
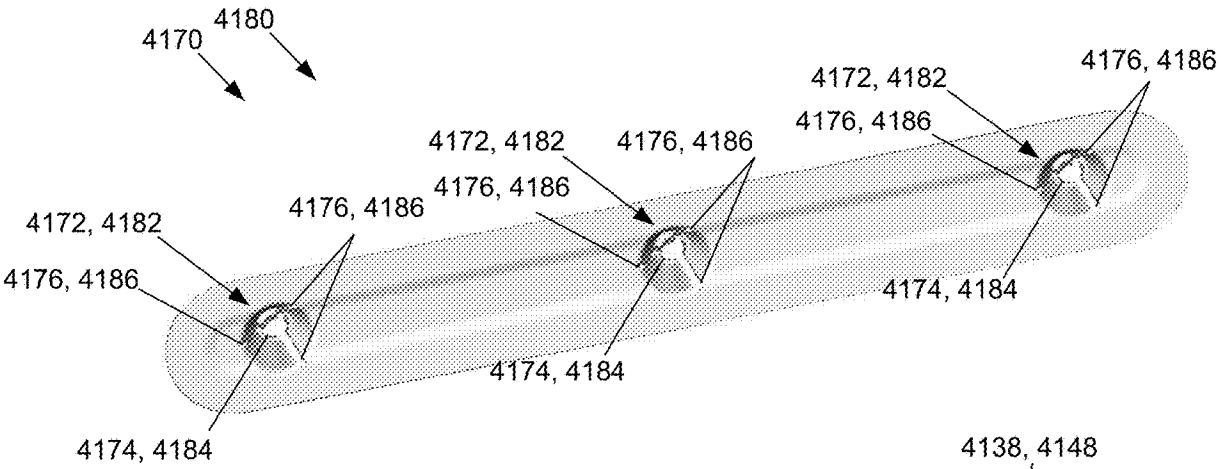
FIG. 12A illustrates a perspective view of the female connector of the play yard illustrated in FIG. 11A.
Figure 12B:
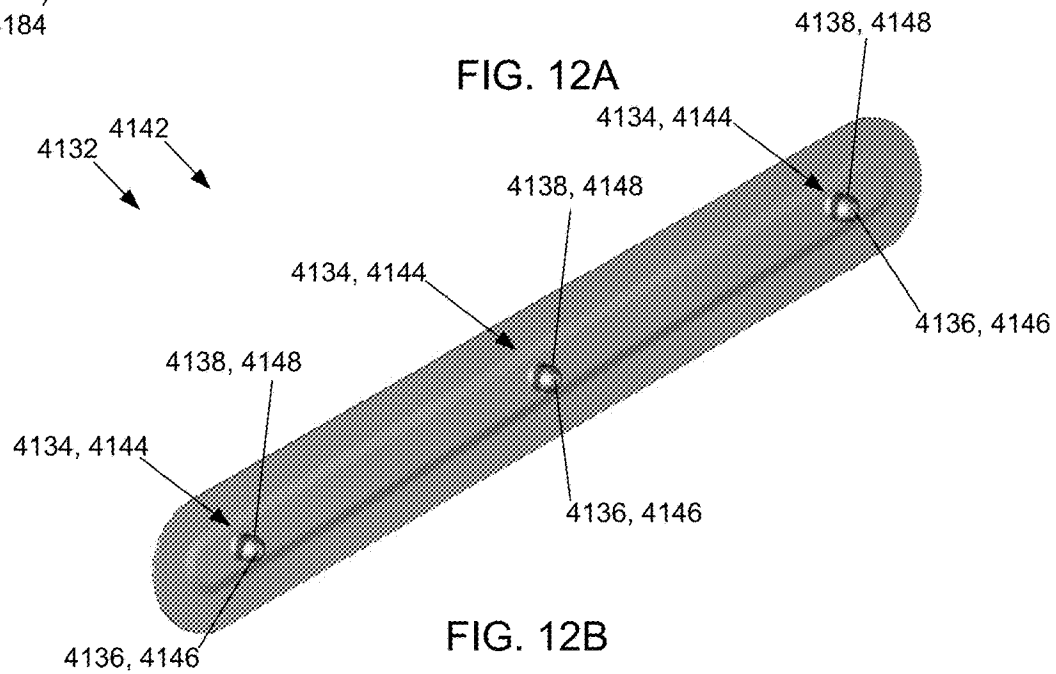
FIG. 12B illustrates a perspective view of the male connector of the play yard illustrated in FIG. 11A.

Turning to FIGS. 12A and 12B, illustrated are a female connector panel 4170, 4180 and male connector panel 4132, 4142. While only one female connector panel 4170, 4180 is illustrated in FIG. 12A, it is representative of both the female connector panel 4170 disposed on the first side 4130 of the top portion 4100 and the female connector panel 4180 disposed on the second side 4140 of the top portion 4100. Similarly, while only one male connector panel 4132, 4142 is illustrated in FIG. 12B, it is representative of both the male connector panel 4132 disposed on the first side 4130 of the top portion 4100 and the male connector panel 4142 disposed on the second side 4140 of the top portion 4100. As illustrated in FIG. 12A, the female connector panel 4170, 4180 includes a set of three receivers 4172, 4182. While this embodiment of the female connector panel 4170, 4180 includes three receivers 4172, 4182, other embodiments may include more or less receivers 4172, 4182. The receivers 4172, 4182 are equally spaced about the female connector panel 4170, 4180. The receivers 4172, 4182 protrude from the female connector panel 4170, 4180 and include a central opening 4174, 4184. Moreover, the receivers 4172, 4182 include a set of extending slots 4176, 4186, which radiate from the central opening 4174, 4184. The extending slots 4176, 4186 enable portions of the receivers 4172, 4182 to deform when receiving the male connectors 4134, 4144 of the male connector panels 4132, 4142.

As illustrated in FIG. 12B, the male connector panel 4132, 4142 includes a set of three male connectors 4134, 4144 which correspond to the receivers 4172, 4182 on the female connector panels 4170, 4180. The male connectors 4132, 4142 are equally spaced on the male connector panel 4132, 4142, where the spacing is equivalent to that of the receivers 4172, 4182 of the female connector panels 4170, 4180. While this embodiment of the male connector panel 4132, 4142 includes three male connectors 4134, 4144, other embodiments may include more or less than three male connectors 4134, 4144. However, the number of male connectors 4134, 4144 on the male connector panel 4132, 4142 is equivalent to the number of receivers 4172, 4182 of the female connector panels 4170, 4180. The male connectors 4134, 4144 extend from the male connector panel 4132, 4142 and include an end 4136, 4146. The ends 4136, 4146 of the male connectors 4134, 4144 are flanged 4138, 4148. The male connectors 4134, 4144 are sized and shaped to be inserted through the central opening 4174, 4184 of the receivers 4172, 4182. Moreover, the flanges 4138, 4148 are sized and configured to interact with the receivers 4172, 4182 so that the male connectors 4134, 4144 remain inserted into the receivers 4172, 4182. As the male connectors 4134, 4144 are inserted in the central opening 4174, 4184 of the receivers 4172, 4182, the flanges 4138, 4148, which are larger than the central opening 4174, 4184, cause the receivers 4172, 4182 to deform about the extending slots 4176, 4186.

Figure 12C:
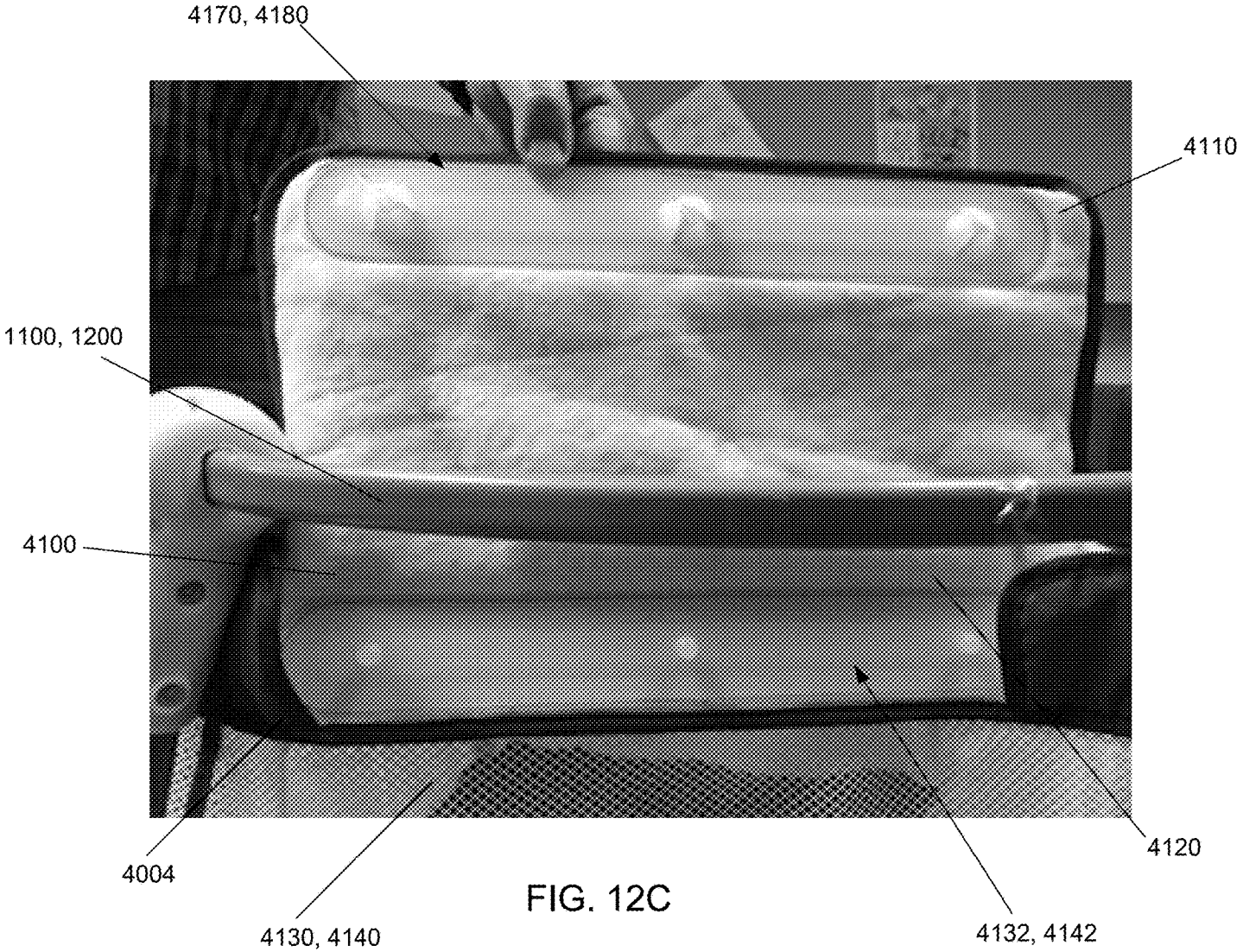
FIG. 12C illustrates a side view of the play yard illustrated in FIG. 11A where the female connector illustrated in FIG. 12A and the male connector illustrated in FIG. 12B are uncoupled from each other.

Turning to FIG. 12C, illustrated is the first side 4130 or second side 4140 of top portion 4100 of the play yard cover 4000 before the top portion 4100 is folded over the frame 1000 of the apparatus 10. As illustrated, the male connector panels 4132, 4142 are disposed on the inner portion 4120 of the first side 4130 or second side 4140 of the play yard cover 4000. Moreover, the female connector panels 4170, 4180 are disposed on the outer portion 4110 of the first side 4130 or second side 4140 of the play yard cover 4000. In other embodiments, the male connector panels 4132, 4142 can be disposed on the outer portion 4110, and the female connector panels can be disposed on the inner portion 4120 of the play yard cover. As further illustrated by FIG. 12C, the male connectors 4134, 4144 of the male connector panels 4132, 4142 extend outward from the exterior 4004 of the play yard cover 4000. It can be As illustrated in FIG. 12, once the top portion 4100 of the play yard cover 4000 is folded over the horizontal members 1100, 1200 of the frame 1000, the female connector panels 4170, 4180 cover the male connector panels 4132, 4142. The male connector panels 4132, 4142 can be pressed against the female connector panels 4170, 4180 causing the male connectors 4134, 4144 to be inserted into the receivers 4172, 7182 of the female connector panels 4170, 4180. This aids in locking the play yard cover 4000 to the frame 1000. Returning to FIGS. 11A and 11B, the front side 4150 of the top portion 4100 is sewn to itself, creating a tunnel that encircles the frame 1000. Similarly, the rear side 4160 of the top portion 4100 is sewn to itself, creating a tunnel that encircles the frame 1000. Thus, the front side 4150 and the rear side 4160 encase a portion of the frame 1000 via sewing, while the first side 4130 and the second side 4140 encase a portion of the frame 1000 via the mating of the male connector panels 4132, 4142 and the female connector panels 4170, 4180.

Figure 13A:
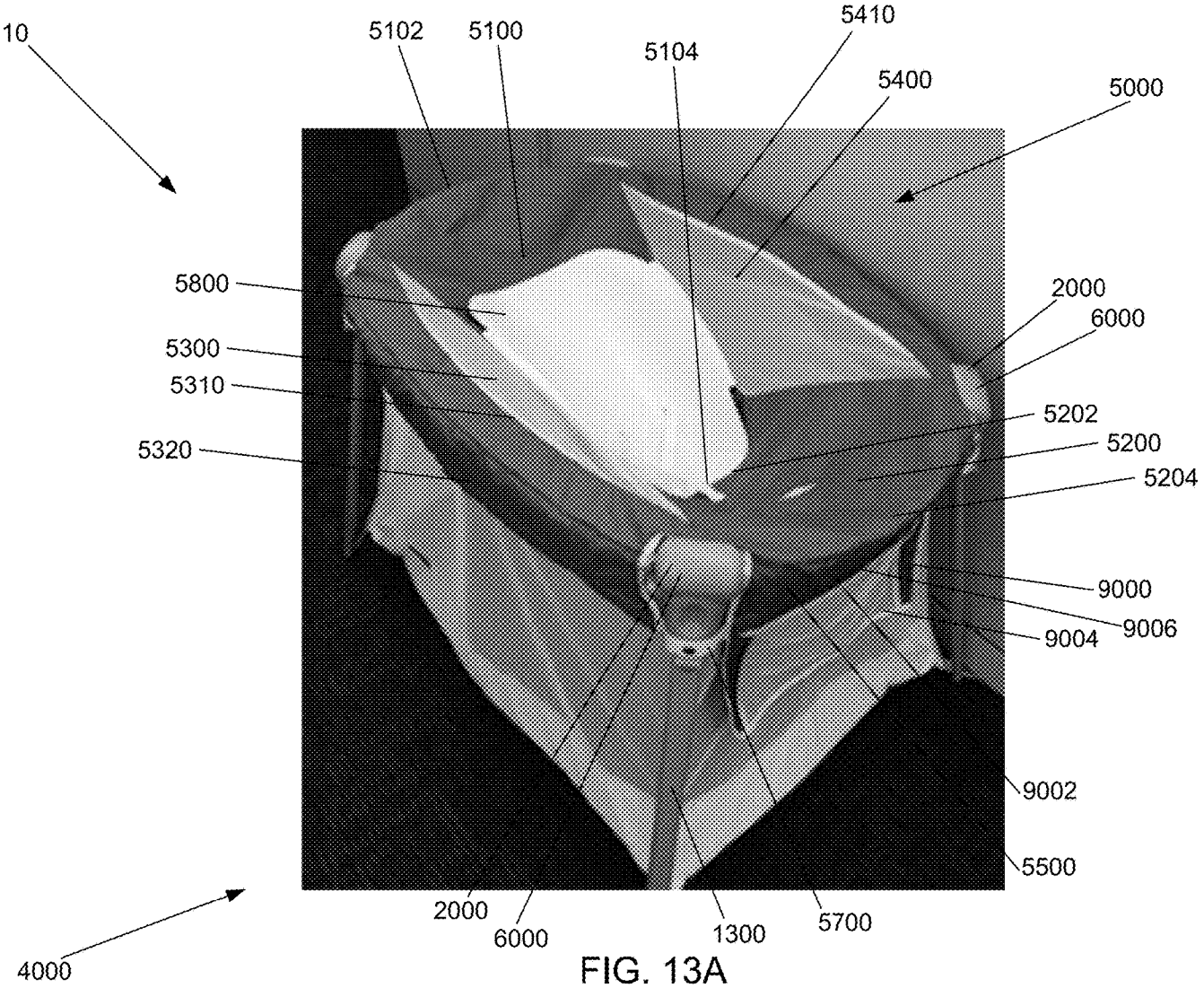
FIG. 13A illustrates a perspective view of the sleeper cover connected to the play yard illustrated in FIG. 11A.

Turning to FIG. 13A, illustrated is the sleeper cover 5000 being coupled to the play yard cover 4000 and the apparatus 10. FIG. 13A illustrates the apparatus 10 in the sleeper configuration. The sleeper cover 5000 is coupled to the apparatus 10 by covering the top portion 4100 of the play yard cover 4000 and being coupled to the leg locks 2000 via strap 5700 and locking covers 6000. As illustrated, the sleeper cover 5000, when coupled to the apparatus 10 in the sleeper configuration, covers access to the interior 4002 of the play yard cover 4000. The sleeper cover 5000 includes a trunk portion 5100 and a foot portion 5200. The trunk portion 5100 includes a top edge 5102 and a bottom edge 5104. The foot portion 5200 includes a top edge 5202 and a bottom edge 5204. The bottom edge 5104 of the trunk portion 5100 is coupled to the top edge 5202 of the foot portion 5200. The sleeper cover 5000 further includes several sidewalls that extend from the trunk portion 5100 and the foot portion 5200, including a front longitudinal sidewall 5300, a rear longitudinal sidewall 5400, a first side latitudinal sidewall 5500, and a second latitudinal sidewall 5600 (illustrated in FIGS. 17A, 17B, and 17C). The front longitudinal sidewall 5300 includes an inner edge 5310 and an outer edge 5320, and is coupled to the trunk portion 5100 and the foot portion 5200. Furthermore, the rear longitudinal sidewall 5400 includes an inner edge 5410 and an outer edge 5420 (not illustrated), and is also coupled to the trunk portion 5100 and the foot portion 5200. The rear longitudinal sidewall 5400 is coupled to the opposite side of the trunk portion 5100 and foot portion 5200 from the front longitudinal sidewall 5300.

Figure 17A:
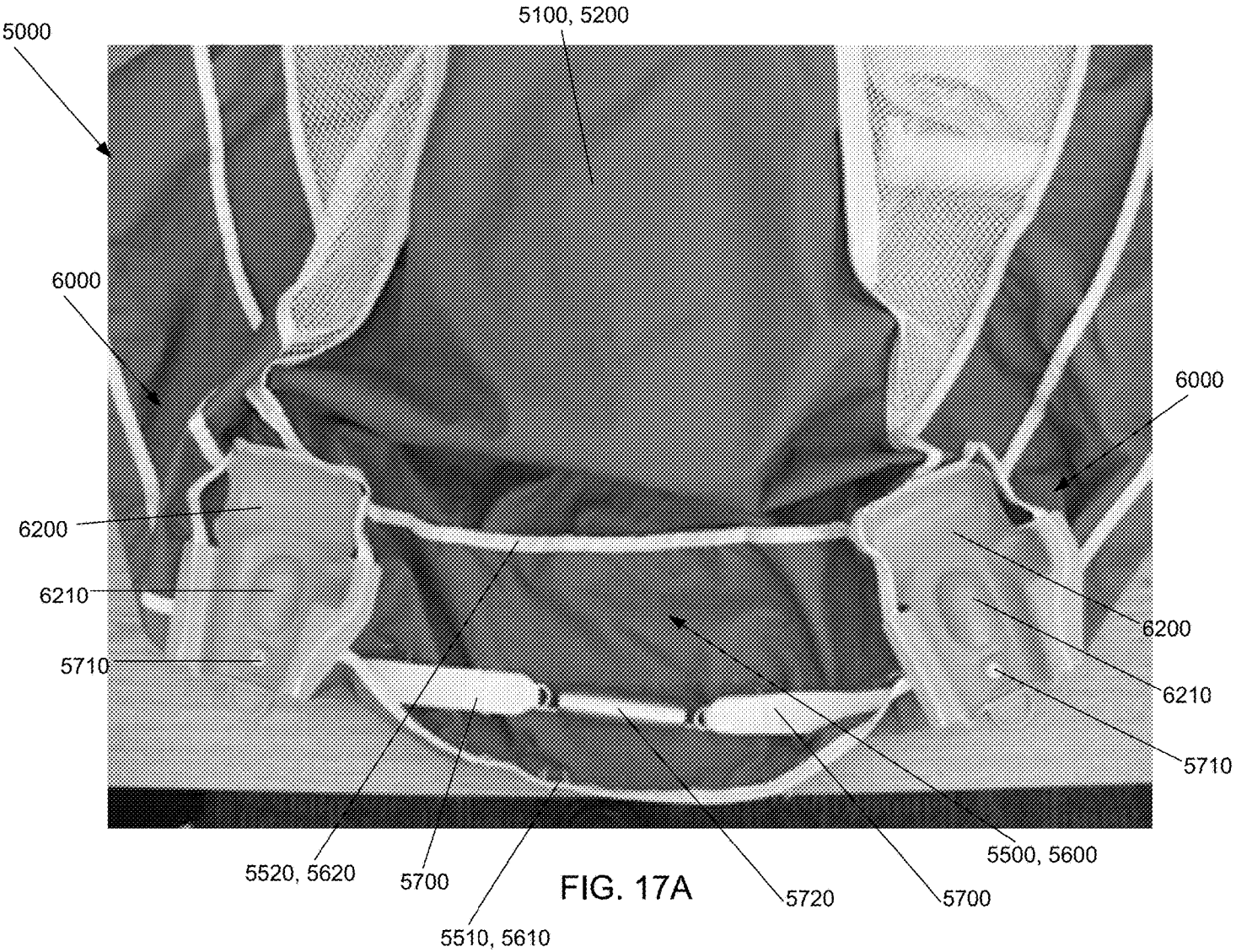
FIG. 17A illustrates a bottom view of the bottom surface of the sleeper cover illustrated in FIG. 13A with the locking covers illustrated in FIG. 15A being coupled to the corners of the sleeper cover.

In addition and best illustrated in FIG. 17A, the first latitudinal sidewall 5500 includes an outer edge 5510 and an inner edge 5520, and is coupled to the bottom edge 5204 of the foot portion 5200. The second latitudinal sidewall 5600 includes an outer edge 5610 and an inner edge 5620, and is coupled to the top edge 5102 of the trunk portion 5100. As further illustrated in FIG. 13A, an outer strap 5700 is coupled to each of the outer edges 5310, 5410, 5510, 5610 of the front longitudinal sidewall 5300, the rear longitudinal sidewall 5400, the first side latitudinal sidewall 5500, and the second latitudinal sidewall 5600. The strap 5700 is exposed at each of the corners of the sleeper 5000, and is coupled to the locking covers 6000.

As illustrated in FIG. 13A, when the sleeper 5000 is coupled to the apparatus 10 is in the sleeper configuration, the front longitudinal sidewall 5300, the rear longitudinal sidewall 5400, the first latitudinal sidewall 5500, and the second latitudinal sidewall 5600 are stretched out to, and over, the top portion 4100 of the play yard cover 4000. In other words, the front longitudinal sidewall 5300, the rear longitudinal sidewall 5400, the first latitudinal sidewall 5500, and the second latitudinal sidewall 5600 are stretched to and over the frame 1000, which is covered by the play yard cover 4000, as described previously. The sleeper cover 5000 is configured to support an infant above a support surface, and the bottom 4300 of the play yard cover 4000. However, as illustrated in FIG. 13A, the trunk portion 5100 and the foot portion 5200 are positioned between the walls formed by the inner portion 4120 and side panels 4200 of the play yard cover 4000, which prevents an infant placed in the sleeper cover 5000 from rolling or falling out of the sleeper cover 5000. In addition, the sleeper cover 5000 may include a retention strap that secures an infant to the trunk portion 5100 and the foot portion 5200.

Moreover, with the sleeper cover 5000 placed on the apparatus 10 in the sleeper configuration, the trunk portion 5100 and the foot portion 5200 are contoured to suspend an infant in a predetermined orientation. In the embodiment illustrated, the trunk portion 5100 and the foot portion 5200 together possesses a slightly inclined sleeping position. While not necessary to practice the invention described in this application, the option for inclined sleeping within the large receiving area of sleeper cover 5000 can present benefits because some children prefer sleeping in an inclined position, while others may benefit because inclined sleeping is often beneficial for children who have difficulty sleeping flat due to, e.g., acid reflux. The large receiving area of sleeper cover 5000 permits such children to sleep in an inclined position for a longer period as the child continues to grow. However, as described below, in other embodiments of the invention the sleeper can employ a fully flat configuration.

Moreover, as illustrated in FIG. 13A, the trunk portion 5100 may further include a substantially rigid or resilient support brace or insert member 5800 configured to provide support for an infant and/or to maintain the side walls 5300, 5400 in spaced relation when an infant is positioned on the seat sleeper cover 5000. The support brace 5800 may possess any shape and dimensions suitable for its described purpose (e.g., to maintain the orientation and position of an infant placed in the sleeper cover 5000). The support brace 5800 may possess a generally oval or elliptical shape, and may be generally contoured to the slope of the trunk portion 5100. The brace 5800 may possess a width substantially equal to that of the trunk portion 5100. Stated another way, the transverse dimension of the support brace 5800 may be substantially equal to the transverse dimension of the trunk portion 5100 (measured between longitudinal side walls 5300, 5400). Similarly, the longitudinal dimension of the brace 5800 may be substantially equal to the longitudinal dimension of the trunk portion 5100, extending from top edge 5102 to the bottom edge 5104, or lowermost point of the sleeper cover 5000. While the support brace 5800 is illustrated as resting on top of the trunk portion 5100 of the sleeper cover 5000, in other embodiments, the support brace 5800 may be disposed within the softgoods of the trunk portion 5100 of the sleeper cover 5000.

Figure 13B:
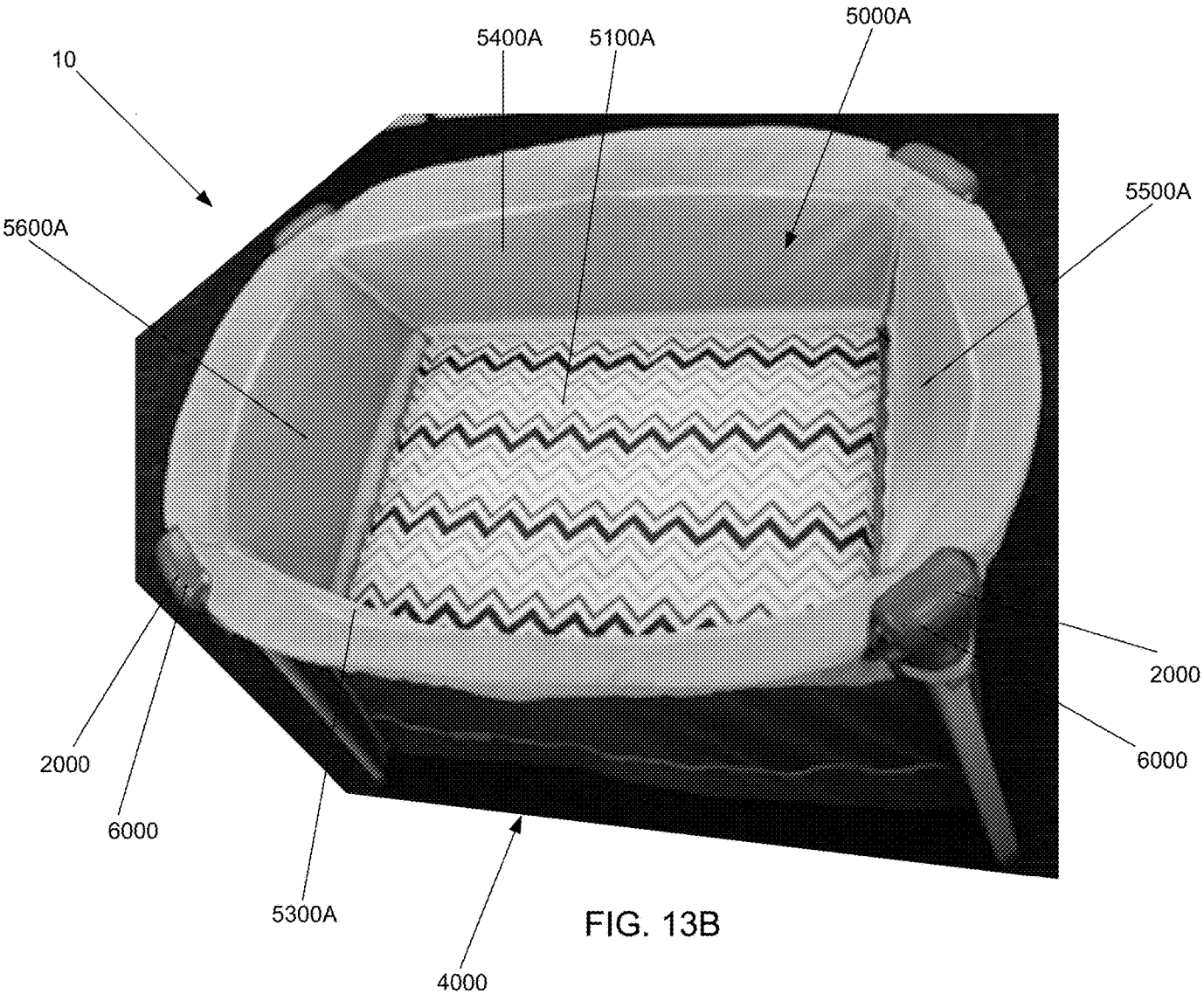
FIG. 13B illustrates a top perspective view of an alternative embodiment of the sleeper cover illustrated in FIG. 13A.

Illustrated in FIG. 13B is an alternative embodiment of the sleeper cover 5000A. As illustrated in FIG. 13B, this embodiment of the sleeper cover 5000A includes a horizontal support platform 5100A rather than the inclined sleeping surface created by the trunk portion 5100 and the foot portion 5200 of the first embodiment of the sleeper cover 5000 illustrated in FIG. 13A. Similar to the first embodiment of the sleeper cover 5000, the alternative embodiment of the sleeper cover 5000A also includes a front longitudinal sidewall 5300A, a rear longitudinal sidewall 5400A, a first side latitudinal sidewall 5500A, and a second latitudinal sidewall 5600A. In addition, the horizontal support platform 5100A of the alternative embodiment of the sleeper cover 5000A is configured to support an infant above a support surface, and above the bottom 4300 of the play yard cover 4000. The horizontal support platform 5100A is positioned between the walls formed by the inner portion 4120 and side panels 4200 of the play yard cover 4000, which prevents an infant placed in the sleeper cover 5000A from rolling or falling out of the sleeper cover 5000A.

Retuning to FIG. 13A, a storage attachment 9000 is illustrated with a top 9002, a bottom 9004, and a pocket 9006. The storage attachment 9000 is coupled to the latitude side wall 5500 of the sleeper cover 5000 and hangs down proximate one of the first or second side panels 4210, 4230 of the play yard cover 4000. The storage attachment 9000 may be permanently coupled to the sleeper cover 5000, or may be removably coupled via buttons, snaps, hook and loop fasteners, etc. Furthermore, in other embodiments, the storage attachment 9000 may be coupled to the sleeper cover 5000 so that it hangs down proximate a location other than the first side 4130 of the top 4100 of the play yard cover 4000. Other embodiments of the storage attachment 9000 may be coupled to the play yard cover 4000 at various locations along the play yard cover 4000.

Figure 15A:
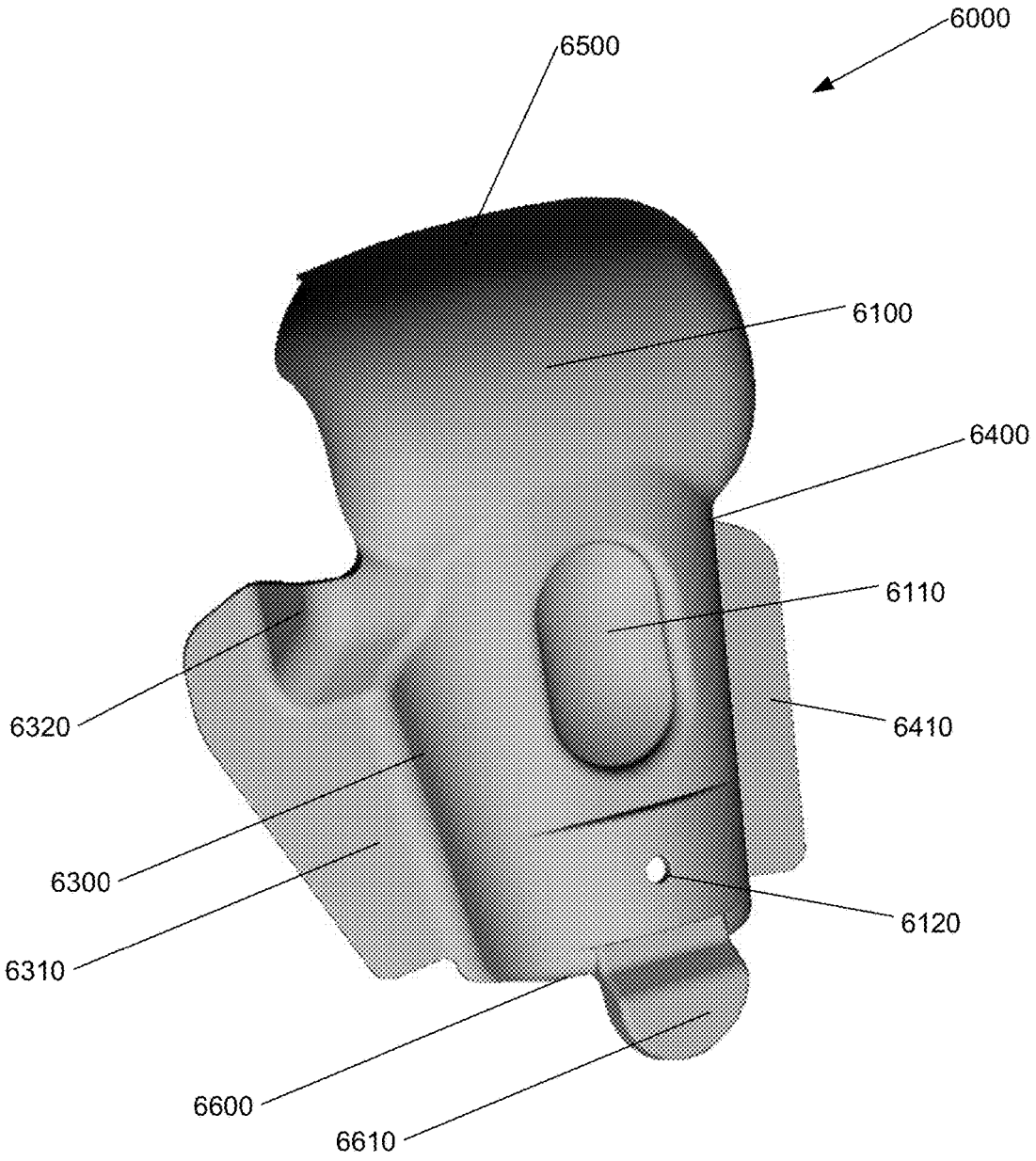
FIG. 15A illustrates a perspective view of the outer surface of the locking cover of the sleeper cover illustrated in FIG. 13A.
Figure 15B:
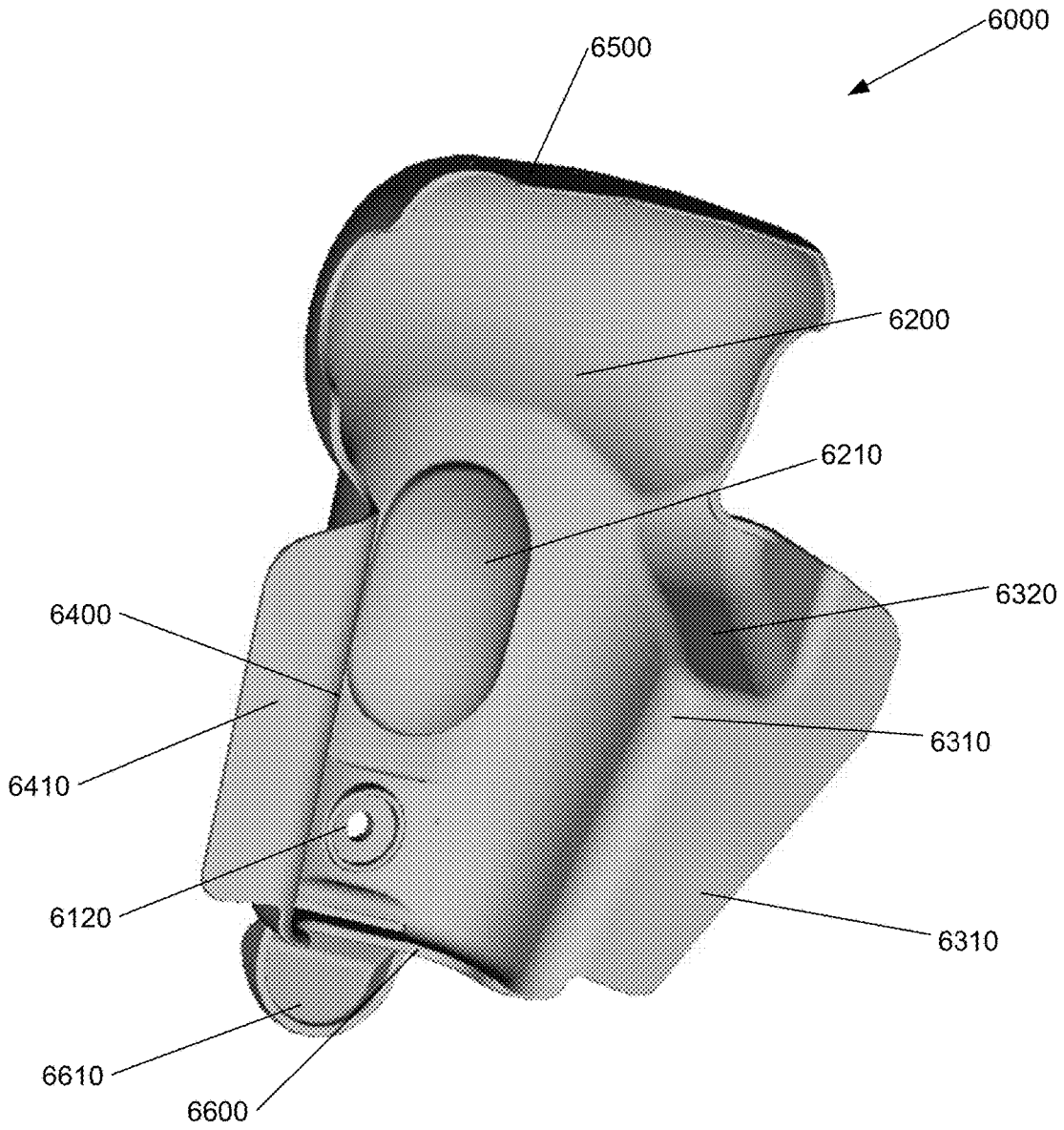
FIG. 15B illustrates a perspective view of the inner surface of the locking cover illustrated in FIG. 15A.

Turning now to FIGS. 15A and 15B, illustrated are perspective views of the front and back of the locking covers 6000. The discussion of FIGS. 15A and 15B only includes one locking cover 6000, but, because the locking covers 6000 are structurally identical to each other, the discussion of this embodiment of the locking cover 6000 can be applied to all of the locking covers 6000 illustrated in FIGS. 13A, 17A, 17B, and 17C. As will be later explained, the locking covers 6000 are coupled to each of the corners of the sleeper cover 5000 to enable the coupling of the sleeper cover 5000 to the play yard 4000. The locking cover 6000 is shaped substantially similar to that of a portion of the outer surface of second embodiment of leg lock 2000, which is illustrated in FIGS. 14A, 14B, 14C, and 14D. The locking covers 6000 include a top 6500, a bottom 6600 opposite the top 6500, a first side 6300 connecting the top 6500 to the bottom 6600, a second side 6400 opposite the first side 6300 that also connects the top 6500 to the bottom 6600, an outer surface 6100 and an inner surface 6200. The top 6500 of the locking cover 6000 is substantially rounded similar to that of the upper portions 2110, 2210 of the first and second housings 2100, 2200 of the leg lock 2000. Moreover, the bottom 6600 of the locking cover 6000 includes a tab 6610 that extends downwardly and slightly outwardly from the bottom 6600 of the locking cover 6000.

As further illustrated in FIGS. 15A and 15B, the first side 6300 of the locking cover 6000 includes a first flange 6310 that extends laterally outward from the first side 6300 of the locking cover 6000. The first side 6300 also includes a projection 6320 that extends outwardly from the first side 6300. As illustrated in FIGS. 15A and 15B, the projection 6320 forms an extension of the area formed by the inner surface 6200 of the locking cover 6000. The second side 6400 of the locking cover 6000 includes a second flange 6410 that extends laterally outward from the second side 6400 of the locking cover 6000.

The outer surface 6100 of the locking cover 6000 includes a cavity 6110 and an aperture 6120. As illustrated in FIG. 15A, the cavity 6110 is centrally located on the outer surface 6100 of the locking cover 6000, and is equivalent in shape and size to the locking cavity member 2710 of the second embodiment of the leg lock 2000. Moreover, the aperture 6120 is disposed on the outer surface 6100 proximate the bottom 6600 of the locking cover 6000. The aperture 6120 is configured to extend through the locking cover 6000 from the outer surface 6100 to the inner surface 6200. As illustrated in FIG. 15B, the inner surface 6200 of the locking cover 6000, which mimics the shape of the outer surface 6100, includes a projection 6210. The projection 6210 is formed of the same shape and at the same location as the cavity 6110 on the outer surface 6100 of the locking cover

6000. The projection 6210 projects inwardly from the inner surface 6200 of the locking cover 6000.

Figure 16A:
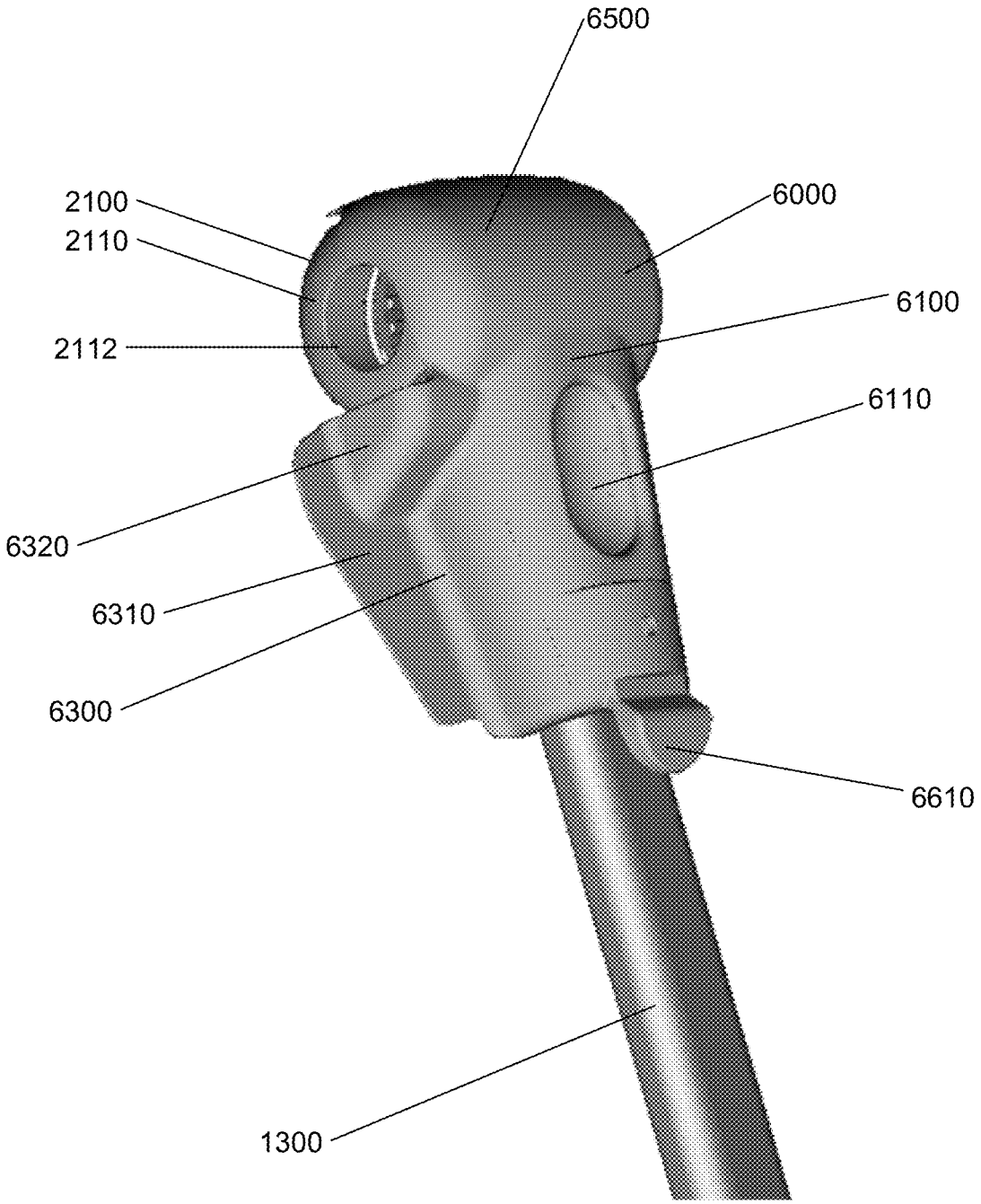
FIG. 16A illustrates a perspective view of the locking cover illustrated in FIG. 15A coupled to the second embodiment of the leg lock illustrated in FIG. 14A.
Figure 16B:
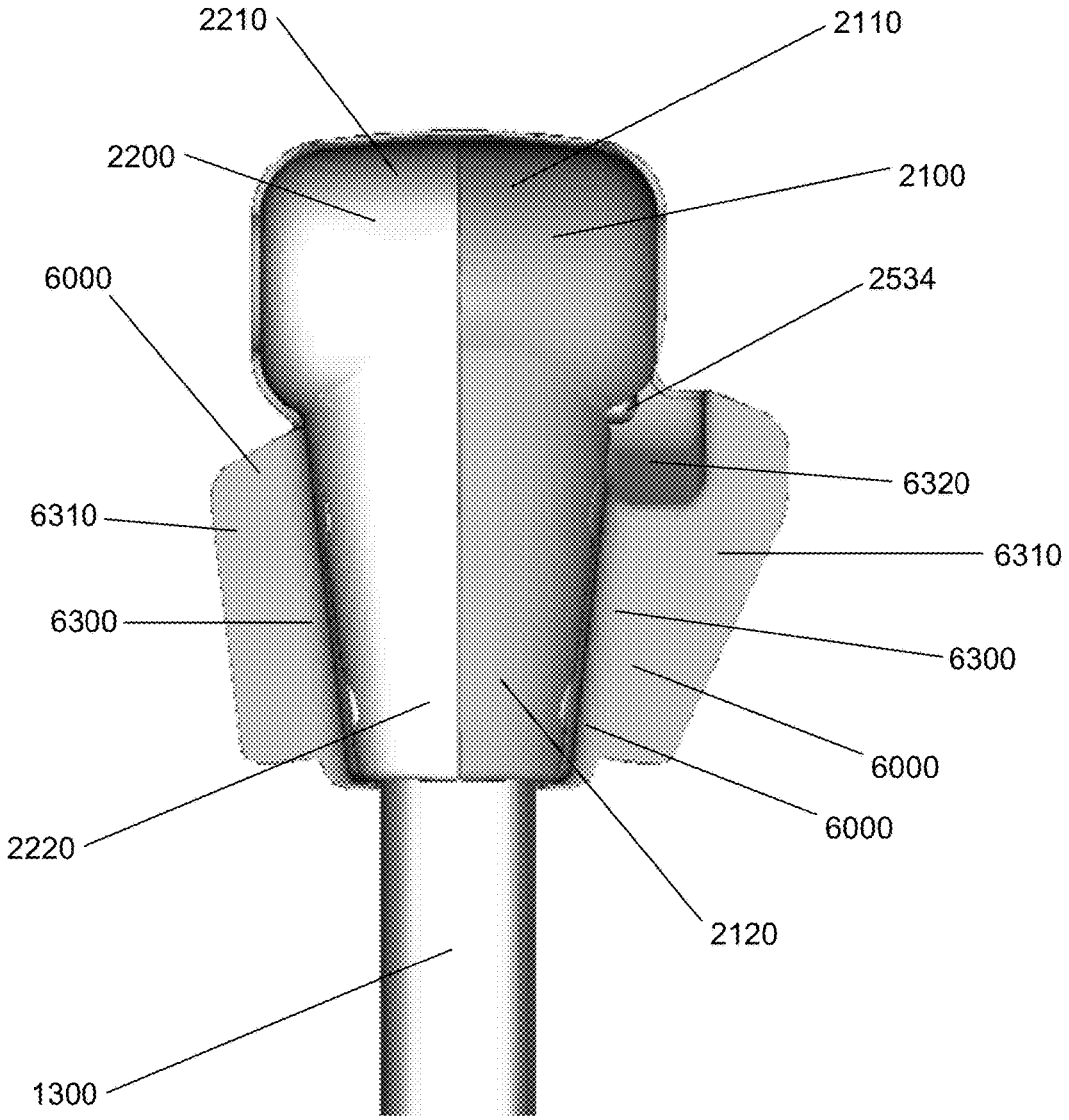
FIG. 16B illustrates a rear view of the locking cover illustrated in FIG. 15A coupled to the second embodiment of the leg lock illustrated in FIG. 14A.
Figure 16C:
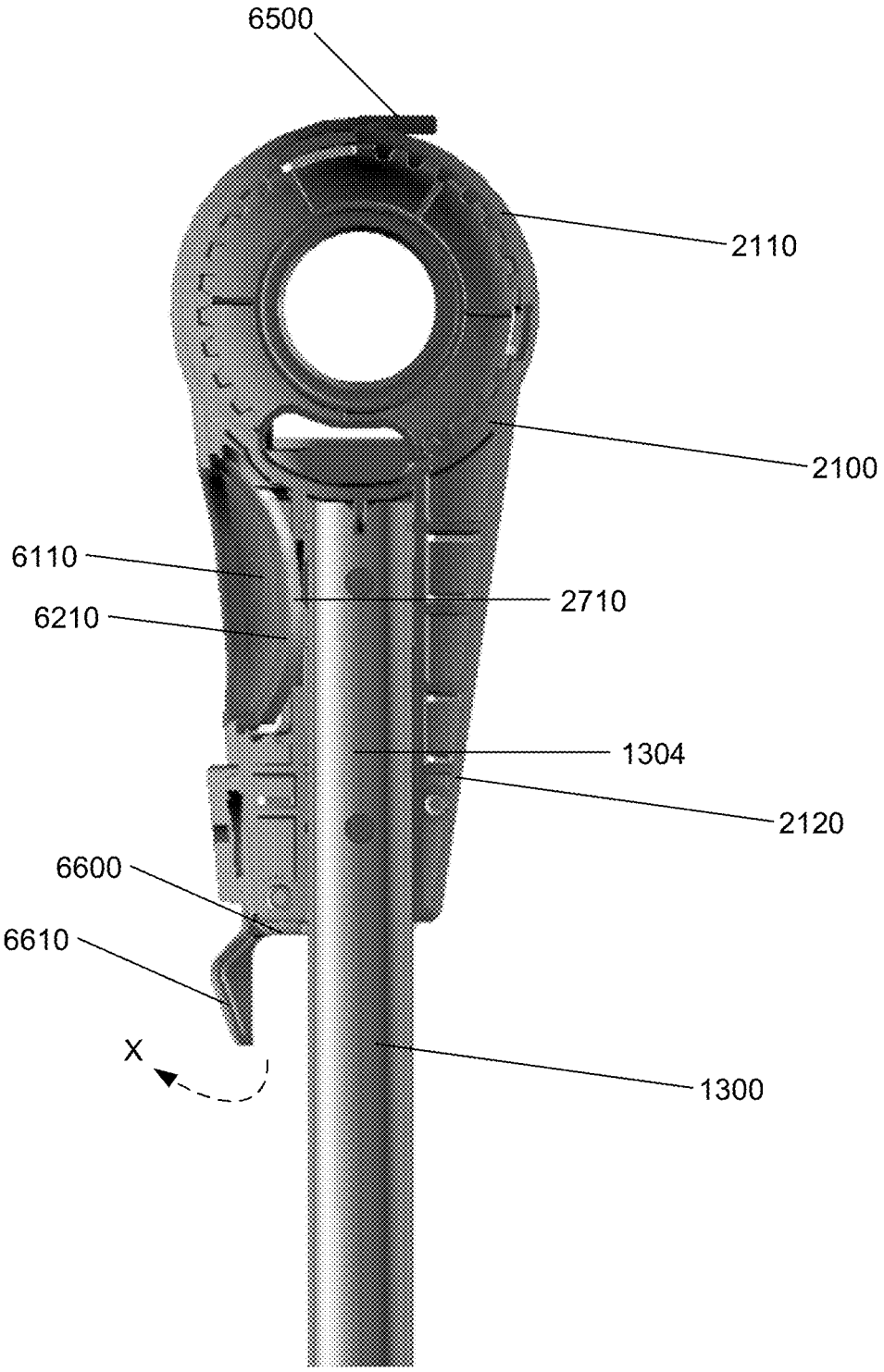
FIG. 16C illustrates a cross sectional view of the locking cover illustrated in FIG. 15A coupled to the second embodiment of the leg lock illustrated in FIG. 14A.

Turning to FIGS. 16A, 16B, and 16C, illustrated is the locking cover 6000 removably coupled to the second embodiment of the leg lock 2000. As best illustrated in FIGS. 16A and 16B, the locking cover 6000 extends the length of the leg lock 2000 with the top 6500 of the locking cover 6000 positioned above the upper portions 2110, 2210 of the housings 2100, 2200 of the leg lock 2000, and the bottom 6600 of the locking cover 6000 being positioned below the bottom of the lower portions 2120, 2220 of the housings 2100, 2200 of the leg lock 2000. As illustrated in FIGS. 16A and 16C, the top 6500 of the locking cover 6000 curves around the upper portions 2110, 2210 of the housings 2100, 2200 of the leg lock 2000. As best illustrated in FIG. 16B, the projection 6320 extending outwardly from the first side 6300 of the locking cover 6000 is positioned proximate to the actuator 2534 of the leg lock 2000 when the locking cover 6000 is coupled to the leg lock 2000. The projection 6320 is configured to prevent the actuator 2534 from being depressed when the locking cover 6000 is placed on the leg lock 2000. If the locking cover 6000 did not include projection 6320, and the first side 6300 mirrored the shape of the second side 6400, the actuator 2534 would be accidentally depressed when the locking cover 6000 was being attached to the leg lock 2000, causing the leg lock 2000 to be able to rotate about the frame 1000. Because of the projection 6320, accidental movement of the actuator 2534 is prevented when the locking covers 6000 are attached to the leg locks 2000 (when the sleeper cover 6000 is being attached or has been attached to the play yard 4000 and the apparatus 10). Therefore, the leg locks 2000 will remain locked in their deployed position when the sleeper cover 5000 is coupled to the play yard 4000 and the apparatus 10.

FIG. 16C illustrates a cross sectional view of the locking cover 6000 removably coupled to the leg lock 2000. As illustrated, the cavity 6110 and the projection 6210 extend into and contact the locking cavity member 2710 disposed within the lower portions 2120, 2220 of the housings 2100, 2200 of the leg lock 2000. This ensures that the locking cover 6000 is positioned correctly on the leg lock 2000 and prevents the locking cover 6000 from accidentally being disengaged from the leg lock 2000. By having the projection 6210 extend into engagement with the locking cavity member 2710, and in conjunction with the force supplied the resilient member 5720, the locking cover 6000 is prevented from accidentally sliding out of engagement with the leg lock 2000. Moreover, FIG. 16C illustrates how the tab 6610 extends downwardly and outwardly from the bottom 6600 of the locking cover 6000. A user can pull on the tab 6610 in the direction indicated by X to begin the process of removing the locking cover 6000 from the leg lock 2000.

Figure 17B:
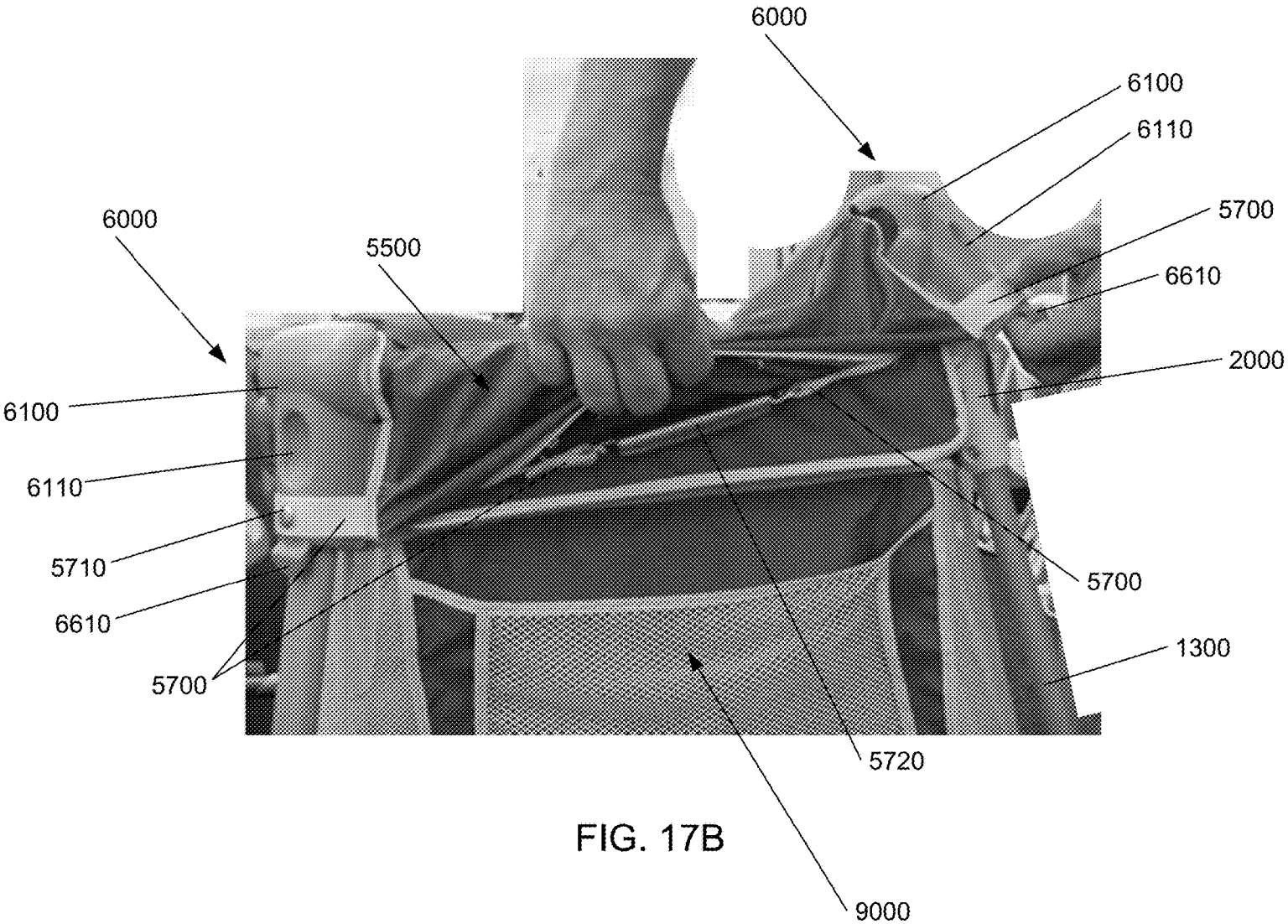
FIG. 17B illustrates a side view of the sleeper cover illustrated in FIG. 17A in the process of being coupled to the play yard.
Figure 17C:
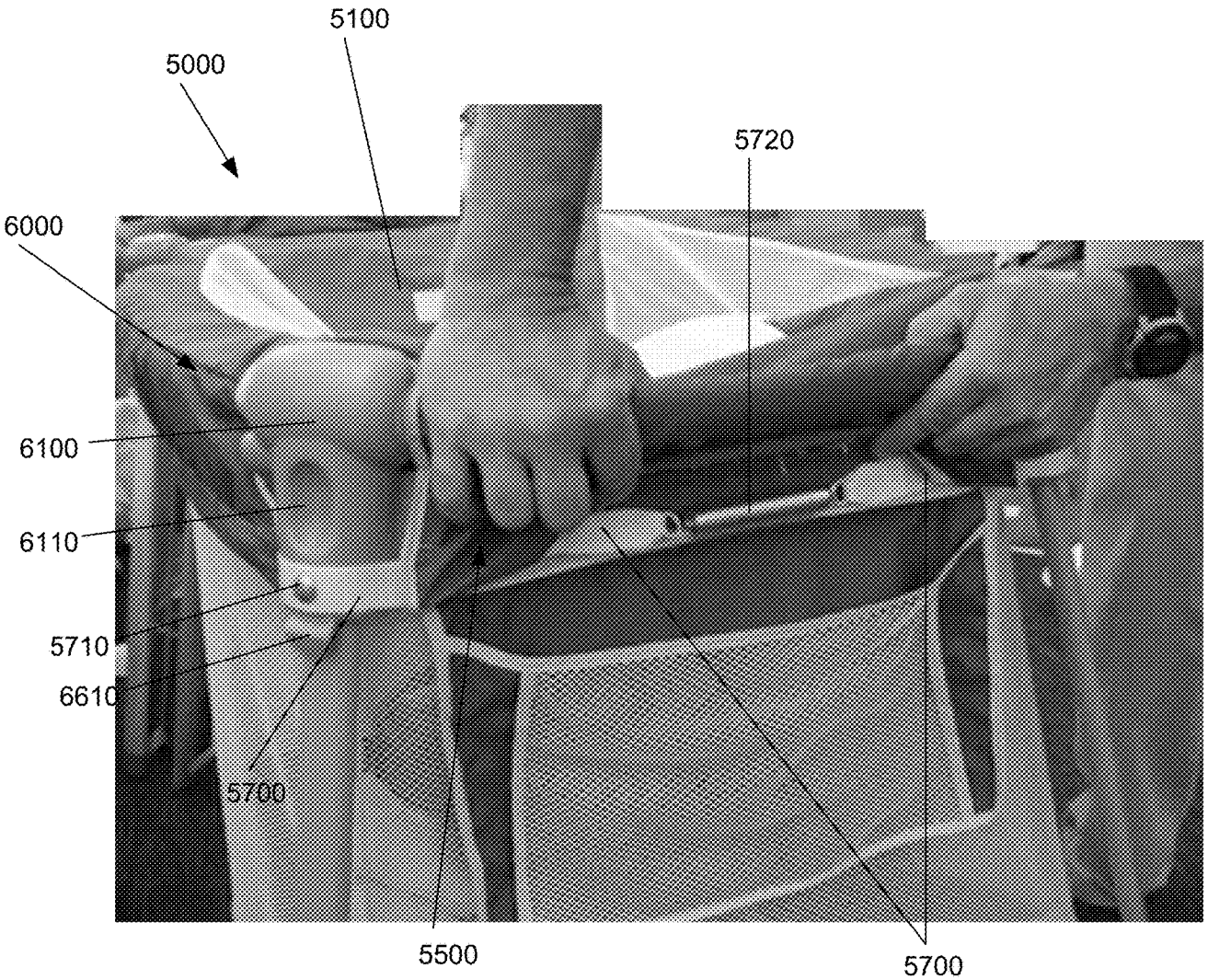
FIG. 17C illustrates a side view of the sleeper cover illustrated in FIG. 17A coupled to the play yard.

FIG. 17A illustrates the underside of one of the latitudinal side walls 5500, 5600 of the sleeper cover 5000. Because the first latitudinal side wall 5500 is substantially similar to the second latitudinal side wall 5600, the discussion of FIGS. 17A, 17B, and 17C applies to both the first and second latitudinal side wall 5500, 5600. As illustrated, the locking covers 6000 are positioned in the corners of the sleeper cover 5000. Moreover, the interior surface 6200 of the locking covers 6000 faces the same direction as the underside of the sleeper cover 5000. As further illustrated in FIGS. 13A, 17A, 17B, and 17C, the sleeper cover 5000 includes a strap 5700 that extends around the outer edge of the sleeper cover 5000. The strap 5700 is coupled to each of the locking covers 6000 via a connector 5710 that extends through the aperture 6120 of the outer surface 6100 of the locking cover 6000. Furthermore, as best illustrated by FIGS. 17A, 17B, and 17C, the strap 5700 includes a resilient member, which may be for example a spring, 5720 on the latitudinal side walls 5500, 5600 of the sleeper cover. While FIGS. 17A, 17B, and 17C only illustrate one latitudinal side wall 5500, 5600 of the sleeper cover 5000, the strap 5700 has a resilient member 5720 on both latitudinal side walls 5500, 5600 of the sleeper cover 5000. In the exemplary embodiment shown, the strap 5700 does not include a resilient member on the portion of the strap 5700 that extends along the longitudinal side walls 5200, 5300 between the locking covers 6000. Additional resilient members, however, may be added along the longitudinal side walls. In another embodiment, the resilient member 5720 may include an internal tether as a safety measure to prevent over extension and/or deformation of the resilient member 5720.

Referring to FIGS. 17B and 17C, illustrated is the connection of sleeper cover 5000 to the frame 1000 over the top of the play yard cover 4000. As illustrated in FIGS. 17B and 17C, when the sleeper cover 5000 is to be connected to the apparatus 10 in the sleeper configuration, the locking covers 6000 must be snapped over and secured to each of the leg locks 2000. As best illustrated in FIG. 17B, to secure the sleeper cover 5000 over the play yard apparatus 4000, the locking covers 6000 must slide over the top of the leg locks 2000 and into proper locking position around the leg locks 2000, which is best illustrated in FIGS. 16A, 16B, and 16C. As illustrated in FIG. 17B, as the locking covers 6000 are being slid over the top of the leg locks 2000, the resilient member 5720 of the strap 5700 expands. As the locking covers 6000 slide far enough over the leg lock 2000, the tension in the now expanded resilient member 5720 causes the locking covers 6000 to be pulled together and slide down and into the proper locking position on the leg lock 2000, where the protrusion 6210 on the inner surface 6200 of the locking cover 6000 extends into contact with the locking cavity member 2710 of the leg lock 2000 (illustrated in FIG. 16C). The resilient member 5720 assists users in properly fitting the sleeper cover 5000 over the play yard cover 4000 and onto the apparatus 10. Furthermore, because of the tension provided by the resilient member 5720, the locking covers 6000 are ensured to snap onto the leg locks 2000 in the proper position and orientation, aiding in preventing user error in attaching the sleeper cover 5000 to the apparatus 10.

As further illustrated by FIG. 17C, while the locking covers 6000 of the sleeper cover 5000 are attached to the leg locks 2000, and the strap 5700 is stretched taut about the perimeter of the play yard cover 4000 and the frame 1000, the resilient member 5720 remains at least partially stretched. When the sleeper cover 5000 is in the process of being attached to the apparatus 10, as illustrated in FIG. 17B, the resilient member 5720 is stretched farther than when the sleeper cover 5000 is secured to the apparatus 10, as illustrated in FIG. 17C. While the resilient member 5720 is not expanded as far in FIG. 17C, the resilient member 5720 still provides tension between the locking covers 6000 and the leg locks 2000 to ensure that the locking covers 6000 remain secured to the leg locks 2000. This results in the sleeper cover 5000 remaining secured to the apparatus 10, even when an infant is placed within the sleeper cover 5000. In other words, the tension in the resilient member 5720 when the sleeper cover 5000 is secured to the apparatus 10 prevents the locking covers 6000 from sliding out of engagement with leg locks 2000 when an infant is placed within the sleeper cover 5000. The tension in the resilient member 5720 also makes assembly substantially easier because locking covers 6000 do not need to be substantially deformed to attach to leg locks 2000. Many prior art play yard bassinet attachments require that plastic hooks or clips be deformed to wrap around and catch onto some portion of the upper frame of the play yard. This requires caregivers to individually press on each attachment spot with substantial force to plastically deform it enough to attach to the play yard, substantially increasing the chances for false latching and increasing the risk to children then inserted into an improperly or not fully assembled sleeper. Resilient member 5720 obviates the need for such deforming of the attachment elements. Locking covers 6000 need only to slide over leg locks 2000, at which point locking covers 6000 and the leg locks 2000 are pulled together by resilient member 5720. The locking covers 6000 do not need to deform around the leg locks 2000 and then plastically revert to their original shape to catch onto any attachment point.

Furthermore, tension may remain in the resilient member 5720 when the sleeper cover 5000 is secured to the apparatus 10 because the perimeter of the strap 5700, with the resilient member 5720 un-tensioned, is equal to or less than the perimeter of the frame 1000. Because the perimeter of the strap 5700 is smaller than the perimeter of the frame 1000, the strap 5700 may be positioned slightly underneath the top rail of the frame 1000 when the sleeper cover 5000 and locking covers 6000 are coupled to the leg locks 2000. The strap 5700 being positioned underneath the top rail of the frame 1000 when the sleeper cover 5000 is coupled to the leg locks 2000 maintains all of outer edges 5310, 5410, 5510, 5610 of the side walls 5300, 5400, 5500, 5600 of the sleeper 5000 as being folded over the top portion 4100 of the play yard 4000. This prevents any access to the interior 4002 of the play yard cover 4000 by the infant and the parent while the sleeper cover 5000 is properly coupled to the leg locks 2000.

Figure 18A:
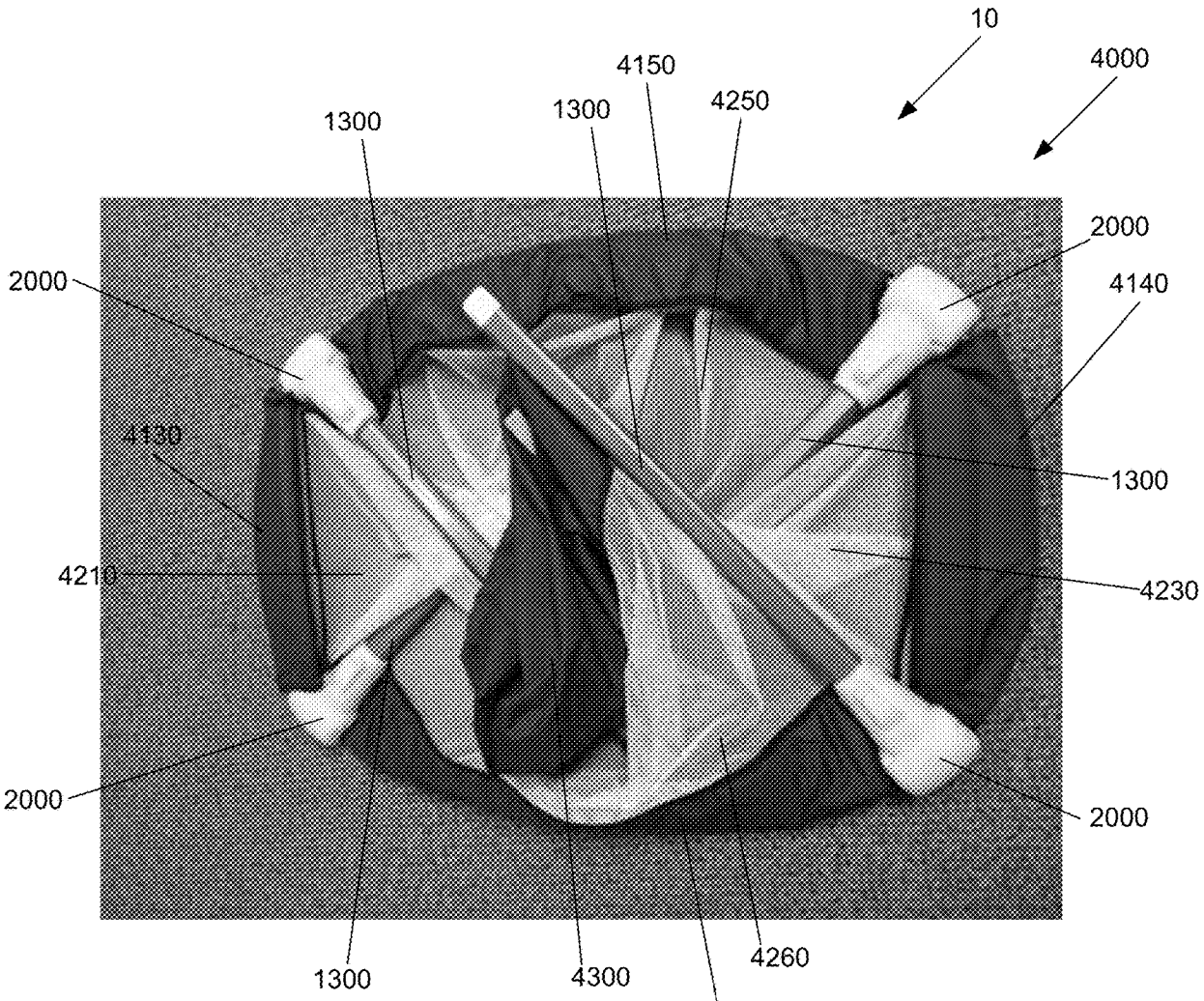
FIG. 18A illustrates a bottom view of the play yard illustrated in FIG. 11A with the legs of the play yard folded to the storage position.

FIGS. 18A, 18B, 18C, 18D, and 18E illustrate the process for configuring the apparatus 10 in the storage configuration. As illustrated in FIG. 18A, the sleeper cover 5000 is no longer connected to the play yard cover 4000 and the frame 1000 of the apparatus. Moreover, the apparatus 10 has been flipped over so that the first side 4130, the second side 4140, the front side 4150, and the rear side 4160 of the top portion 4100 of the play yard cover 4000 are in contact with the support surface. Furthermore, the legs 1300 of the frame 1000 and the leg locks 2000 have been rotated about the frame 1000 so that the legs 1300 are in the folded configuration. As previously explained when discussing FIGS. 8A, 8B, and 9, each of the leg locks 2000 includes an actuator 2534 that, when depressed by a user, allows the user to rotate the leg lock 2000, and ultimately the leg 1300 coupled to that leg lock 2000, about either the first horizontal member 1100 or the second horizontal member 1200 of the frame 1000.

As illustrated in FIG. 18A, the legs 1300 have been rotated in to be substantially within the same plane as the frame 1000, which is wrapped within the upper portion 4100 of the play yard cover 4000. Moreover, because the bottom 4300 and the side panels 4210, 4230, 4250, 4260 were coupled to the distal ends 1310 of the legs 1300 via tethers 4224, 4244, the bottom 4300 and the side panels 4210, 4230, 4250, 4260 are repositioned to be substantially within the same plane as the frame 1000, which is wrapped within the upper portion 4100 of the play yard cover 4000. In addition, before the legs 1300, the bottom 4300, and the side panels 4210, 4230, 4250, 4260 can be placed in the folded leg configuration, the mattress 4310 must be removed from the bottom 4300 of the play yard cover 4000. Thus, as illustrated in FIG. 18A, when in the folded leg configuration, the apparatus 10 is configured to lay flat on a support surface.

Figure 18B:
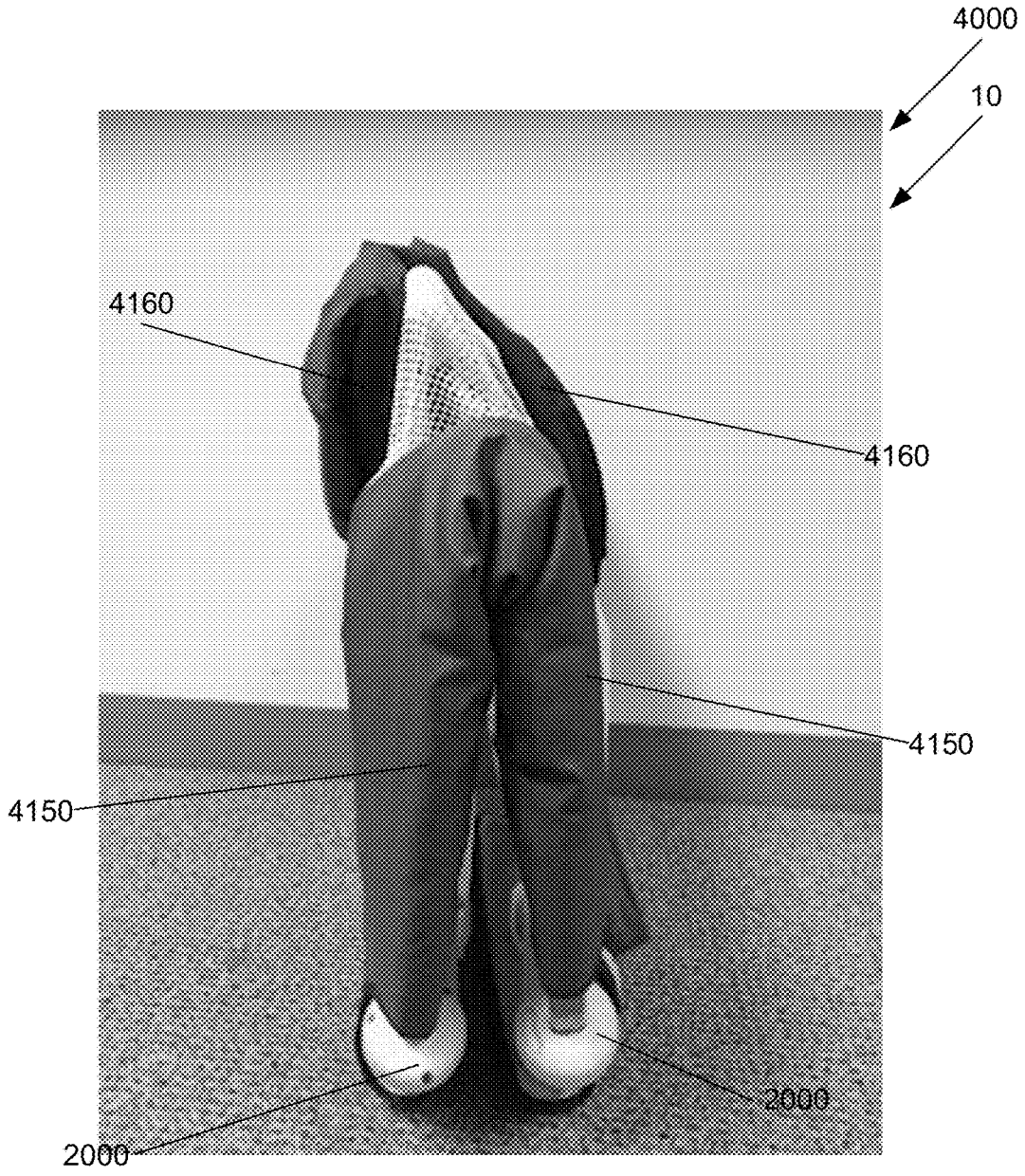
FIG. 18B illustrates a side view of the play yard illustrated in FIG. 11A with the frame folded in half.

Turning to FIG. 18B, the apparatus 10 has been reconfigured from the folded leg configuration to the folded frame configuration. When in the folded frame configuration, the frame 1000, and thus the play yard cover 4000, is folded in half. As previously explained with the discussion of FIGS. 1, 2A, and 2B, the frame 1000 includes a pair of frame locks 3000 that enable the first horizontal member 1100 to be folded proximate to the second horizontal member 1200. Moreover, when reconfigured to the folded frame configuration, the leg locks 2000 rotatably coupled to the first horizontal member 1100 are positioned proximate to the leg locks 2000 rotatably coupled to the second horizontal member 1200. Furthermore, as illustrated in FIG. 18B, when reconfigured from the folded leg configuration to the folded frame configuration, the frame 1000 and the front and rear side 4150, 4160 of the top portion 4100 of the play yard cover 4000 are folded in half. This reduces the length of the apparatus 10 in half, making it easily packable and storable.

Figure 18C:
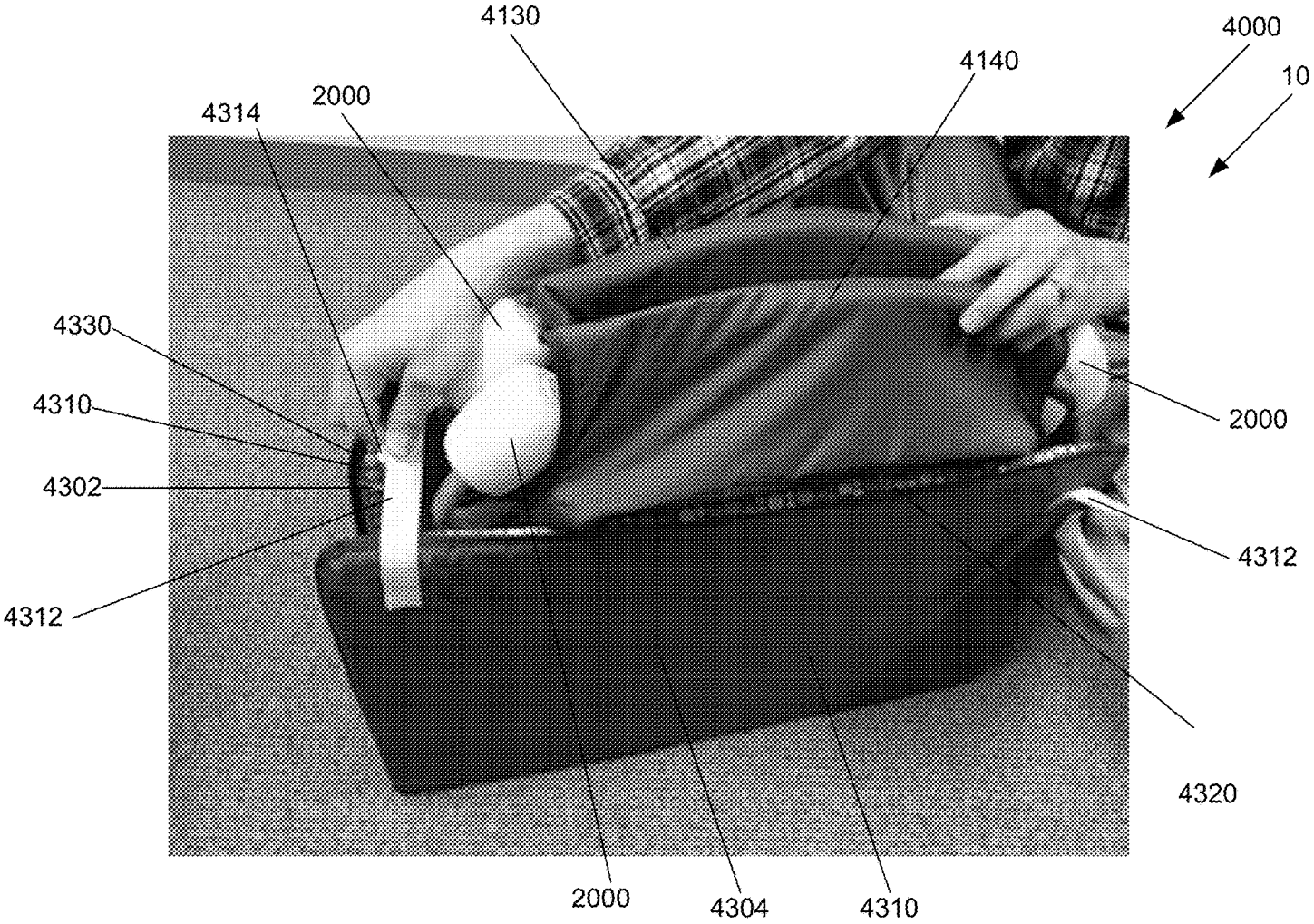
FIG. 18C illustrates a perspective view of the folded play yard illustrated in FIG. 18B with the mattress folded around the frame.

FIG. 18C illustrates the apparatus 10 reconfigured in the folded frame configuration with the mattress 4300 being folded around the folded frame 1000 and play yard cover 4000. The mattress 4300 includes a top surface 4302 and a bottom surface 4304. The mattress 4300 also includes a first end 4320 and a second end 4330. As illustrated in FIG. 18C, the mattress 4300 is folded in half around the folded apparatus 10 with the top surface 4302 abutting the play yard cover 4000, and the bottom surface 4304 being exposed. The mattress 4300 includes a first pair of straps 4312 disposed on the bottom 4304 proximate the first side 4320 and a second pair of straps 4314 disposed on the bottom 4304 proximate the second side 4330. The first and second pair of straps 4312, 4314 are configured to be coupleable to one another, securing the mattress 4300 in a folded position around the apparatus 10. With the mattress 4300 coupled to the apparatus 10, the leg locks 2000 and the first and second sides 4130, 4140 of the play yard cover 4000 are still exposed. Furthermore, by coupling the mattress 4300 to the apparatus 10, the mattress 4300 does not get lost or separated from the apparatus 10 when put into storage.

Figure 18D:
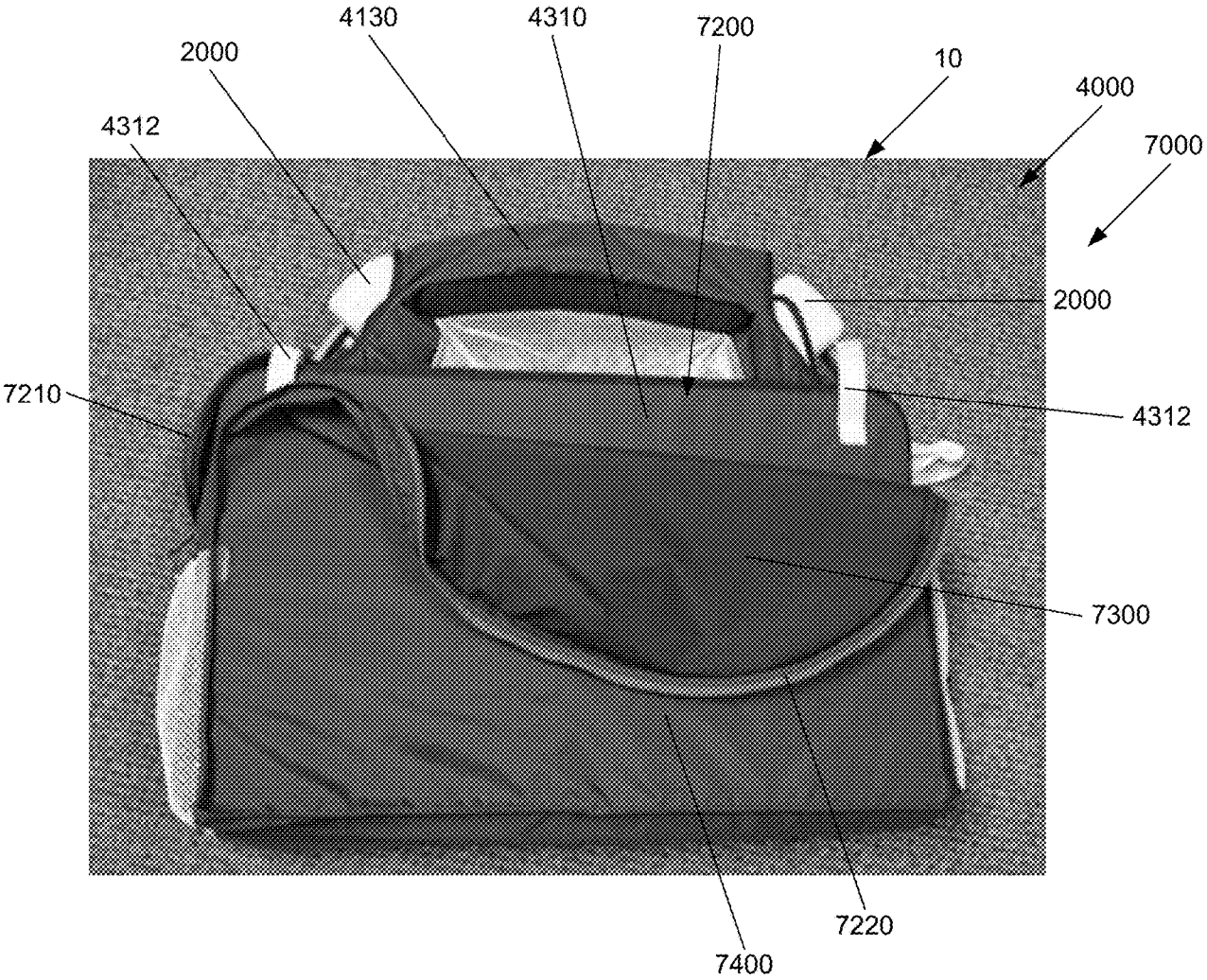
FIG. 18D illustrates a side view of the folded play yard illustrated in FIG. 18C being inserted into a storage bag.
Figure 18E:
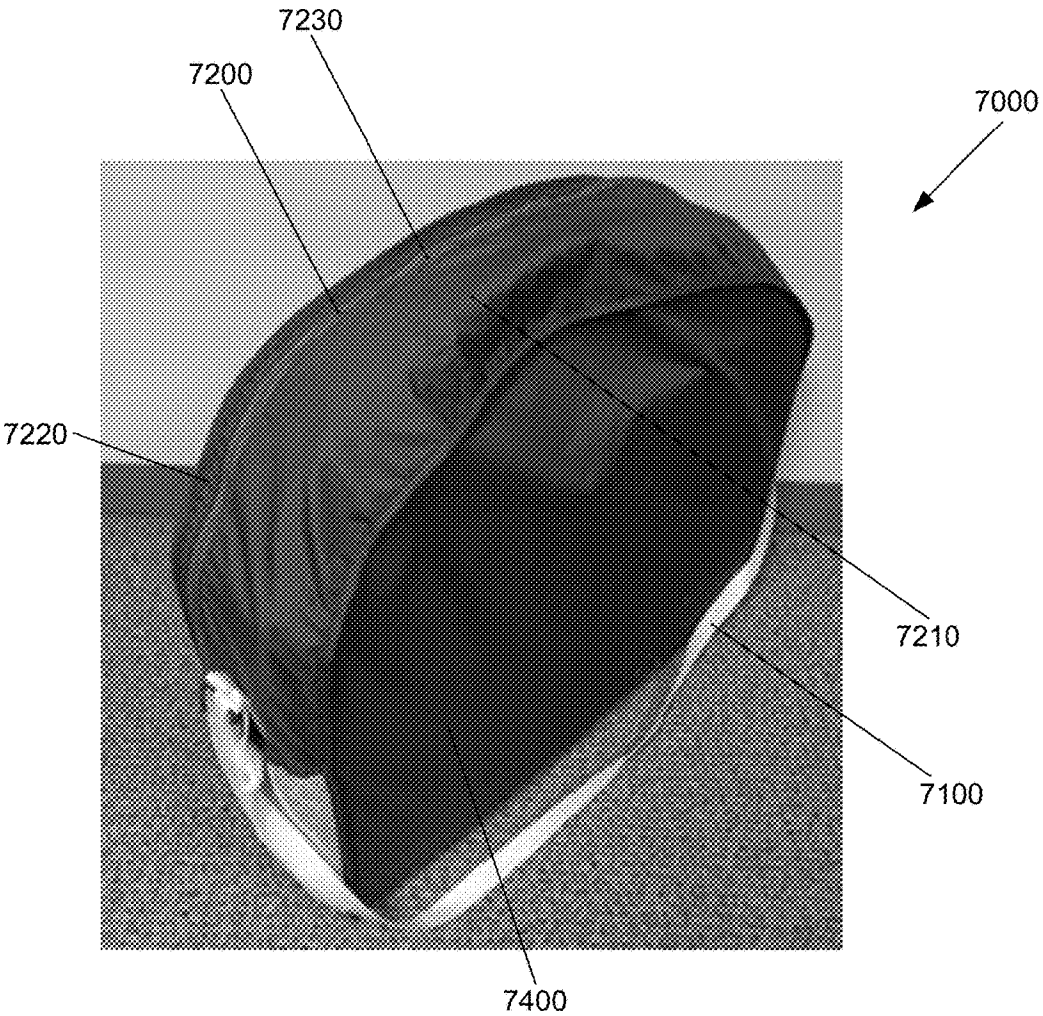
FIG. 18E illustrates the storage bag illustrated in FIG. 18D enclosing the play yard.

As illustrated in FIGS. 18D and 18E, once the apparatus 10 has been reconfigured to the folded frame configuration, and the mattress 4300 has been coupled around the apparatus 10 in the folded frame configuration, the apparatus 10 may be placed within a storage bag 7000 in the storage configuration. The storage bag 7000 includes an exterior surface 7400, an interior surface 7300, and a top opening 7200 that provides access to the interior surface 7300. The top opening 7200 includes a first side 7210 and a second side 7220. The first and second sides 7210, 7220 of the top opening 7200 may be coupled to one another to close the top opening 7200 by a zipper 7230. In other embodiments, the first and second sides 7210, 7220 of the top opening 7200 may be coupled via other means, such as snap buttons, hook and loop fasteners, etc. Furthermore, as best illustrated in FIG. 18D, the storage bag 7000 is sized and shaped to receive the apparatus 10 when the apparatus 10 is reconfigured to the folded frame configuration. The apparatus 10 can be slid into the storage bag 7000 through the top opening 7200. When positioned in the storage bag 7000, because of the curved shape of the top opening 7200, the leg locks 2000 and the first and second sides 4130, 4140 of the play yard cover 4000 are proximate to the top opening 7200. As further illustrated in FIG. 18E, the storage bag 7000 includes a handle or carrying strap 7100. The handle 7100 facilitates easy transportation of the storage bag 7000, and thus the apparatus 10, from one location to another.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Therefore, although the disclosed inventions are illustrated and described herein as embodied in one or more specific examples, it is nevertheless not intended to be limited to the details shown, since various modifications and structural changes may be made therein without departing from the scope of the inventions. Further, various features from one of the embodiments may be incorporated into another of the embodiments. Accordingly, it is appropriate that the invention be construed broadly and in a manner consistent with the scope of the disclosure.

What is claimed is:

1. An infant support apparatus comprising:

a first support structure comprising:

a frame defining an opening, a plurality of corner connectors coupled to the frame, the plurality of corner connectors having an inner surface that faces a first direction toward an interior of the infant support apparatus and an outer surface that faces a second direction outwardly from the infant support apparatus and opposite of the first direction, wherein the outer surface of the plurality of corner connectors have a first shape that includes a cavity that faces the second direction, and a support member coupled to and extending from each of the plurality of corner connectors, the plurality of support members supporting the frame over a support surface; and a second support structure removably coupled to the first support structure, the second support structure covering the opening defined by the frame when coupled to the first support structure, the second support structure comprising:

an infant receiving portion, a plurality of rigid corner covers coupled to the infant receiving portion and configured to engage the outer surface of the plurality of corner connectors to removably couple the second support structure to the first support structure, wherein the plurality of rigid corner covers have a second shape substantially identical to the first shape of the outer surface of the plurality of corner connectors and include a projection substantially equal in shape and size to the cavity in the outer surface of each of the plurality of corner connectors, and a strap at least partially disposed circumferentially around the infant receiving portion and coupled to the plurality of rigid corner covers.

2. The infant support apparatus of claim 1, wherein the plurality of corner connectors are rotatably coupled to the frame and configured to rotate between a storage position and a deployed position.

3. The infant support apparatus of claim 1, wherein the strap is resilient.

4. The infant support apparatus of claim 1, wherein the strap includes at least one resilient member.

5. An infant support structure comprising:

a frame defining an opening;

a plurality of support members coupled to the frame, each of the plurality of support members comprising:

a corner connector coupled to the frame, the corner connector including an inner surface facing toward an interior of the infant support structure and an opposite outer surface facing outward from the infant support structure, wherein the outer surface includes a cavity, and a leg coupled to and extending from the corner connector; and an infant receiving insert removably coupled to the corner connectors of the plurality of support members, the insert being at least partially disposed within the opening when coupled to the corner connectors, the insert comprising:

a plurality of rigid corner covers that engage the outer surface of the corner connectors of the plurality of supports and include a projection substantially equal in shape and size to the cavity in the outer surface of each of the plurality of corner connectors, and a strap element at least partially disposed circumferentially around the insert and coupled to each of the plurality of rigid corner covers.

6. The infant support structure of claim 5, wherein the projection in the corner cover is disposed against the cavity in the outer surface of the corner connectors when the plurality of rigid corner covers are engaged with the corner connectors.

7. The infant support structure of claim 5, wherein the strap element includes at least one resilient portion.

8. An infant support comprising:

a frame defining an opening, the frame comprising;

a plurality of corner connectors disposed around the frame, the corner connector including an inner surface facing toward an interior of the infant support and an opposite outer surface facing outward from the infant support, wherein the outer surface includes a cavity;

a plurality of support members coupled to and extending from the plurality of corner connectors;

an insert removably coupled to the frame, the insert at least partially disposed within the opening when removably coupled to the frame; and a strap at least partially disposed circumferentially around the insert, the strap coupled to a plurality of rigid corner covers that engage the outer surface of the plurality of corner connectors when the insert is removably coupled to the frame, wherein the rigid corner covers include a projection substantially equal in shape and size to the cavity in the outer surface of each of the plurality of corner connectors.

9. The infant support of claim 8, wherein the outer surface of each of the plurality of corner connectors includes a hook.

10. The infant support of claim 9, wherein the strap is configured to engage with the hooks of the plurality of corner connectors to removably couple the insert to the plurality of corner connectors.

11. The infant support of claim 8, wherein the strap includes at least one resilient portion.

* * * * *